US006184799B1

(12) United States Patent
Jinno et al.

(10) Patent No.: US 6,184,799 B1
(45) Date of Patent: Feb. 6, 2001

(54) MONITORING APPARATUS AND CONTROL APPARATUS FOR TRAFFIC SIGNAL LIGHTS

(75) Inventors: Yoshitaka Jinno; Yoshiharu Ozaki; Norihiro Okada; Heisaku Mazawa; Hidetoshi Fujimoto; Junya Toda; Koichi Futsuhara; Norihiro Asada, all of Urawa (JP)

(73) Assignee: The Nippon Signal Co., Ltd., Tokyo (JP)

( * ) Notice: Under 35 U.S.C. 154(b), the term of this patent shall be extended for 0 days.

(21) Appl. No.: 08/750,771

(22) PCT Filed: Apr. 20, 1995

(86) PCT No.: PCT/JP95/00783

§ 371 Date: Dec. 17, 1996

§ 102(e) Date: Dec. 17, 1996

(87) PCT Pub. No.: WO96/33480

PCT Pub. Date: Oct. 24, 1996

(51) Int. Cl.[7] ..... G08G 1/095

(52) U.S. Cl. ..... 340/907; 340/931; 340/642; 340/953; 315/130

(58) Field of Search ..... 340/907, 931, 340/953, 642, 458; 315/130

(56) References Cited

U.S. PATENT DOCUMENTS

| | | | | |
|---|---|---|---|---|
| 3,629,802 | * | 12/1971 | Clark | 340/642 |
| 3,902,156 | * | 8/1975 | Hill | 340/642 |
| 4,135,145 | * | 1/1979 | Eberle | 340/642 |
| 4,255,738 | * | 3/1981 | Van Tol | 340/642 |
| 4,661,880 | | 4/1987 | Futusuhara . | |
| 4,667,184 | | 5/1987 | Futusuhara . | |
| 5,027,114 | | 6/1991 | Kawashima et al. . | |
| 5,248,967 | * | 9/1993 | Daneshfar | 340/931 |
| 5,387,909 | * | 2/1995 | Neel et al. | 340/931 |

FOREIGN PATENT DOCUMENTS

| | | |
|---|---|---|
| 28 51 050 | 11/1978 | (DE) . |
| 34 15 143 | 4/1984 | (DE) . |
| 0 214 692 | 9/1986 | (EP) . |
| 2 672 145 | 1/1991 | (FR) . |
| 2 012 465 | 1/1979 | (GB) . |
| 43-29297 | 12/1968 | (JP) . |
| 48-31907 | 9/1973 | (JP) . |
| 53-4800 | 2/1978 | (JP) . |
| 54-98199 | 8/1979 | (JP) . |
| 55-127698 | 10/1980 | (JP) . |
| 55-127699 | 10/1980 | (JP) . |
| 56-24699 | 3/1981 | (JP) . |
| 56-167498 | 12/1981 | (JP) . |
| 6-201733 | 7/1994 | (JP) . |

OTHER PUBLICATIONS

Masakazu Kato et al, "LSI Implementation and Safety Verification of Window Comparator Used in Fail–Safe Multiple–Valued Logic Operations" IEICE Trans. Electron., vol. E76–C, No. 3 Mar. 1993, pp. 419–427.

* cited by examiner

*Primary Examiner*—Nina Tong
(74) *Attorney, Agent, or Firm*—McDermott, Will & Emery

(57) ABSTRACT

Monitoring and control apparatus for fail-safe monitoring for normal operation of traffic signal lights provided at an intersection or the like where a plurality of roads intersect. The illumination conditions of respective signal lights are detected using as sensor device, and when the number of illuminated or non-illuminated signal lights is a predetermined number, a normal judgment output of logic value 1 corresponding to a high energy condition is generated while, when the number of illuminated or non-illuminated signal lights is not the predetermined number, an abnormal judgment output of logic value 0 corresponding to a low energy condition is generated. As a result, when a fault in the monitoring apparatus stops the output, the resultant output condition is the same as for a danger condition due to a signal light abnormality, resulting in an extremely safe signal light monitoring and control with excellent fail-safe characteristics.

11 Claims, 47 Drawing Sheets

(a)

(b)

(a)

(b)

(a)

(b)

(a)

(b)

(c)

(a)

(b)

(a)

(b)

MONITORING APPARATUS AND CONTROL APPARATUS FOR TRAFFIC SIGNAL LIGHTS

TECHNICAL FIELD

The present invention relates to a monitoring apparatus for advising if an illumination condition of traffic signal lights is normal or abnormal, and a control apparatus for controlling the signal lights based on an advisory signal from the monitoring apparatus.

BACKGROUND ART

With traffic signal units provided for example at a road intersection or the like, if an illumination condition of the signal lights is abnormal, then a traffic conflict can result. In particular, if the green lights (referred to hereunder as G lights) for permitting people and vehicles to proceed, are simultaneously illuminated for the respective directions of the intersecting roads, an extremely dangerous situation results. To avoid this situation, monitoring for simultaneous illumination of the G lights for the respective directions of the intersecting roads has heretofore mainly involved using a hard logic, for example to detect the terminal voltage of the signal lights via a voltage transformer or the like.

With conventional simultaneous G light illumination detection methods, voltage transformers are connected across the terminals of the G lights, so that a voltage is produced in the respective voltage transformers when the G lights illuminate, the arrangement being such that when a G light pair for the respective directions of the intersecting roads are illuminated simultaneously, G light simultaneous illumination (danger condition) is advised by the presence of a voltage (corresponding to a high energy condition). That is to say, the arrangement is such that a danger condition is advised by a high energy condition. In this case, if a fault occurs where the output to the monitoring circuit itself, which includes for example the voltage transformer, has a fault giving zero, then there is a problem in that if a simultaneous illumination of the G light pair for the respective intersecting roads occurs, this cannot be advised.

Moreover, in most cases it has not been possible to reach a stage where the illumination condition of a plurality of signal lights is monitored by only monitoring for simultaneous illumination of a G light pair for respective intersecting roads.

In view of the above situation, it is an object of the present invention to provide a monitoring apparatus for fail-safe monitoring for abnormal conditions such as, simultaneous illumination of traffic proceed permit signal lights, or signal light burn-out. Moreover, it is an object of the invention to provide a signal light control apparatus, which uses such a fail-safe monitoring apparatus.

DISCLOSURE OF THE INVENTION

Accordingly, the monitoring apparatus for traffic signal lights according to the present invention comprises: a sensor device for detecting an illumination condition of traffic signal lights; and a judgment device for generating an output of logic value 1 corresponding to a high energy condition indicating a normal condition of the signal lights when, based on an output from the sensor device, the number of illuminated or non illuminated signal lights is a predetermined number, and generating an output of logic value 0 corresponding to a low energy condition indicating an abnormal condition of the signal lights when not the predetermined number.

With this construction, since when the signal lights are normal and thus safe, this can be advised by a high energy condition (logic value 1) while when the signal lights are abnormal and thus dangerous, this can be advised by a low energy condition (logic value 0), then when a fault occurs where the sensor device or judgment device gives a zero output, this dangerous situation can be advised. Hence reliability of the signal light monitoring can be improved.

The construction may be such that the judgment device generates an output of logic value 1 when the number of illuminated signal lights is a predetermined number, and generates an output of logic value 0 indicating a signal light burn-out fault when not the predetermined number.

If in this way judgment of a signal light burn-out fault is carried out from the number of illuminated lights, with a logic value 1 for when the signal lights are illuminated, then the output level goes to the low side with both a signal light burn-out fault, and a zero output fault for example in the sensor. Therefore it is possible to warn off d anger, even in the case where both faults coincide.

The construction may be such that the output from the judgment device is output via an on-delay circuit having a delay time which is longer than an illumination period of the signal lights, or via a self-hold circuit with the output from the judgment device as a reset input signal, and a signal light power source switch on signal as a trigger input signal, which self-holds the trigger input signal.

In this way, even in the case where burn-out fault information appears intermittently in the illumination period of the signal light, this information output can be continuously advised until conditions return to normal.

Moreover, the construction may be such that the judgment device generates an output of logic value 1 when the number of non illuminated signal lights is a predetermined number, and generates an output of logic value 0 indicating a signal light simultaneous illumination fault where simultaneous illumination is not permitted, when not the predetermined number.

If in this way judgment of a signal light simultaneous illumination fault is carried out from the number of non illuminated lights, with a logic value 1 for when the signal lights are not illuminated, then the output level goes to the low side with both a signal light simultaneous illumination fault, and a zero output fault for example in the sensor. Therefore it is possible to warn off danger, even in the case where both faults coincide.

The construction may be such that the output from the judgment device is output via an on-delay circuit having a delay time which is longer than an illumination period of the signal lights, or a self-hold circuit with the output from the judgment device as a reset input signal, and a signal light power source switch on signal as a trigger input signal, which self-holds the trigger input signal.

In this way, even in the case where simultaneous illumination fault information appears intermittently in the illumination period of the signal lights, this information output can be continuously advised until conditions return to normal.

The construction is such that an illumination condition of respective signal lights for respective road directions of a two way intersection where two roads intersect is detected using sensor devices which output a binary logic signal, generating an AC signal and outputting a logic value 1 when a signal light is illuminated, and not generating an AC signal and outputting a logic value 0 when the signal light is not illuminated, and there is provided a judgment device which, based on the output conditions from respective sensor devices for each of the respective signal lights, gene rate s an output of logic value 1 corresponding to a high energy condition when the signal lights are normal, and generates an output of logic value 0 corresponding to a low energy condition at the time of a simultaneous illumination of the signal lights where simultaneous illumination is not permitted.

Basically, the construction may be such that the judgment device comprises; a first adding circuit for adding the logic signals of the respective sensor devices for detecting an illumination condition of respective green lights indicating permission to proceed in the respective road directions, and a first level detection circuit for level detecting the addition value from the first adding circuit, the construction being such that the first level detection circuit generates an output of logic value 1 when the addition value is 1, and generates an output of logic value 0 when the addition value is 2. Consequently it is possible to monitor for simultaneous illumination of the green lights.

Furthermore, the construction may be such that the judgment device comprises the first adding circuit and the first level detection circuit of claim 19, and further comprises: a second adding circuit for adding the logical signals of the respective sensor devices for detecting an illumination condition of respective red lights for the respective road directions; a second level detection circuit for level detecting the addition value from the second adding circuit; a third adding circuit for adding the logical signals of respective sensor devices for detecting an illumination condition of yellow lights for the respective road directions and an output signal from the second level detection circuit; and a first logical sum operation circuit for carrying out a logical sum operation on the addition value from the third adding circuit and an output from the first level detection circuit, and the logical sum operation output is made a judgment output. Consequently, if the signal lights are normal in the illumination period of the signal lights, an output of logic value 1 is continuously generated so that safety can be advised.

In order to continuously generate an output of logic value 1 when the signal lights are normal, the construction may be such that the judgment device comprises the second adding circuit and the second level detection circuit of claim 20, and further comprises: a fourth adding circuit for adding the logical signals of respective sensor devices for detecting an illumination condition of green lights and yellow lights for the respective road direction s; and a second logical sum operation circuit for carrying out a logical sum operation on the addition value from the fourth adding circuit and an output from the second level detection circuit, and the logical sum operation output is made a judgment output.

The construction may also be such that the signal lights for the same road of a two way intersection where two roads intersect are made one group, and for each group the illumination condition of a permit signal light indicating permission to proceed is detected using a sensor device which outputs a binary logic signal, generating an AC signal and outputting a logic value of 1 when a signal light is not illuminated, and not generating an AC signal and outputting a logic value 0 when the signal light is illuminated, and there is provided a judgment device which, based on the output conditions from the sensor device for each group, generates an output of logic value 1 corresponding to a high energy condition indicating the signal lights are normal, when at least one group shows a non illuminated condition, and generates an output of logic value 0 corresponding to a low energy condition indicating a simultaneous illumination fault when neither group shows a non illuminated condition.

In this way, danger can be reliably advised even in the case where a simultaneous illumination and a fault such as in the sensor occur at the same time.

In the case of only one permit signal light, that is to say, for simultaneous illumination detection of the green lights, the construction may be such that the judgment device comprises a third logical sum operation circuit for carrying out a logical sum operation on the logical output from the respective sensor devices for each respective group, and the logical sum operation output is made a judgment output. Moreover the judgment device may comprise: a fifth adding circuit for adding the logical outputs from the respective sensor devices for each respective group; and a third level detection circuit for level detecting the addition value from the fifth adding circuit, the construction being such that the third level detection circuit generates an s output of logic value 1 when the addition value is 1 or more and generates an output of logic value 0 when the addition value is zero.

In the case of a plurality of permit signal lights for the respective groups, for example for simultaneous illumination detection of the green lights, yellow lights, and pedestrian green lights etc., then the construction may be such that the judgment device comprises: sixth and seventh adding circuits for respectively adding the logical outputs from the respective sensor devices for each respective group; fourth and fifth level detection circuits for respectively level detecting the addition values from the sixth and seventh adding circuits and outputting a logic value 1 when the addition values are respectively a maximum; and a fourth logical sum operation circuit for carrying out a logical sum operation on both outputs from the fourth level detection circuit and the fifth level detection circuit, and the logical sum operation output is made a judgment output. Moreover, the judgment device may comprise: eight and ninth adding circuits for respectively adding the logical outputs from the respective sensor devices for each respective group; a fifth logical sum operation circuit for carrying out a logical sum operation on the addition values from the eighth and ninth adding circuits; and a sixth level detection circuit for level detecting the logical sum output from the fifth logical sum operation circuit and outputting a logic value 1 when the logical sum output is a logic value of 2 or more.

Moreover, the sensor device may be a current sensor provided for each permit signal light, with a power supply line for the permit signal light wound around a saturable magnetic core such that an excitation signal for the saturable magnetic core input from a high frequency signal generator is received on an output side at a high level at the time of no power to the power supply line, and is received on the output side at a low level at the time of power supply. Alternatively the sensor device may be a voltage sensor provided for each permit signal light, which detects a terminal voltage of an illumination switch circuit disposed in a power supply line for the permit signal light.

In the case of a voltage sensor, if a simultaneous illumination fault occurs due to a short circuit fault between the power supply lines for the signal lights, then this can be detected.

The construction of the voltage sensor may basically involve a series circuit of a first photocoupler for switching an AC current from an illumination power source using a high frequency signal from a high frequency signal generator, and a second photocoupler for receiving an AC signal from the switched illumination power source, connected in parallel across the terminals of a switching circuit for signal light illumination which is connected in series with the signal light.

If a current sensor is used for the sensor device, with all power supply lines for the permit signal lights of the same group wound around one saturable magnetic core such that an excitation signal for the saturable magnetic core input from a high frequency signal generator is received on an output side at a high level when no current flows in all the power supply lines, and is received on the output side at a low level when a current flows in at least one power supply line, then the number of current sensors can be reduced.

Moreover, the construction may be such that in the case of a voltage sensor for the sensor device, then basically this involves a series circuit of a first photocoupler for switching an AC current from an illumination power source using a high frequency signal from a high frequency signal generator, and a second photocoupler for receiving an AC signal from the illumination power source switched by the first photocoupler, connected in parallel across the terminals of an illumination switching circuit for one permit signal light, together with a plurality of series circuits constituted by photocouplers, each of which connected in parallel across the terminals of an illumination switching circuit for another permit signal light, with the second photocoupler and the series circuits constituted by photocouplers cascade connected, and an output from the final stage series circuit made the sensor output.

Moreover with the monitoring apparatus, in monitoring for a simultaneous illumination fault of the signal lights of a three way intersection where three roads intersect, the signal lights for the same road are made one group, and for each group, the illumination condition of a permit signal light indicating permission to proceed is detected using a sensor device which outputs a binary logic signal, generating an AC signal and outputting a logic value of 1 when a signal light is not illuminated, and not generating an AC signal and outputting a logic value 0 when the signal light is illuminated, and there is provided: tenth, eleventh and twelfth adding circuits for respectively adding the logical signals from the sensor devices for each group; seventh, eight and ninth level detection circuits for respectively level detecting the addition values from the respective adding circuits and generating an output of logic value 1 when the respective addition values are a maximum; a thirteenth adding circuit for adding the logical outputs from the respective level detection circuits; and a tenth level detection circuit for outputting a logic value 1 indicating normal signal lights when the addition value of the thirteenth adding circuit is 2 or more, and generating an output of logic value 0 indicating a simultaneous illumination fault when the addition value is 1 or less.

In this way, it is possible to monitor for a simultaneous illumination fault of the signal lights of a three way intersection.

In the case of monitoring for a simultaneous illumination fault of the signal lights of a three way intersection where three roads intersect, the illumination condition of the respective permit signal lights indicating permission to proceed is respectively detected using sensor devices which output a binary logic signal, generating an AC signal and outputting a logic value 1 when a signal light is not illuminated, and not generating an AC signal and outputting a logic value 0 when the signal light is illuminated, and there is provided: a fourteenth adding circuit for adding the sensor outputs corresponding to the respective permit signal lights for the first direction and second direction roads; a fifteenth adding circuit for adding the sensor outputs corresponding to the respective permit signal lights for the second direction and third direction roads; a sixteenth adding circuit for adding the sensor outputs corresponding to the respective permit signal lights for the third direction and first direction roads; and an eleventh level detection circuit for generating an output of logic value 1 indicating normal signal lights when the addition value of the respective adding circuits is 6, and generating an output of logic value 0 indicating a simultaneous illumination fault when the addition value is 5 or less.

Furthermore, for the control apparatus of the present invention for controlling the illumination of traffic signal lights, the construction may comprise: a signal light monitoring circuit provided with, a sensor device for detecting an illumination condition of respective signal lights, and a judgment device for generating an output of logic value 1 corresponding to a high energy condition indicating a normal condition of the signal lights when, based on an output from the sensor device, the number of illuminated or non illuminated signal lights is a predetermined number, and generating an output of logic value 0 corresponding to a low energy condition indicating an abnormal condition of the signal lights when the number is not the predetermined number; and a signal light power supply control circuit which supplies power to the signal lights when an output of logic value 1 is generated from the signal light monitoring circuit, and which stops power supply to the signal lights when an output of logic value 0 is generated.

In this way, the illumination control for the signal lights can be carried out in a fail-safe manner.

The signal light monitoring circuit may comprise: a sensor device constructed so as to generate an AC signal at the time of non illumination of a signal light, and not to generate an AC signal at the time of illumination; and a judgment device which generates an output of logic value 1 when the number of non illumination outputs from the sensor device is a predetermined number, and generates an output of logic value 0 indicating a signal light simultaneous illumination fault where simultaneous illumination is not permitted, when not the predetermined number.

Moreover, the signal light power supply control circuit may have an electromagnetic relay having relay contact points disposed in series in the power supply lines for the respective signal lights, the construction being such that the electromagnetic relay is placed in a non excited condition with the contact points open, based on an output of logic value 0 indicating simultaneous illumination of the signal light monitoring circuit.

Furthermore, the signal light power supply control circuit may incorporate: a first self-hold circuit with a signal light power source switch on signal as a trigger input signal, and an output from the signal light monitoring circuit as a reset input signal, which self-holds the trigger input signal, the construction being such that the electromagnetic relay is excited and the contact points thus closed with an output of logic value 1 from the self-hold circuit when a reset input signal of logic value 1 indicating normal signal lighting from the monitoring circuit, and a trigger input signal of logic value 1 due to the power source switch on signal are input together.

Furthermore, the construction may be such that the signal light power supply control circuit incorporates: a signal light flash command circuit which outputs to an illumination control circuit, a flash command for a yellow light and a red light for intersecting roads when an output of logic value 0 indicating simultaneous illumination of the signal lights is generated from the signal light monitoring circuit so that the output from the first self-hold circuit is cancelled; a flash monitoring circuit for monitoring if a flash operation of the yellow light and red light is normal, based on the flash command from the signal light flash command circuit; and a n electromagnetic relay control circuit which de-energizes the electromagnetic relay to open the contact points and stop the signal light power supply, based on an output from the flash monitoring circuit when the flash operation for the yellow light and the red light is abnormal.

Moreover, t he electromagnetic relay control circuit may comprise: a second self-hold circuit with a signal for a fall in the output of logic value 1 from the signal light monitoring circuit as a trigger input signal, and a monitoring output from the flash monitoring circuit as a reset input signal, the construction being such that when the flash operation for the yellow light and the red light is normal at the time of signal light simultaneous illumination, the trigger input signal and the reset input signal both become a logic value 1 so that the excitation of the electromagnetic relay is maintained by means of an output from the second self-hold circuit.

Moreover the construction may comprise: respective saturable magnetic cores with respective signal light power supply lines provided for each of a plurality of signal lights connected in parallel with each other to a common power supply line, wound thereon as primary windings; a transformer with second windings for impedance detection wound on the respective saturable magnetic cores and connected in series with each other, acting as load for a secondary winding thereof and which receives a high frequency signal from a high frequency signal generator in a primary winding thereof; and a level detection circuit which generates an output of logic value 1 indicating norm al signal lights when an output signal level of the transformer is equal to or above a predetermined level as a result of an output signal change due to a change in impedance for h the transformer, and generates an output of logic value 0 indicating a signal light burn-out fault when lower than the predetermined level.

In this way, it is possible to detect a signal light burn-out fault in the case where a plurality of signal lights are connected in parallel to a common power supply line.

Moreover, the monitoring apparatus may be one wherein an illumination condition of respective signal lights of an intersection where a plurality of roads intersect is detected using: sensor devices which generate an AC signal at the time of non illumination of a signal light and which do not generate an AC signal at the time of illumination of the signal light, and wherein an AC signal level at the time of non illumination from a sensor device for detecting the illumination condition of a vehicle green light and a pedestrian green light, is made different from an AC signal level at the time of non illumination from a sensor device for detecting an illumination condition of a yellow light, and wherein there is provided a judgment device which, based on the outputs from the respective sensor devices, distinguishes and warns between respective simultaneous illumination faults of the vehicle green light pairs, and the vehicle green lights and the pedestrian green lights, and respective simultaneous illumination faults of the vehicle green lights and the yellow lights, and the pedestrian green lights and the yellow lights.

In this way, it is possible to monitor and distinguish between a simultaneous illumination fault of the green light pairs or the green light and the yellow light, and hence it is possible to detect carefully signal light abnormalities.

Moreover the invention provides a monitoring apparatus for traffic signal lights for monitoring for simultaneous illumination faults in traffic signal lights where illumination is controlled with the green, red and yellow signal lights of respective signal units for an intersection where a plurality of roads intersect, connected in parallel with one common power supply line, the construction being such that current sensors are used, each with the power supply line for the signal light wound on a saturable magnetic core such that an excitation signal for the saturable magnetic core input from a high frequency signal generator is received on an output side at a high level at the time of no power to the power supply line, and is received on the output side at a low level at the time of power supply, and the common power supply lines for the signal units and the red light power supply lines are wound in opposite directions to each other on the saturable magnetic cores of the respective current sensors provided for each signal unit for the respective road directions, and the AC signal level of the respective current sensors is added by an adding circuit, and the added signal level is detected by a level detection circuit, the level detection circuit generating an output of logic value 1 indicating normal when the addition signal level is equal to or above a previously set predetermined level, and generating an output of logic value 0 indicating, a simultaneous illumination fault when lower than the predetermined level.

In this way, it is possible to monitor for a simultaneous illumination fault of the permit signal lights for permitting traffic to proceed, using a common line and the red light power supply line.

With a control apparatus for controlling the illumination of signal lights for a two way intersection where two roads intersect, the construction may be such that the illumination condition of respective permit signal lights for permitting traffic to proceed in the respective road directions is detected using sensor devices which generate an AC signal at the time of non illumination of the signal lights and which do not generate an AC signal at the time of illumination, and there is provided: a first electromagnetic relay which is excited by an output signal from a first sensor device for detecting an illumination condition of a permit signal light on one road; and a second electromagnetic relay which is excited by an output signal from a second sensor device for detecting an illumination condition of a permit signal light on the other road, and wherein relay contact points for closing a circuit at the time of excitation of the second electromagnetic relay are disposed in series in a power supply line for the permit signal light for the one road, and relay contact points for closing a circuit at the time of excitation of the first electromagnetic relay are disposed in series in a power supply line for the permit signal light for the other road.

In this way, when the green light for one road direction of the intersecting roads is illuminated, the illumination current for the green light for the other road direction can be shut off. Moreover, since a time difference exists between the reciprocal illuminations of the green lights, then the illumination current for the signal lights is not shut off by the on and off switching of the electromagnetic relay contact points.

BRIEF DESCRIPTION OF THE DRAWINGS

FIG. 2(*c*) illustrates output signals OUT1, OUT2, of FIG. 2(*b*) with rectifier and window comparator instead of on/off switching;

BEST MODE FOR CARRYING OUT THE INVENTION

As follows is a description of embodiments of the present invention with reference to the drawings.

First is a description of fail-safe sensors and logical operation elements.

Figure 1:
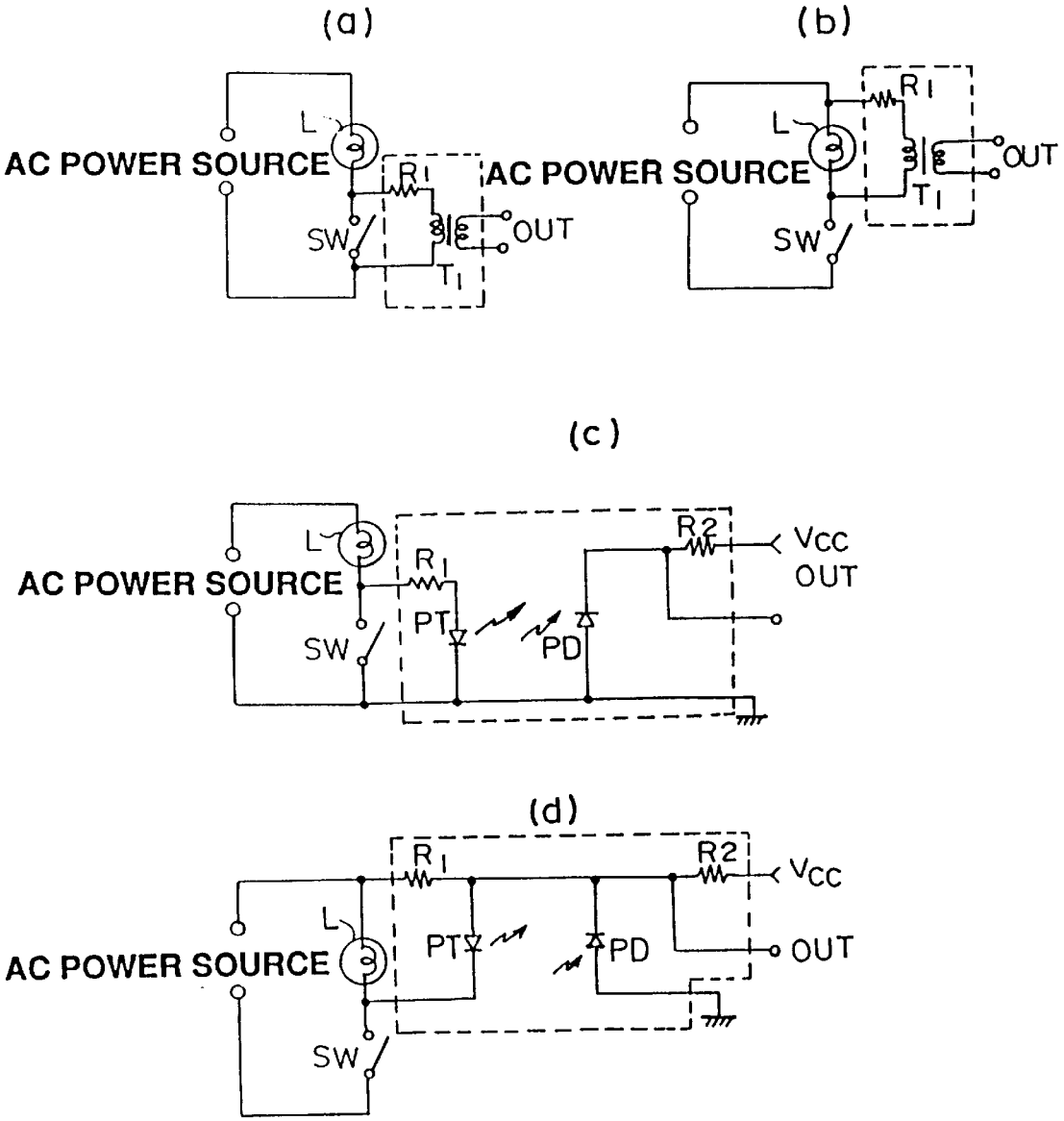
FIGS. 1(*a*)~(*d*) are circuit diagrams illustrating fail-safe voltage sensors.

FIGS. 1(*a*)~(*d*) illustrate structural examples of a voltage sensor.

FIGS. 1(*a*) and (*b*) illustrate examples using a transformer $T_1$, while FIGS. 1(*c*) and (*d*) illustrate examples using a photocoupler comprising a light emitting element PT and a light receiving element PD. With the construction as shown in FIGS. 1(*a*) and (*c*) wherein a voltage sensor enclosed by the dashed line in the figures is connected across the terminals of an illumination switch SW for a signal light L, an output signal OUT from the sensor is generated at a high level when the switch SW is off. On the other hand, with the construction of FIGS. 1(*b*) and (*d*) wherein a voltage sensor is connected across the terminals of a signal light L, an output signal OUT from the sensor is generated at a high level when the switch SW is on. In both cases the output signals OUT are AC signals. With all the sensors of FIGS. 1(*a*) through (*d*), in the case where a disconnection or a short circuit fault occurs in the constituent elements of the sensor portions enclosed by the dashed lines in the figures, the AC signal OUT is not produced. Here, since the resistors R1, R2 are only susceptible to burn-out, then normally short circuit faults are not considered.

Figure 2:
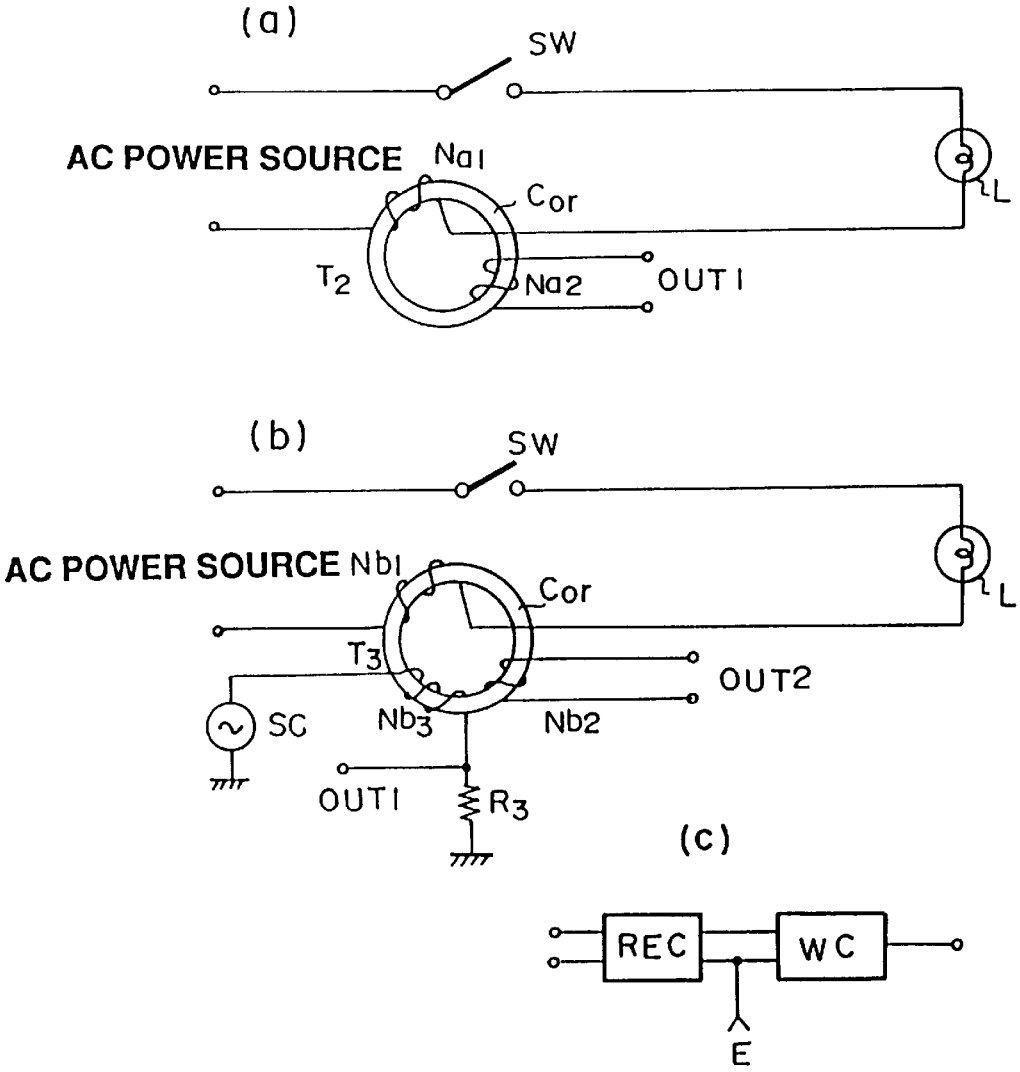
FIGS. 2(*a*)~(*b*) are circuit diagrams illustrating fail-safe current sensors.

FIGS. 2(*a*) and (*b*) illustrate structural examples of a current sensor.

In FIG. 2(*a*), a transformer $T_2$ is a current transformer. A power supply line for a signal light L is wound on a core Cor of the transformer $T_2$ as a primary winding $N_{a1}$, and an AC output signal OUT1 is generated in a secondary winding $N_{a2}$ wound on the core Cor, when a switch SW is switched on so that a current flows in the power supply line.

In FIG. 2(*b*), the presence of a power supply current is produced as a modulation signal from a high frequency signal generator SG (referred to hereunder simply as a signal generator). A power supply line is wound on a ring shape saturable magnetic core Cor of a transformer $T_3$ as a winding $Nb_1$, and a current (saturable magnetic core excitation signal) is supplied to a winding $Nb_3$ from the signal generator SG via a resistor $R_3$. When a current flows in the power supply line for the signal light L, the saturable magnetic core Cor becomes saturated due to the winding $Nb_1$. Hence at this time, a high frequency signal from the winding $Nb_3$ is not transmitted to an output winding $Nb_2$ via the saturable magnetic core Cor. That is to say, when the switch SW is on, the output signal OUT2 becomes a low level high frequency signal, while when the switch SW is off, the output signal OUT2 becomes a high level high frequency signal. In particular, if the power supply current is large, then when the switch SW is on, the output signal OUT2 becomes an extremely low level. In the following discussion this is treated as an approximately zero level condition.

On the other hand, with an output signal OUT1 taken out from between the resistor $R_3$ and the winding $Nb_3$, when a current flows in the power supply line for the signal light L so that the saturable magnetic core Cor becomes saturated, the self inductance of the winding $Nb_3$ becomes small and hence the voltage across the terminals of the winding $Nb_3$ drops so that the terminal voltage of the resistor $R_3$ increases. Alternatively, when a current does not flow in the power supply line for the signal light L, since the saturable magnetic core Cor is not saturated, the self inductance of the winding $Nb_3$ shows a large value, and the voltage across the terminals of the winding $Nb_3$ is thus increased. Hence the terminal voltage of the resistor $R_3$ drops. If the power supply current is large, the difference between the output levels at the time of power supply and non power supply can be increased. That is to say, when the switch SW is off, an approximately zero level condition results, while when on, this gives a high level.

FIG. 2(*c*) illustrates processing for the case where a large change in the output signals OUT1, OUT2, of FIG. 2(*b*) can not be obtained by on and off switching with the switch SW. By rectifying and level detecting the output signals OUT1 or OUT2 using a voltage doubler rectifying circuit REC and a fail-safe window comparator WC (both to be described later), then a binary output signal of logic value 1 and logic value 0 is possible.

Figure 3:
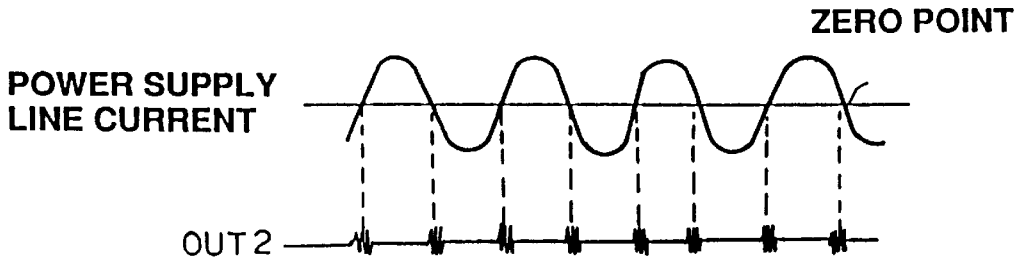
FIG. 3 is a signal wave form diagram for a power supply current and an output OUT2 from the current sensor of FIG. 2(*b*)

In FIG. 2(*b*), since the current flowing in the power supply line for the signal light L is an alternating current, then as shown in FIG. 3, with the output signal OUT2 during power supply, a high frequency signal from the signal generator SG is intermittently generated at the zero point of the power supply current.

Figure 4:
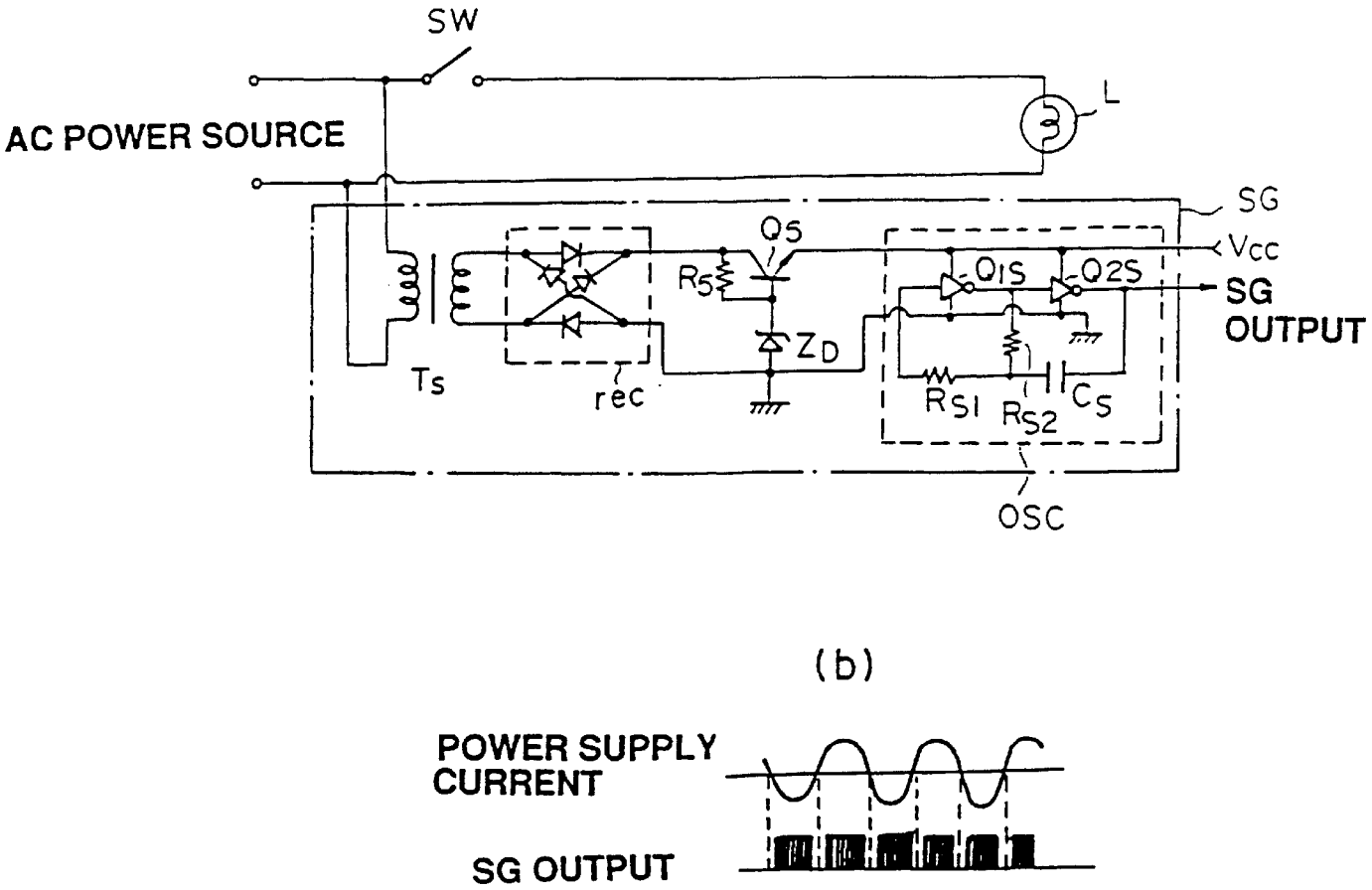
FIG. 4(*a*) is a circuit diagram of a high frequency signal generator used in the current sensor of FIG. 2(*b*), while FIG. 4(*b*) is a signal wave form diagram for a signal light power supply current and an output from the high frequency signal generator.

FIG. 4(*a*) shows a structural example of a signal generator SG to prevent the occurrence of this intermittent high frequency signal in the output signal OUT2. In FIG. 4, CMOS inverters $Q_{1s}$, $Q_{2s}$, resistors $R_{s1}$, $R_{s2}$ and a capacitor $C_S$ constitute an oscillator OSC. A high frequency output signal from the oscillator OSC is supplied to the winding $Nb_3$ as the output from the signal generator SG. Depending on the situation, the output signal from the oscillator OSC is amplified by a known amplifier. Power for the oscillator OSC is supplied from a full wave rectifying circuit rec which is supplied from a signal light power source (AC power source) via a transformer $T_S$. A transistor $Q_S$, a zener diode ZD, and a resistor $R_S$ constitute a known constant voltage circuit which limits the upper limit voltage of the output from the full wave rectifying circuit rec. The oscillator OSC oscillates when the output from the constant voltage circuit is equal to or greater than a predetermined level (normally a low value of a few volts at which the CMOS can operate). Since the power source output to the signal generator SG is synchronized with the power source of the power supply line for the signal lights, then the output signal from the signal generator SG is produced as shown in FIG. 4(*b*) relative to the change in the power supply current, with an output signal from the signal generator SG not produced close to the zero point of the power supply current. Therefore, the intermittent high frequency signal shown in FIG. 3 does not occur.

Next is a discussion concerning AC signal addition.

AC input signals can be added using a voltage doubler rectifying circuit.

Figure 5:
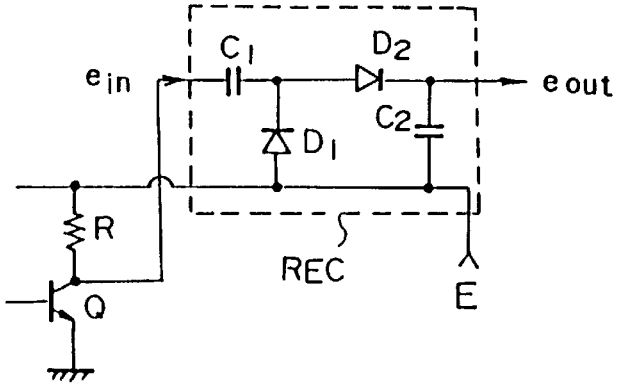
FIG. 5 is a circuit diagram of a voltage doubler rectifying circuit.

The portion enclosed by the dashed line in FIG. 5 indicates a voltage doubler rectifying circuit REC, comprising a coupling capacitor $C_1$, a smoothing capacitor $C_2$, a clamping diode $D_1$, and a rectifying diode $D_2$, which outputs a DC output signal $e_{out}$ clamped at a power source potential E. An input signal $e_{in}$ is switched at a level of the power source potential E by a transistor Q. A resistor R has a small value. In the case where a disconnection fault occurs in the capacitor $C_1$ or $C_2$, or a short circuit fault occurs in the diode $D_{1\ or\ D2}$, then a DC output signal is not produced.

In the case where a short circuit fault occurs in the capacitor $C_1$, the level of the output signal $e_{out}$ is the level of the power source potential E or a lower level. If a disconnection fault occurs in the diode $D_1$, the electrical discharge route for the charge stored in the capacitor $C_1$ is lost, and hence the input signal $e_{in}$ is not transmitted to the output side via the capacitor $C_1$. If a short circuit fault occurs in the diode $D_2$, then the input signal $e_{in}$ is short circuited by the capacitor $C_2$ so that the DC output signal $e_{out}$ is not produced. If a disconnection fault occurs in the capacitor C2, then the output signal $e_{out}$ becomes an AC signal (if a four terminal capacitor is used for the capacitor $C_2$, then the output signal $e_{out}$ becomes zero).

Consequently, the voltage doubler rectifying circuit REC of FIG. 5 has the characteristic that if a single fault occurs in the constituent elements of the circuit, a DC output signal of a higher level than the power source potential E never occurs. Moreover it has the characteristic that when the input signal $e_{in}$ is not input, an output signal $e_{out}$ of a higher potential than the power source potential E is never produced even with a circuit fault.

That is to say, the output signal can be treated as the following binary logical output signal x.

$$x = \begin{matrix} 1, & e_{out} > E \\ 0 & e_{out} \leq E \end{matrix} \tag{1}$$

Figure 6:
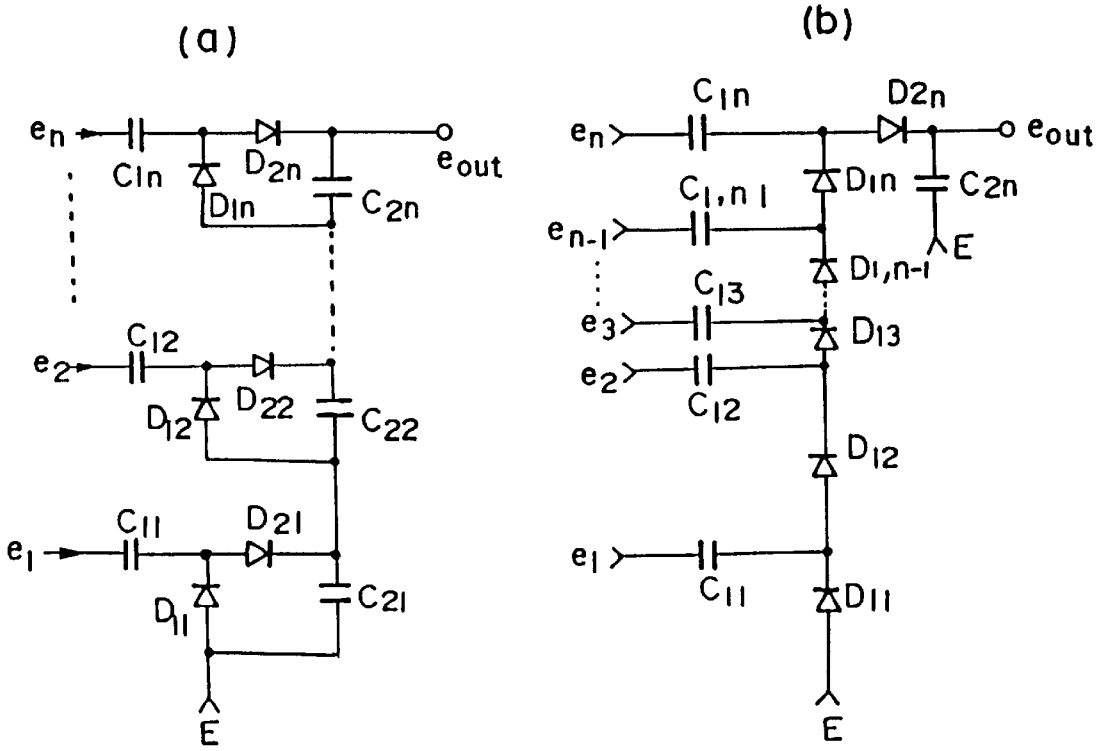
FIGS. 6(*a*) and (*b*) are circuit diagrams of adding circuits which use voltage doubler rectifying circuits.

FIGS. 6(*a*) and (*b*) are examples of adding circuits made up using the voltage doubler rectifying circuit of FIG. 5.

With the adding circuit of FIG. 6(*a*), the output signal for input signal $e_2$ is clamped and added to the rectified output signal for the input signal $e_1$, the output signal for the input signal $e_3$ is clamped and added to the added value of the input signals $e_1$ and $e_2$, and the output signal for the input signal $e_n$ is clamped and added to the added value of input signals $e_1$~$e_{n-1}$. Consequently, the output signal $e_{out}$ is output as the added value of the input signals $e_1$~$e_n$.

FIG. 6(*b*) shows the adding circuit for where the input signals $e_1$~$e_n$ are synchronized, with $e_1$, $e_3$, $e_5$, . . . and $e_2$, $e_4$, $e_6$, . . . having opposite phases to each other. For example, considering the case where the input signals $e_1$, $e_2$, $e_3$, $e_4$ and $e_5$ are input, since when the input signals $e_1$, $e_3$ are input at a positive voltage, the input signals $e_2$, $e_4$ are input at a negative voltage, then the charge for the input signals $e_1$, $e_3$ is stored in the capacitors $C_{12}$, $C_{14}$ via the respective capacitors $C_{11}$, $C_{13}$. Then when the input signals $e_2$, $e_4$ become a positive voltage and the input signals $e_1$, $e_3$, $e_5$ become a negative voltage, the charge due to the positive voltage of the input signals $e_2$, $e_4$ is superimposed on the charge due to the positive voltage of the input signals $e_1$, $e_3$ stored in the capacitors $C_{12}$, $C_{14}$, and stored in the respective capacitors $C_{13}$, $C_{15}$.

That is to say, the clamping diodes $D_{12}$~$D_{1n}$ for the input signals $e_2$~$e_n$ of FIG. 6(*b*) also perform the role of rectifying diodes (diodes $D_{21}$~$D_{2n}$ of FIG. 6(*a*)) for the immediately preceding respective input signals $e_1$~$e_{n-1}$, and the coupling capacitors $C_{12}$~$C_{1n}$ for the input signals $e_2$~$e_n$ also perform the role of smoothing capacitors (capacitors $C_{22}$~$C_{2n}$ in FIG. 6(*a*)) for the immediately preceding respective input signals $e_1$~$e_{n-1}$. The diode $D_{2n}$ is the rectifying diode for the input signal en, while the capacitor $C_{2n}$ is the smoothing capacitor for the input signal $e_n$.

In FIG. 6, the input signals $e_1$, $e_2$, . . . $e_n$ are rectified, and the respective DC output signals added and then output. If the rectified binary logical output signals for the input signals $e_1$, $e_2$, $e_3$, . . . $e_n$, are $x_1$, $x_2$, . . . $x_n$, then the logical output signal X for the output signal $e_{out}$ is represented by;

$$X = x_1 + x_2 + \ldots + x_n = \sum_{i=1}^{n} x_i \tag{2}$$

and since $x_1$, $x_2$, . . . $x_n$ are binary, then the logical output signal X becomes multi valued (n values) as 0, 1, 2, 3 . . . n values, with X=0 being the condition where none of the input signals are input. Moreover, in the case where a fault occurs in any one of the voltage doubler rectifying circuits, the value for the logical output signal X drops to a small value.

Figure 7:
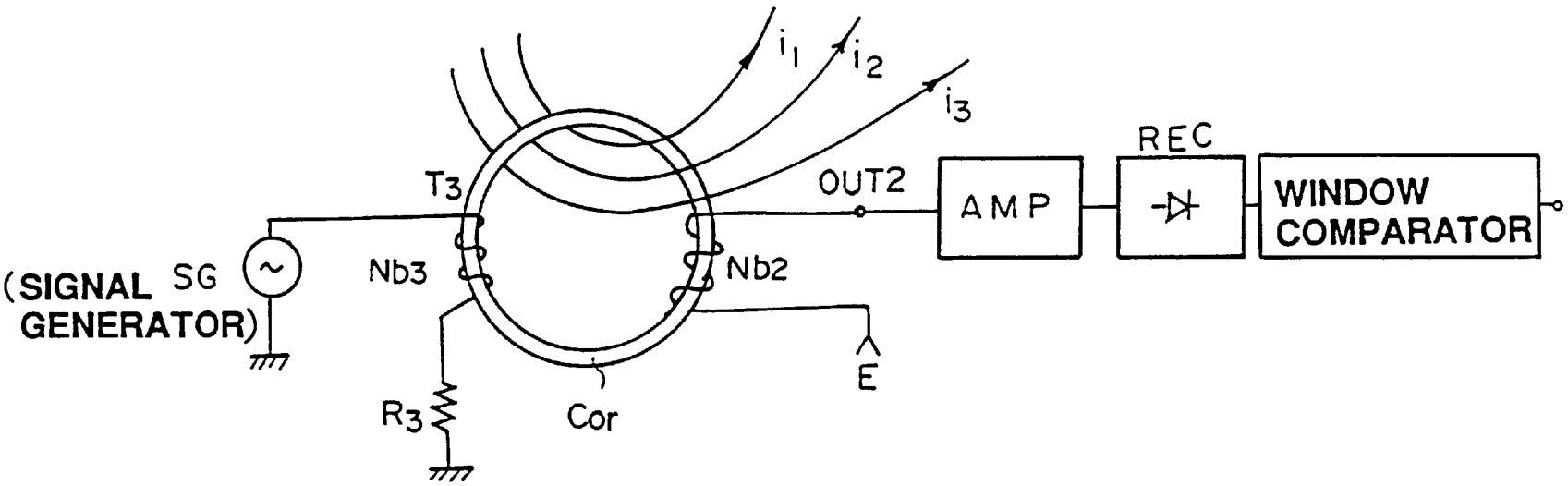
FIG. 7 is a circuit diagram of another current sensor.

In the case where a plurality of current signals are to be added using a current sensor, then as a special case, the construction may be as shown in FIG. 7 using the current sensor of FIG. 2(*b*).

In FIG. 7, three signal light power supply lines with equal currents $i_1$, $i_2$, and $i_3$ flowing therein, are passed through a saturable magnetic core Cor (passed in this case meaning a single turn through the core). The level of the high frequency signal supplied from the signal generator SG and transmitted from the primary winding $Nb_3$ to the secondary winding $Nb_2$, is reduced in approximate proportion to the increase in the number of power lines carrying the current. FIG. 7 shows the case where the signal level for the secondary winding $Nb_2$ is small, and hence an amplifier AMP is provided before the voltage doubler rectifying circuit REC shown in FIG. 2(*c*).

Figure 8:
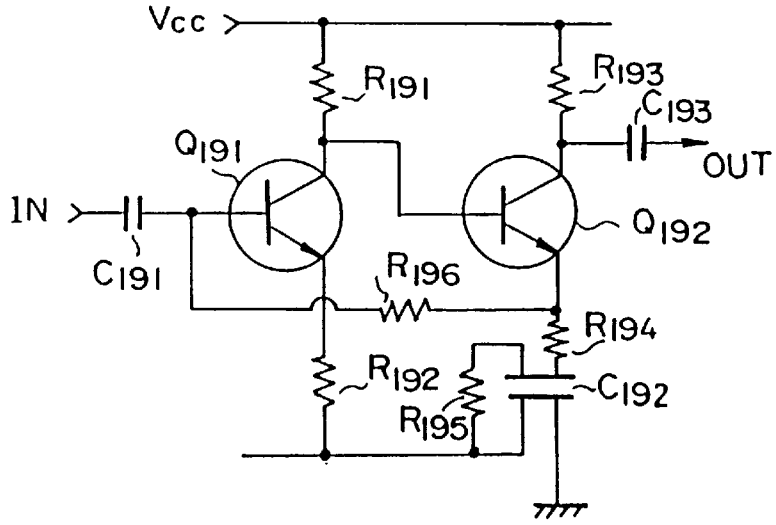
FIG. 8 is a circuit diagram of a fail-safe AC amplifier.

FIG. 8 shows a structural example of an AC amplifier for use as the amplifier AMP.

With the amplifier in FIG. 8, in the case where a fault occurs in a transistor $Q_{191}$ or $Q_{192}$, amplification is effectively lost. Moreover, if a disconnection fault occurs in resistors $R_{191}$, $R_{192}$, $R_{193}$, $R_{194}$, $R_{195}$ or $R_{196}$, then there is effectively no output signal. A four terminal capacitor is used for the capacitor $C_{192}$, and hence in the case where a short circuit fault occurs in the capacitor $C_{192}$ or a disconnection fault occurs in the leads, again there is effectively no output signal. If a disconnection fault occurs in the capacitor $C_{191}$, then of course an output is not produced, but even if a short circuit fault occurs, since the input side is then short circuited by the winding $Nb_2$ of the current sensor, then an output will not be produced. Also in the case where a disconnection fault occurs in the winding $Nb_2$, an output signal will not be produced. A capacitor $C_{193}$ corresponds to the coupling capacitor (in FIG. 5, the capacitor C1) for the subsequent voltage doubler rectifying circuit REC. Such a fail-safe AC amplifier is known for example from prior International Patent Publication No. WO 94/23303.

With the addition method of FIG. 7, the signal light currents $i_1$, $i_2$, $i_3$ must be equal. In practice however, the signal lights deteriorate with age so that the currents $i_1$, $i_2$, $i_3$ are reduced. Consequently, this addition method is limited to use in special cases where the signal lights are comparatively new and all of the signal lights are replaced at the same time, or where the threshold values of the window comparator are adjusted periodically.

Next is a description of the logical operation and the logical operation elements used therein.

A device which can be used for the fail-safe threshold value logical operation is the fail-safe window comparator/AND gate. This device is known for example from U.S. Pat. No. 4,661,880, U.S. Pat. No. 4,667,184, U.S. Pat. No. 5,027,114, and from IEICE Trans. Electron, Vol. E76-C, No. 3, March 1993, pp. 419–427.

Figure 9:
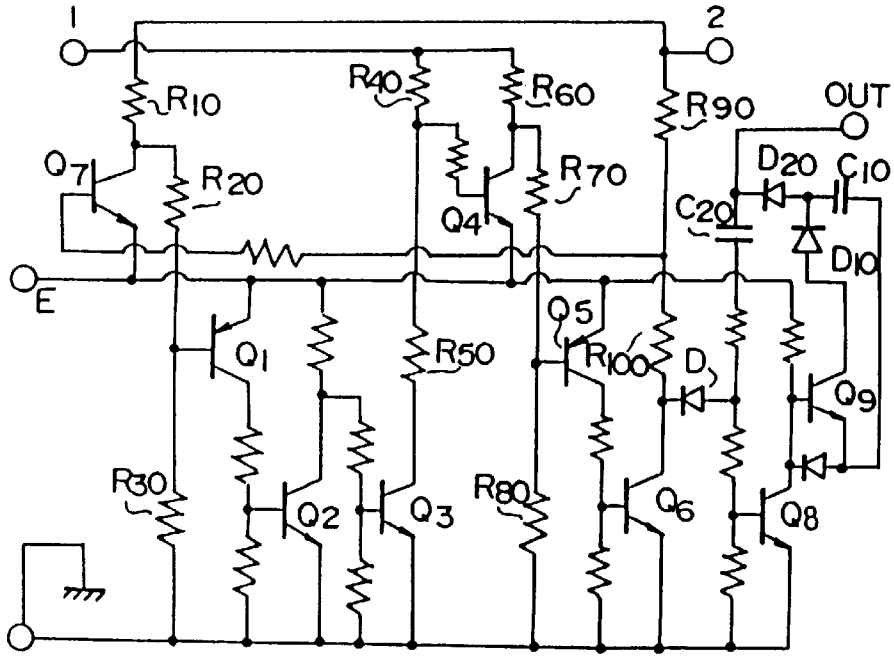
FIG. 9 is a circuit diagram of a fail-safe window comparator/AND gate.

FIG. 9 shows a structural example of this device.

In FIG. 9, letter E indicates the power source potential, numerals 1 and 2 denote input terminals, and OUT denotes an output terminal. With the circuit of FIG. 9, if the input voltages for the input terminals 1 and 2 are V1 and V2 respectively, then the circuit oscillates when the input voltages V1 and V2 are within the ranges satisfying the following equations. Here the threshold values given to these ranges are referred to as windows.

For the input voltage V1;

$$E(R_{10}+R_{20}+R_{30})/R_{30}<\mathbf{V1}<E(R_{40}+R_{50})/R_{50} \tag{3}$$

and for the input voltage V2

$$E(R_{60}+R_{70}+R_{80})/R_{80}<\mathbf{V2}<E(R_{90}+R_{100})/R_{100} \tag{4}$$

Only when inputs satisfying the above equations are input together to the input terminals 1 and 2 can the circuit oscillate. The input terminals 1 and 2 thus have a logical product function.

In FIG. 9, a feedback circuit comprising transistors $Q_1$~$Q_7$ constitutes an oscillator (referred to as an operational oscillator), transistors $Q_8$, $Q_9$ constitute an amplifier coupled by a diode D, while diodes $D_{10}$, $D_{20}$ and capacitors $C_{10}$, $C_{20}$ constitute the beforementioned voltage doubler rectifying circuit for superimposing on the power source potential E.

These three circuits have the following characteristics:

(1) if a fault occurs in any of the constituent elements of the circuit, the oscillator will not oscillate;

(2) if a fault occurs in any of the constituent elements of the circuit, since there is no oscillation output, the amplifier will not produce an AC output signal; and (3) if a fault occurs in any of the constituent elements of the circuit, since there is no amplifier output (AC), the voltage doubler rectifying circuit will not produce an output signal higher than the power source potential E.

Therefore the circuit of FIG. 9 gives a fail-safe window comparator/AND gate, which will not produce an output signal when there is no input signal.

Figure 10:
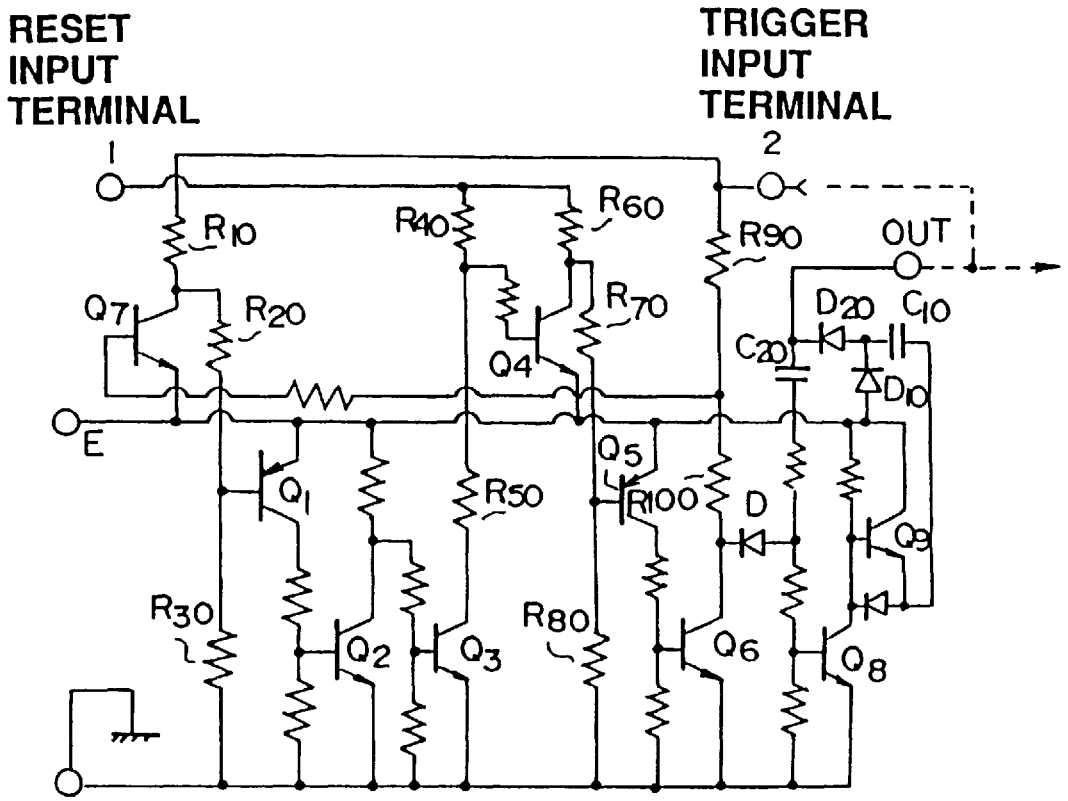
FIG. 10 is a circuit diagram of a self-hold circuit which uses the window comparator/AND gate of FIG. 9.

If as shown in FIG. 10, the output signal from the output terminal OUT is fed back for example to the input terminal 2, then this gives a fail-safe self-hold circuit with the input terminal 1 as a reset input terminal and the input terminal 2 as a trigger input terminal. A self-hold circuit using such a window comparator is known for example from U.S. Pat. No. 5,207,114.

Figure 11:
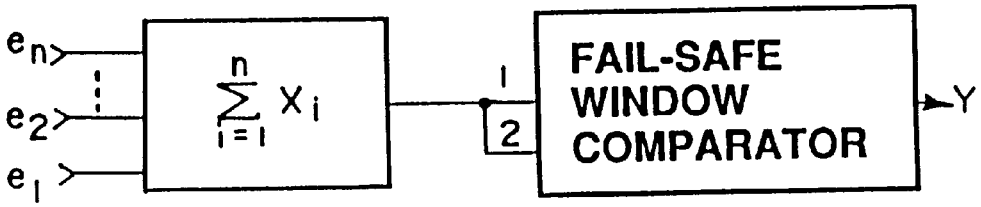
FIG. 11 is a block diagram of a threshold value operation circuit which uses an adding circuit and a window comparator.

FIG. 11 illustrates a threshold value operation circuit which uses an adding circuit and a two input fail-safe window comparator. In the case where the threshold value operation circuit of FIG. 11 is used, with the input terminals 1 and 2 of the window comparator made common and the threshold values for the two terminals made the same level, then for the logical product operation and the logical sum operation, the upper limit threshold value is made a sufficiently high level and only the lower limit threshold value is used. If the lower limit threshold value of the window comparator is $V_L$, then the logical product output and the logical sum output for the logical values $x_i$(i=1, 2, . . . n) for the input signals $e_i$(i=1, 2, . . . n) of FIG. 11 is given by the following.

With the logical product, the logical product output Y is;

$$Y = \begin{cases} 1, & \sum_{i=1}^{n} x_i > n-1 \\ 0, & \sum_{i=1}^{n} x_i \le n-1 \end{cases} \tag{5}$$

Here the lower limit threshold value $V_L$ is a lower level than the logical level (addition level) of $$\sum_{i=1}^{n} x_i,$$

and a higher level than the logical level of $$\sum_{i=1}^{n-1} x_i.$$

Moreover, equation (5) implies that when n input signals are input, an output signal Y=1 is produced, while when less than n input signals are input, then Y=0.

With the logical sum;

$$Y = \begin{cases} 1, & \sum_{i=1}^{n} x_i \ge 1 \\ 0, & \sum_{i=1}^{n} x_i < 1 \end{cases} \tag{6}$$

Here the lower limit threshold value $V_L$ is a lower level than the logical level of $$\sum_{i=1}^{n} x_i = 1,$$

and a higher level than the logical level of $$\sum_{i=1}^{n} x_i = 0$$

(zero level). Furthermore, equation (6) implies that when at least one (one or more) of the n input signals is input, an output signal of Y=1 is produced, while if none are input, then an output signal of Y=0 results.

In the case of an operation involving a window, the window comparator has upper limit and lower limit threshold values. It is thus possible to generate an output signal of logic value 1, within a specific range of the input signal. That is to say, if the threshold value for the upper limit of the window comparator is $V_H$, and the threshold value for the lower limit is $V_L$, then an operation where an output signal Y=1 is produced with the addition value $$\sum_{i=1}^{n} x_i$$

between logical values k and h (k>h), and an output signal Y=0 is produced when the addition value $$\sum_{i=1}^{n} x_i$$

is higher than k or lower than h, is represented by the following equation (k and h are multiple values):

$$Y = \begin{cases} 1, & h \le \sum_{i=1}^{n} x_i \le k \\ 0, & \sum_{i=1}^{n} x_i < h \text{ or } \sum_{i=1}^{n} x_i > k \end{cases} \quad (7)$$

Here the upper limit threshold value $V_H$ is set between the logical level for $$\sum_{i=1}^{n} x_i = k$$

and the logical level for $$\sum_{i=1}^{n} x_i = k + 1,$$

while the lower limit threshold value $V_L$ is set between the logical level for $$\sum_{i=1}^{n} x_i = h$$

and the logical level for $$\sum_{i=1}^{n} x_i = h - 1.$$

Provided that k and h are positive integers of 1, 2, 3, . . . n. With equation (7), when a number of input signals of the n input signals $e_i$(i=1, 2, n) greater than h−1 and less than k+1 are input, an output signal Y=1 is produced, while when a number of input signals less than h or greater than k are input, then an output signal Y=0 is produced.

The output signal Y=1 for the respective equations (5), (6) and (7), is for when the window comparator oscillates so that an AC output signal is produced, while Y=0 is for when the window comparator does not oscillate and an AC output signal is not produced.

Figure 12:
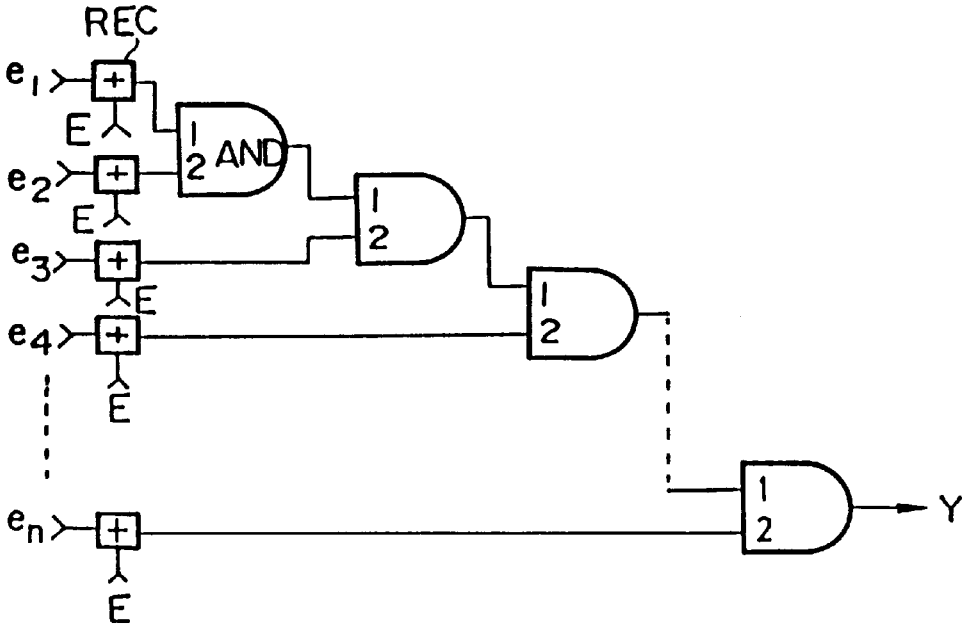
FIG. 12 is a diagram of a logical product operation circuit configured with the window comparator of FIG. 9 connected in a cascade.

If several of the window comparators shown in FIG. 9 are used in cascade, then a fail-safe logical product operation circuit can be made which uses the lower limit threshold value (the upper limit threshold value is made a sufficiently high level). Consequently, using the window comparators of FIG. 9 as two input AND gates, then the logical product operation represented by equation (5) is possible with the construction of FIG. 12. In FIG. 12, voltage doubler rectifying circuits REC are the devices shown in FIG. 5, while AND gates shown as AND in FIG. 12 are the devices shown in FIG. 9 having a voltage doubler rectifying circuit clamped at a power source potential E on the output side.

Figure 13:
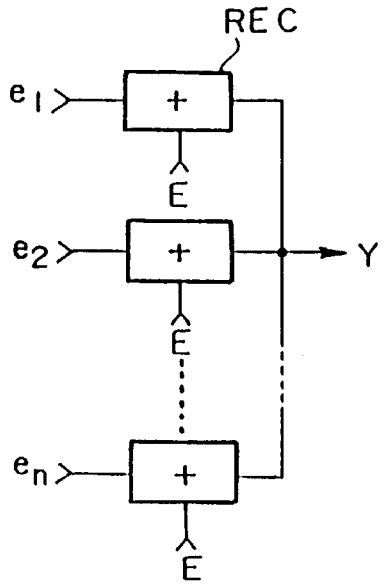
FIG. 13 is a circuit diagram of a logical sum operation circuit with an AC signal input.

On the other hand, a logical sum circuit which takes the AC signals, can be obtained by a wired OR connection of the output signals from the voltage doubler rectifying circuits REC. FIG. 13 shows an example of this construction.

Therefore, the logical operation using the adding circuit and the threshold value operation circuit shown in FIG. 12, can be replaced by a binary logical operation, except for the operation having a window.

Next is a description of the logic for safety detection.

In the sampling of information indicating safety, it is necessary to transmit information for safety in a high energy condition. More specifically, if two signal lights (G lights) $G_1$, $G_2$ indicating permission to proceed along intersecting roads at an intersection are illuminated simultaneously, then a dangerous situation arises, while conversely, if both are not illuminated simultaneously then the situation is safe. Detection types can thus involve two types; one being referred to as a danger detection type which involves detecting a dangerous condition when this arises, and handling this in some way, and the other being referred to as a safety verifying type which involves first verifying safety and then executing practices involving danger (for example before crossing an intersection, first verifying that the abovementioned two signal lights $G_1$, $G_2$ are not illuminated simultaneously and that only one is on).

Figure 14:
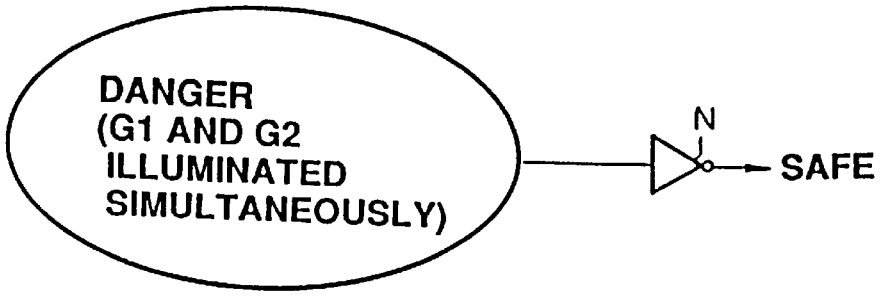
FIG. 14(*a*) is a diagram for explaining a danger detection type method of sampling safety information, while FIG. 14(*b*) is a basic circuit structural diagram.
Figure 14:
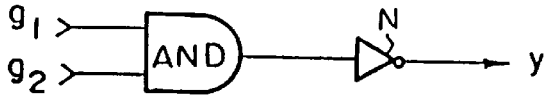

Consideration is now given to the construction shown in FIG. 14(*a*) where a provisional detection for danger is carried out ($G_1$ and $G_2$ illuminated simultaneously) and if there is no danger, safety is indicated.

This construction is based for example as shown in FIG. 14(*b*), on verification that the signal lights $G_1$, $G_2$ at an intersection are not illuminated simultaneously. In FIG. 14(*b*), $g_1$ and $g_2$ show a logic value of 1 when the respective signal lights $G_1$ and $G_2$ are illuminated, and a logic value of 0 when not illuminated. For example these are signals obtained by rectifying in a voltage doubler rectifying circuit, the output signal OUT1 from the current sensor in FIG. 2(*a*) or in FIG. 2(*b*) (to be described later). In FIG. 14, letter N indicates a NOT circuit. Letter y indicates a binary signal, being a logic value of 1 for safety and a logic value of 0 for danger. The implication with FIG. 14(*a*) is that danger is detected ($G_1$, $G_2$ illuminated simultaneously), and safety is then shown as the negative of this.

FIG. 14(*b*) shows the basic circuit construction, with y=1 being produced when the signal lights $G_1$, $G_2$ are not illuminated simultaneously, that is when the condition is not $g_1=g_2=1$, and y=0 being produced when $g_1=g_2=1$. If the NOT circuit N in the construction of FIG. 14 is normal, but the AND gate is faulty, or a disconnection fault occurs in the input lead for the input signal $g_1$ or $g_2$, or a disconnection fault occurs in the connection lead between the AND gate and the NOT circuit N, a logic value of 0 is produced for the input to the NOT circuit N, and for example even if the signal lights $G_1$, $G_2$ are illuminated simultaneously resulting in the condition $g_1=g_2=1$, an output y=1 results indicating safety. This characteristic cannot be avoided, even if the NOT circuit N is constituted by a circuit where there is never an error in the output condition of logic value 1 (that is to say a fail-safe circuit).

In view of the above situation, the following two facts can be stated in relation to the sampling of information indicating safety:

(1) a NOT operation must never be included in a process for sampling information indicating safety.

(2) safety must be sampled directly, rather than by sampling for danger.

Figure 15:
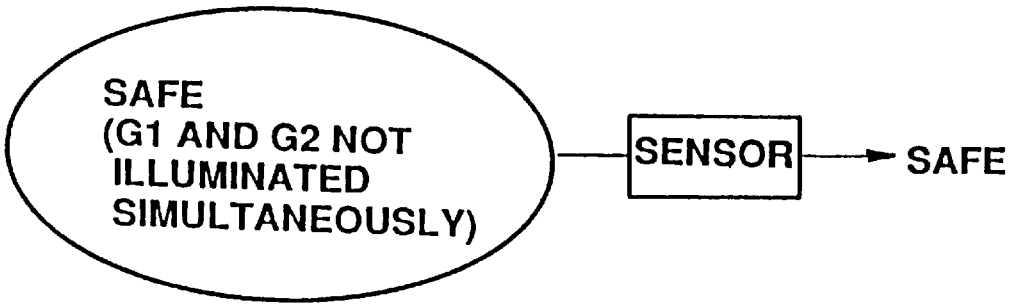
FIG. 15(*a*) is a diagram for explaining a safety verifying type method of sampling safety information, while FIG. 15(*b*) is a basic circuit structural diagram.
Figure 15:
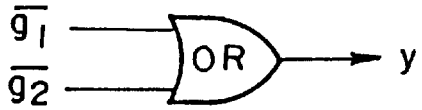

FIG. 15(*a*) shows a situation for where safety is sampled directly by a sensor.

In FIG. 15(*b*), the implication is that when one or both of the signal lights $G_1$, $G_2$ are not illuminated, the negation for $g_1$ being shown by $\overline{g_1}$, and the negation for $g_2$ being shown by $\overline{g_2}$ (the sign"" indicates negation), then safety is indicated by y=1. With FIG. 15(*b*), if a disconnection fault occurs in the input lead for $\overline{g_1}$ or $\overline{g_2}$, or the output lead for the output signal y, then the output signal becomes y=0 indicating danger. Consequently, if the construction is such that the OR gate cannot give an erroneous y=1 (ie. is fail-safe), then this circuit will not give an erroneous y=1 at the time of a fault.

FIG. 14(*b*) and FIG. 15(*b*) illustrate a logic equivalent to that of the De Morgan theorem.

That is to say, in FIG. 14(*b*), $$y=\overline{g_1 \cdot g_2} \tag{8}$$

while in FIG. 15(*b*), $$y=\overline{g_1} \vee \overline{g_2} \tag{9}$$

With the two equations, it will be evident that the processes for sampling safety (y=1) differ, and hence for safety information it is preferable to use equation (9) rather than equation (8). In equations (8) and (9) the symbol • indicates a logical product, while the symbol ∨ indicates a logical sum.

A description of an embodiment of a signal light simultaneous illumination detection circuit according to the present invention will now be given.

However before this, it is necessary to decide on the signal to use for indicating the signal light illumination condition in the following description of the embodiment.

Figure 16:
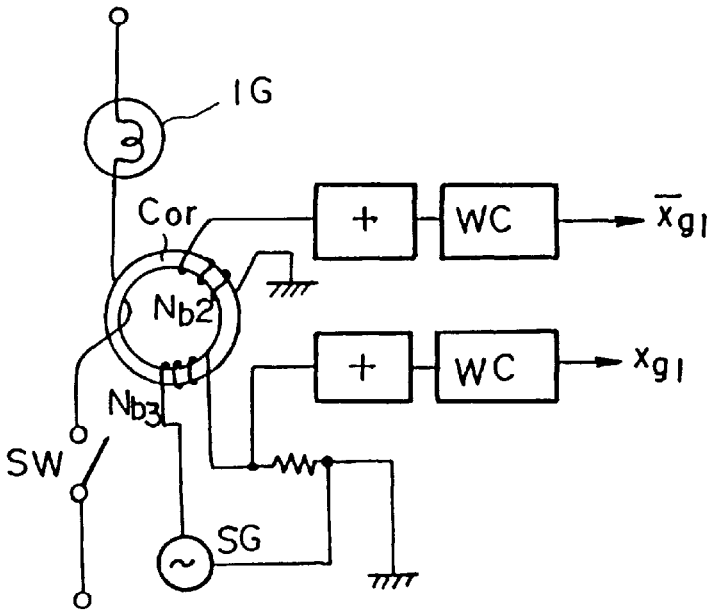
FIG. 16 is a diagram for explaining output signals from a current sensor applicable to the present invention.

The signal light illumination condition is detected using the current sensor of FIG. 2(*b*). The sensor output signal is level detected to be made binary using a voltage doubler rectifying circuit and a lower limit threshold value of a window comparator (one where in the upper limit threshold value is set sufficiently high so as to be unrelated) as shown in FIG. 2(*c*). As shown in FIG. 16, a detection signal of logic value 1 for when an illumination current flows for example in the signal light 1G and of logic value 0 for when this does not flow, is represented by a logical variable $x_{g1}$, while a detection signal of logic value 1 for when the illumination current does not flow and of logic value 0 for when the current does flow, is represented by a logical variable $\overline{x}_{g1}$. A proviso is that the output signal from the window comparator WC is an oscillating output signal (AC signal), and the amplitudes are the same magnitude. Here $g_1$ in $x_{g1}$ and $\overline{x}_{g1}$ indicate the respective signal lights $G_1$.

Figure 17:
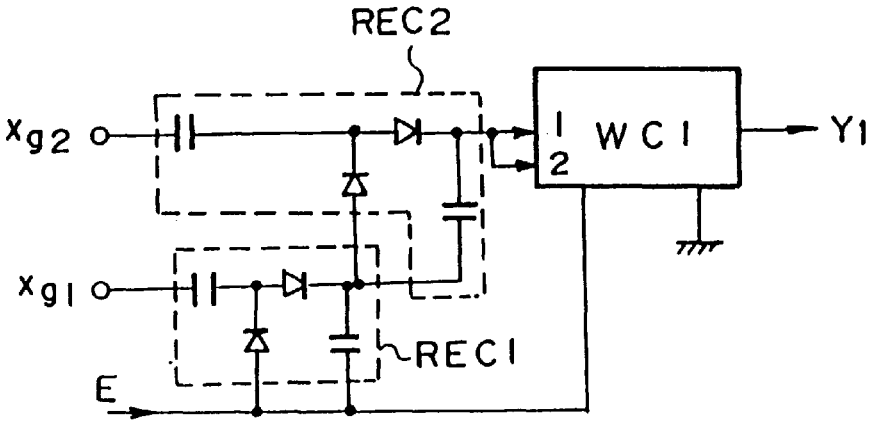
FIG. 17 is a circuit diagram of a first embodiment of the invention according to claim 18.

FIG. 17 is a schematic diagram of a first embodiment of a simultaneous illumination detection circuit according to the present invention.

Figure 18:
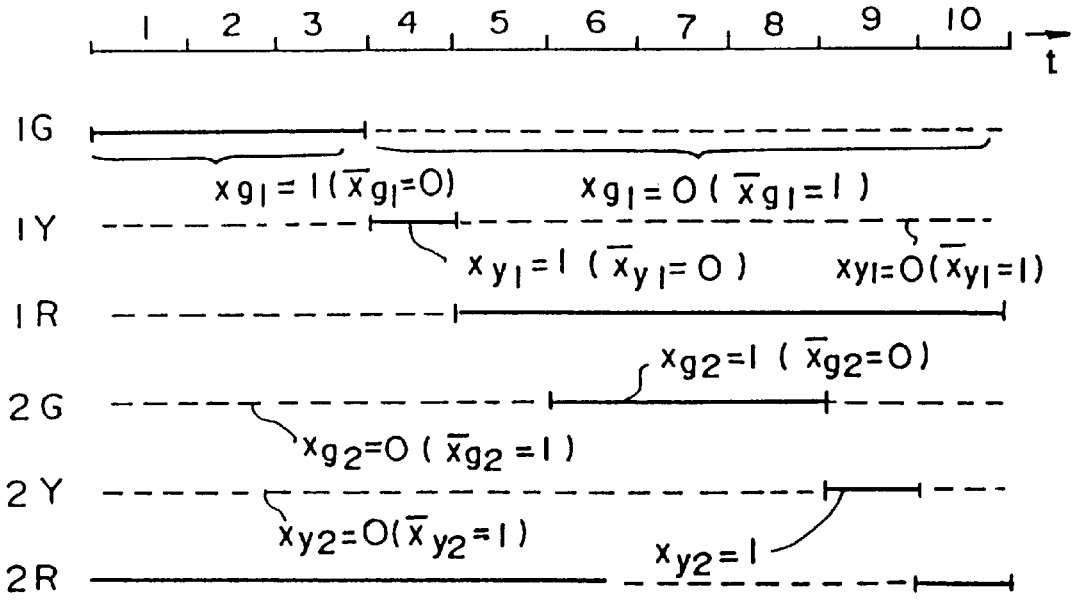
FIG. 18(*a*) is a relational diagram for the illumination of signal lights of an intersection applicable to the first embodiment, while FIG. 18(*b*) is a schematic diagram showing a signal unit arrangement at the intersection.
Figure 18:
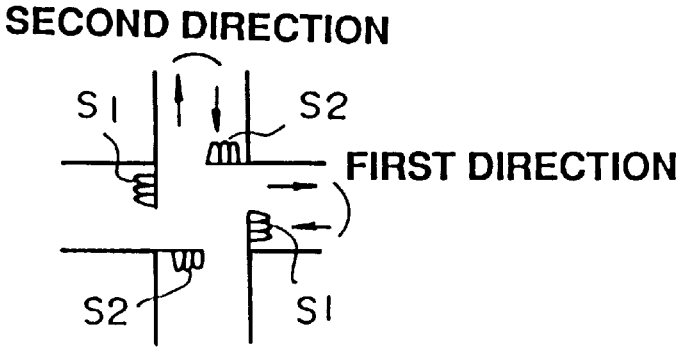

The first embodiment is one which detects simultaneous illumination of the G lights indicating permission to proceed for first and second directions at a two way intersection as shown in FIG. 18(*b*) (the case where there are two intersecting roads).

In FIG. 17, REC1 and REC2 are the voltage doubler rectifying circuits of FIG. 5, and constitute a first adding circuit for adding an illumination signal $x_{g1}$ for the green light 1G for the first direction, and an illumination signal $x_{g2}$ for the green light 2G for the second direction. The addition output is level detected using the beforementioned fail-safe two input window comparator WC1 serving as a first level detection circuit. When illuminated normally, the window comparator WC1 generates an output signal $Y_1=1$, while at the time of simultaneous illumination or when neither is illuminated, generates an output signal $Y_1=0$.

Figure 19:
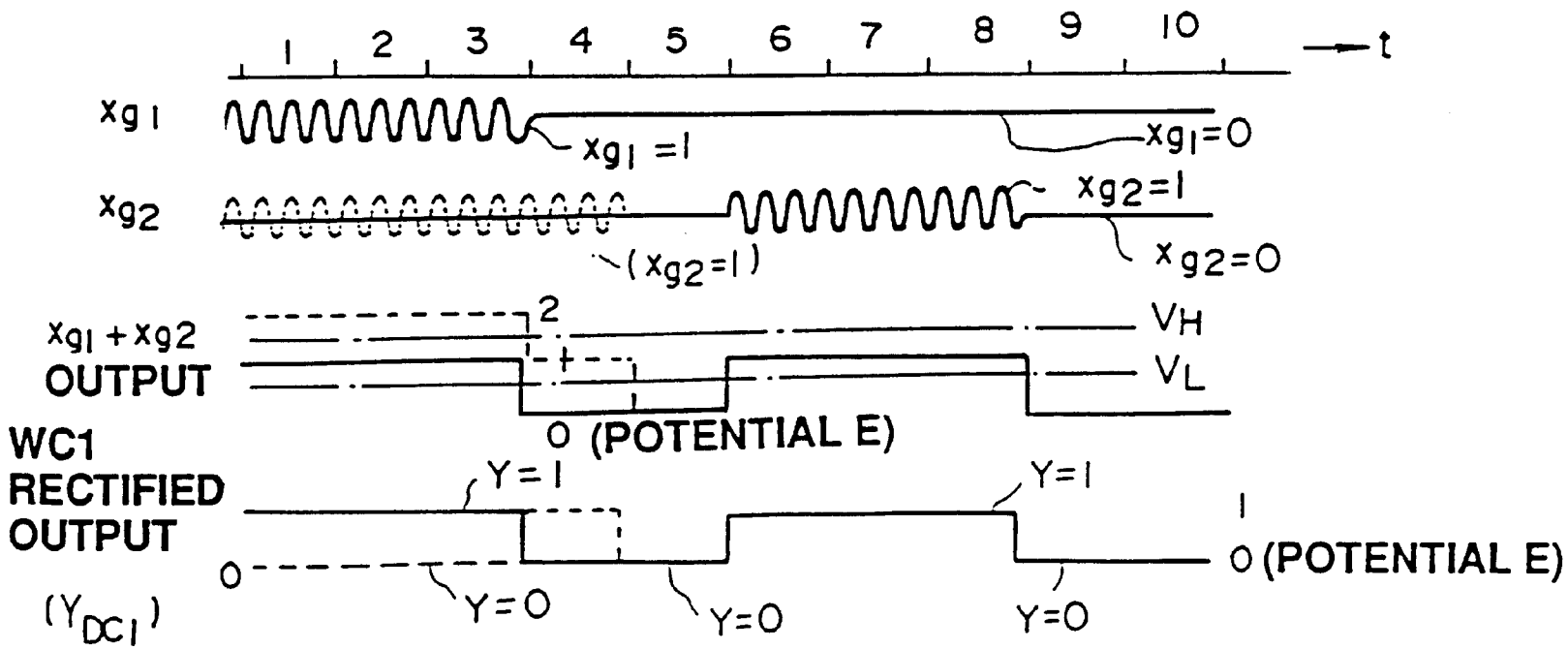
FIG. 19 is a time chart for the operation of the circuit of the first embodiment of FIG. 17.

Next is a description of the operation, referring to FIG. 18(*a*) and FIG. 19.

In FIG. 18(*a*), the illumination sequences for the signal lights of the two way intersection shown in FIG. 18(*b*) are represented on time axes, the full lines being the illumination intervals and the dashed lines being the non illumination intervals. The horizontal axis numerals show one period for signal light illumination in 10 equal increments. Hence in the case where the period for the signal light illumination is 100 seconds, the horizontal axis becomes 10 secs/div. Symbols 1G, 1Y, and 1R indicate the respective signal lights namely; green (G), yellow (Y), and red (R) for a signal unit S1 for a first direction of the intersection, while symbols 2G, 2Y, and 2R indicate the respective signal lights namely; green (G), yellow (Y), and red (R) for a signal unit S2 for a second direction of the intersection.

In FIG. 18(*a*), the green light 1G for the first direction is illuminated over intervals 1 through 3, the yellow light 1Y is illuminated over interval 4, while the red light 1R is illuminated over the other intervals (intervals 5 through 10). Moreover, the green light 2G for the second direction is illuminated over intervals 6 through 8, the yellow light 2Y is illuminated over interval 9, while the red light 2R is illuminated over the other intervals (intervals 1 through 5, and 10).

Consequently, as shown by the operating time chart of FIG. 19, with the sum ($x_{g1}+x_{g2}$) of the rectified output signals for the illumination signals $x_{g1}$, $x_{g2}$ of the green lights 1G, 2G from the current sensor, there is no overlap when the green lights 1G, 2G are illuminated normally, and hence the logic level is logic value 1. When neither is illuminated, the logic level is logic value 0 (corresponding to the level of the power source potential E of the window comparator WC1). If in a worst case scenario the green light 2G is illuminated over the illumination interval for the green light 1G as shown by the broken line, then the detection signal $x_{g2}=1$ for the illumination current is added to $x_{g1}=1$ so that the sum of the rectified output signals ($x_{g1}+x_{g2}$) becomes a logic level of logic value 2 as shown by the broken line in FIG. 19. Consequently, if as shown in FIG. 19, the upper limit threshold value $V_H$ of the window comparator WC1 is set between a logical level indicated by logic value 2 and a logical level indicated by logic value 1, then when the green lights 1G and 2G are illuminated simultaneously giving a logic value 2, the window comparator WC1 will not oscillate, so that the output signal becomes $Y_1=0$. In FIG. 19, the window comparator output YDC1 is shown as the condition after rectification.

Moreover, in the case were a burn-out fault occurs in the green light 1G or the green light 2G, then a logic value 0 condition occurs for the sum of the rectified output signals for $x_{g1}$ and $x_{g2}$. The lower limit threshold value $V_L$ shown in FIG. 19 is a threshold value for judging this condition, and is set between a logical level of logic value 1 and a logical level of logic value 0 relative to the sum of the rectified output signals for the output signals $x_{g1}$ and $x_{g2}$. If the rectified output signals (voltage level) for the output signals $x_{g1}$, $x_{g2}$ from the current sensor are both made v, then basically the logical level for the logic value 2 becomes 2v+E, while the logical level for the logic value 1 becomes v+E, and the logical level for the logic value 0 becomes E. Consequently, the threshold values $V_H$, $V_L$ are set as follows:

$$v+E<V_H<2v+E \quad E<V_L<v+E \tag{10}$$

and the output signal Y from the window comparator WC1 is;

$$Y_1 = \begin{cases} 1, & x_{gl}+x_{g2}=1 \\ 0, & x_{gl}+x_{g2}=2, \text{ or } x_{gl}+x_{g2}=0 \end{cases} \tag{11}$$

Here $Y_1=1$ is for when the window comparator oscillates and an AC output signal is produced. Moreover, $x_{g1}+x_{g2}$ has the meaning of the sum of the rectified output ail signals for the AC input signals $x_{g1}$ and $x_{g2}$.

With the circuit of FIG. 17, during the non illumination interval for the green lights 1G and 2G, a logical level equivalent to that at the time of a burn-out fault in the green light 1G or 2G ($x_{g1}+x_{g2}=0$, that is a logical level where a logic value 0 is produced for the output signal) is always produced within one period (intervals 4 and 5, and intervals 9 and 10).

Figure 20:
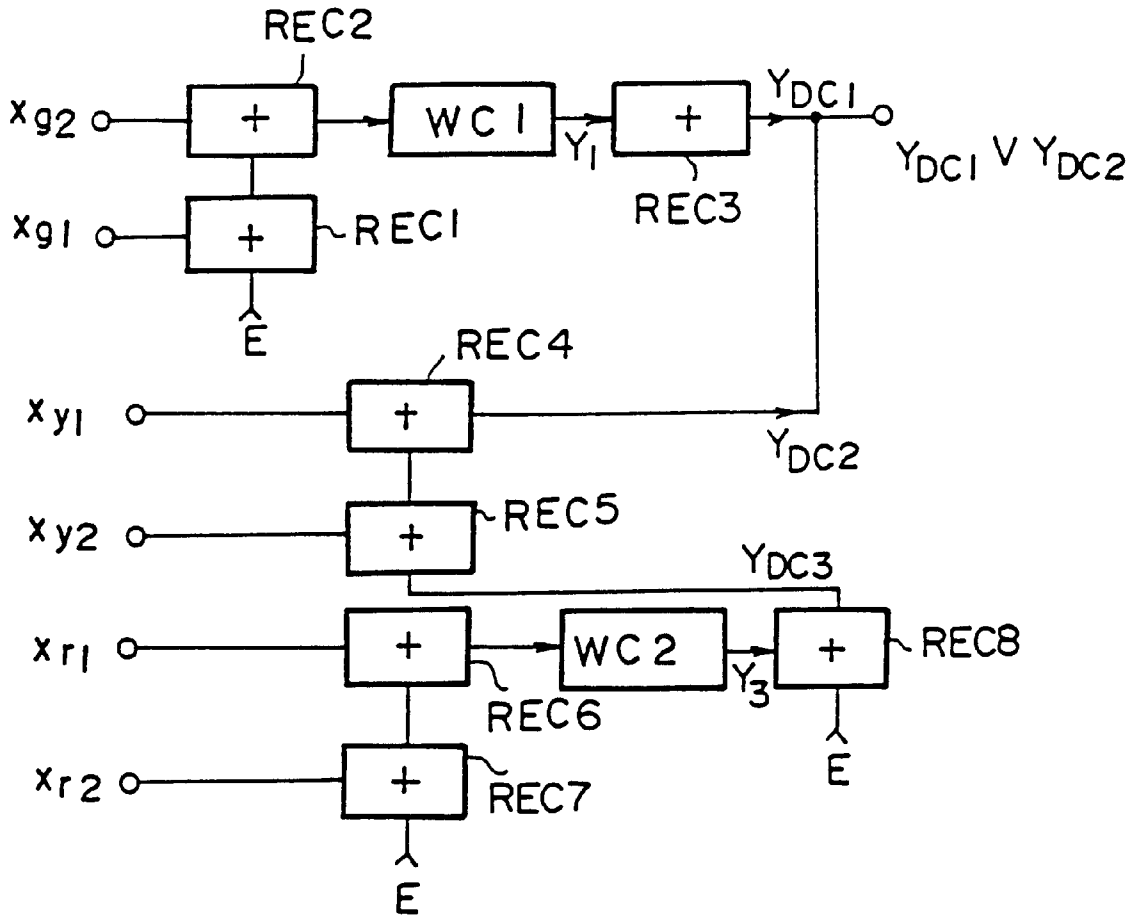
FIG. 20 is a circuit diagram of a second embodiment.

FIG. 20 illustrates a second embodiment of the present invention, being a simultaneous illumination detection circuit for the green lights 1G and 2G, which compensates for this defect. Components the same as for the first embodiment are indicated by the same symbols.

In FIG. 20, $x_{y1}$ denotes an output signal from a sensor which produces an AC signal of logic value 1 when a yellow light 1Y for one direction is illuminated, and gives a logic value 0 for no AC signal when the yellow light 1Y is not illuminated. Similarly, $x_{y2}$, $x_{r1}$, and $x_{r2}$ denote the sensor output signals, being $x_{y2}=1$, $x_{r1}=1$ and $x_{r2}=1$ for when the respective signal lights 2Y, 1R, and 2R are illuminated, and $x_{y2}=0$, $x_{r1}=0$, and $x_{r2}=0$ for when not illuminated.

Voltage doubler rectifying circuits REC6 and REC7 constitute a second adding circuit, a window comparator WC2 constitutes a second level detection circuit, voltage doubler rectifying circuits REC4, REC5, and REC8 constitute a third adding circuit, and a first logical sum operation circuit is constituted by a wired OR connection.

The operation will now be explained.

Signals $x_{r1}$ and $x_{r2}$, respectively indicating the illumination and non-illumination of the red lights 1R and 2R, are added by the second adding circuit and then level detected by the window comparator WC2. The lower limit threshold value in the window comparator WC2 is set so that when $x_{r1}=x_{r2}=1$, an output signal Y3=1 is produced (the upper limit threshold value is set to a sufficiently high level so as to have no relation). That is to say, the lower limit threshold value is set between the logical levels for logic values 2 and 1, and hence the window comparator WC2 carries out the operation as follows:

[124]128]

$$Y_3 = \begin{cases} 1, & x_{rl}+x_{r2}=2 \\ 0, & x_{rl}+x_{r2}=1 \end{cases} \tag{12}$$

The operation result $Y_3=1$ is for when the red lights 1R and 2R are simultaneously illuminated, and hence corresponds to intervals 5 and 10 of FIG. 18 (a). The signal Y3 and the illumination signals $x_{y1}$ and $x_{y2}$ for the yellow lights 1Y and 2Y are added by the respective voltage doubler rectifying circuits REC8, REC 4 and REC 5. With the signals $x_{y1}=1$ and $x_{y2}=1$, that is the illumination of yellow lights 1Y and 2Y, and the simultaneous illumination of red lights 1R and 2R ($Y_3=1$), if the signal lights are normally illuminated, then these are always generated at different times, and hence, the signal YDC2, generated as the sum of $x_{y1}$ and $x_{y2}$ and the output signal $Y_3$ from the window comparator WC2, is always 1, except for during the illumination interval for the green lights 1G and 2G. Since the rectified signal YDC1 for the output signal Y1 from the window comparator WC1 becomes a logic value 1 during the illumination interval for the green lights 1G and 2G as shown in FIG. 18(*a*), then the logical sum $Y_{DC2} \vee Y_{DC1}$ of the addition output $Y_{DC2}$ and the voltage doubler rectifying circuit REC3 output $Y_{DC1}$ of FIG. 20 (logical sum based on the circuit of FIG. 13), is always a logical value 1 if illumination for all of the signal lights is normal. Moreover, if a simultaneous illumination occurs with the green lights 1G and 2G, then $Y_{DC2} \vee Y_{DC1}$ gives a logical value 0. Here the symbol v represents a logical sum.

Figure 21:
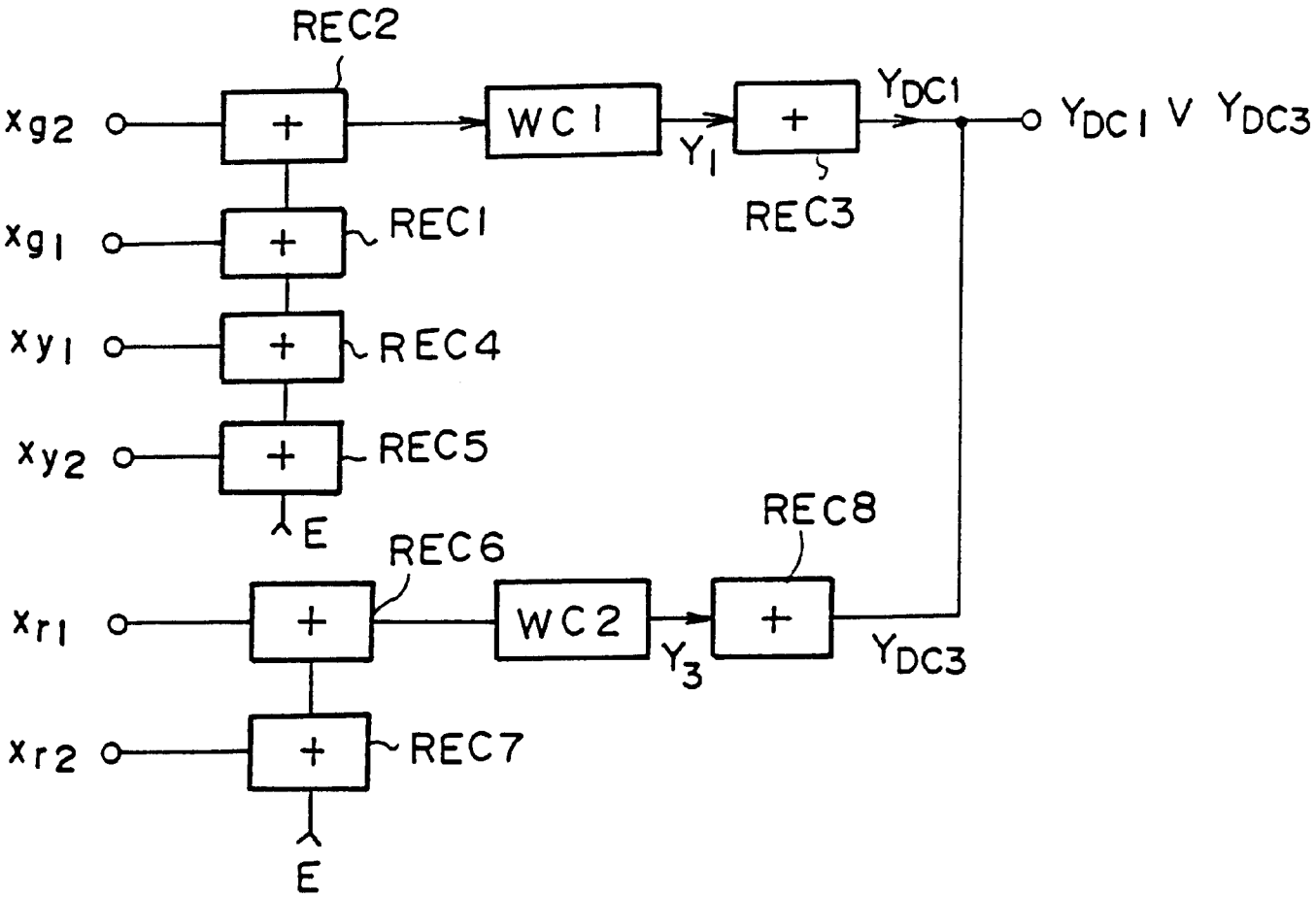
FIG. 21 is a circuit diagram of a third embodiment.

FIG. 21 is a circuit illustrating a third embodiment of a simultaneous illumination detection circuit, being a circuit which detects not only simultaneous illumination of the green lights 1G and 2G but also simultaneous illumination between the signal lights 1G and 1Y, and 2G and 2Y. Components the same as for the second embodiment are indicated by the same symbols.

In FIG. 21, the construction is such that the output signals $x_{g1}$, $x_{g2}$, $x_{y1}$ and $x_{y2}$ from the current sensors are added. Voltage doubler rectifying circuits REC1, REC2, REC4 and REC5 constitute a fourth adding circuit. Moreover, a second logical sum operation circuit is constituted by a wired OR connection.

Since if the signal lights as shown in FIG. 18 are in a normal illumination condition, the signal lights 1G, 2G, 1Y and 2Y are illuminated at different times to each other, then the addition output ($x_{g1}+x_{g2}+x_{y1}+x_{y2}$) is always a logical value 1. Furthermore, if any two of the four signal lights are simultaneously illuminated, then the addition output become a logic value 2, while if three are simultaneously illuminated, this becomes a logic value 3, and if four are simultaneously illuminated, this becomes a logic value 4. Therefore, the upper limit threshold value $V_H$ Of the window comparator WC1 is set to a level between the logical levels for logic values 1 and 2, while the lower limit threshold value $V_L$ is set to a level between the logical levels for logic values 1 and 0, and the output signal $Y_1$ is generated as follows.

[128]

$$Y_1 = \begin{cases} 1, & x_{g1} + x_{g2} + x_{y1} + x_{y2} = 1 \\ 0, & x_{g1} + x_{g2} + x_{y1} + x_{y2} \geq 2 \text{ or } x_{g1} + x_{g2} + x_{y1} + x_{y2} = 0 \end{cases} \quad (13)$$

In FIG. 20 and FIG. 21, the voltage doubler rectifying circuits REC as mentioned before do not erroneously produce an output signal with a fault while there is no input signal. Moreover, with the window comparator WC also, a similar situation with a fault does not arise. Consequently, the output signals from the respective circuits of FIG. 20 and FIG. 21, which are based on the output signals from the adding circuits, err towards a drop in the logic value at the time of a fault. Under conditions wherein the signal lights 1G, 2G, 1Y, 2Y 1R and 2R are operating normally, then in the case of a fault in the sensors for generating the signals $x_{g1}$, $x_{g2}$, $x_{y1}$, $x_{y2}$, $x_{r1}$ and $x_{r2}$, or in the constituent elements of the circuits shown in FIG. 20 and FIG. 21, a logic value of zero is produced for the output signals for both the circuits of FIG. 20 and FIG. 21. That is to say, if a fault occurs in the sensors for generating the signals $x_{g1}$, $x_{g2}$, $x_{y1}$, $x_{y2}$, $x_{r1}$ and $x_{r2}$, or a fault occurs in the voltage doubler rectifying circuits for rectifying these signals, then at the time when the addition values $x_{g1}+x_{g2}$, or $x_{y1}+x_{y2}$, or $x_{g1}+x_{g2}+x_{y1}+x_{y2}$, or $x_{r1}+x_{r2}$ should be a logic value 1, a logic value 0 is produced. Also in the case where a fault occurs in the window comparator WC1 or WC2, or a fault occurs in the voltage doubler rectifying circuit REC3 or REC8, then at the time when the logical sums $Y_{DC1} \vee Y_{DC2}$ or $Y_{DC1} \vee Y_{DC3}$ should be a logic value 1, a logic value 0 is produced. Consequently, when the respective signal lights are operating normally, then with the circuit constructions of FIG. 20 and FIG. 21, fault detection of the circuit is possible (these circuits have the characteristics that at the time of a fault, a logic value 0 is produced in the output signal).

With the circuit construction of FIG. 20 and FIG. 21, under conditions wherein a simultaneous illumination error is produced in the signal lights so that a logic value of 2 or a logic value greater than 2 showing the abnormality should be produced for the addition value, then if a fault occurs in the current sensor or in the voltage doubler rectifying circuit for rectifying the sensor output, a situation can arise giving a logic value 1 indicating normal. That is to say, if an illumination abnormality for the signal lights, and a fault in the simultaneous illumination detection circuit of FIG. 20 or FIG. 21 both occur at the same time, it is not always possible to detect the simultaneous illumination. The reason for this is that the circuit constructions of FIG. 20 and FIG. 21 are danger detection type constructions.

Next is a description of an embodiment of a simultaneous illumination detection circuit of a safety verifying type construction having even greater fail-safe characteristics, which always produces a logic value 0 in the output signal to reliably warn of an abnormality, even in the abovementioned case where simultaneous illumination and a detection circuit fault occur at the same time.

With the safety verifying type construction, in detecting simultaneous illumination of the green lights 1G and 2G at a two way intersection, it is necessary to detect that a simultaneous illumination of the green lights 1G and 2G has not occurred. That is to say, detection must be based on equation (9).

Figure 22:
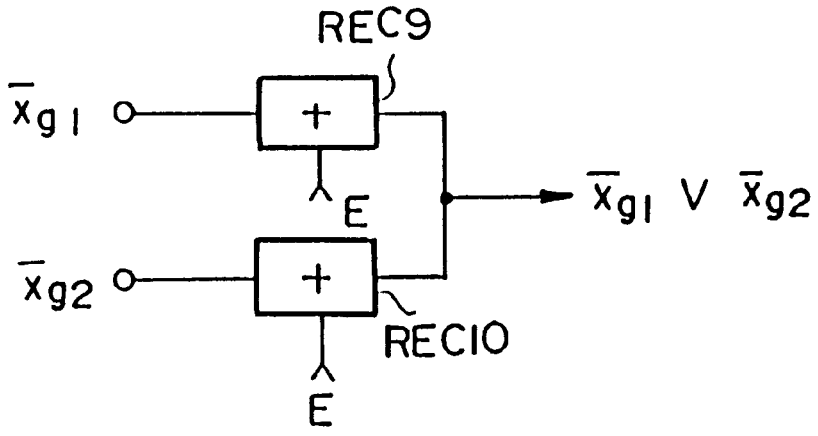
FIG. 22 is a circuit diagram of a first embodiment of the invention according to claim 22.

FIG. 22 shows a circuit example for a simultaneous illumination detection circuit of the safety verifying type.

In FIG. 22, an input signal $\overline{x}_{g1}$ is the signal obtained from the output signal OUT2 of the current sensor of FIG. 2(*b*). As shown in FIG. 16, this is the AC output signal $\overline{x}_{g1}$ obtained via the voltage doubler rectifying circuit and the window comparator. With the circuit of this embodiment, the construction is such that the input signals $\overline{x}_{g1}$ and $\overline{x}_{g2}$ are rectified by means of voltage doubler rectifying circuits REC9 and REC10, and subjected to a logical sum operation in a logical sum operation circuit constituted by a wired OR connection (corresponding to a third logical sum operation circuit).

With this circuit, when the green lights 1G and 2G are illuminated simultaneously, the logical sum output $\overline{x}_{g1} \vee \overline{x}_{g2}$ becomes a logic value 0.

Figure 23:
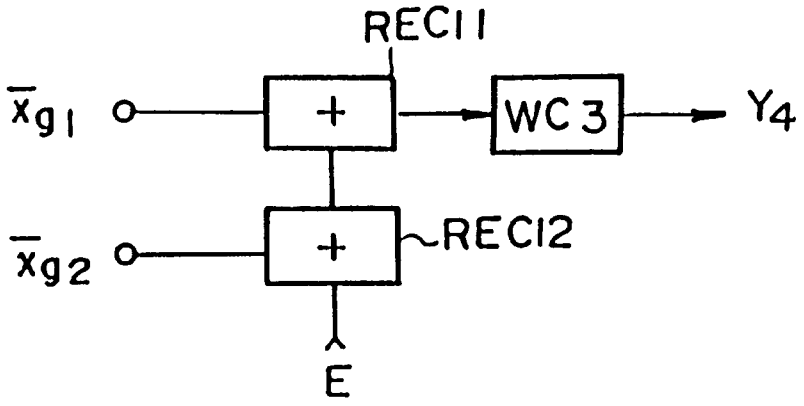
FIG. 23 is a circuit diagram of a second embodiment.

FIG. 23 shows a simultaneous illumination detection circuit with a construction wherein both input signals $\overline{x}_{g1}$ and $\overline{x}_{g2}$ are added by a fifth adding circuit comprising voltage doubler rectifying circuits REC11 and REC12, and the addition output is level detected by a window comparator WC3 serving as a third level detection circuit to thereby obtain an output signal Y4.

Figure 24:
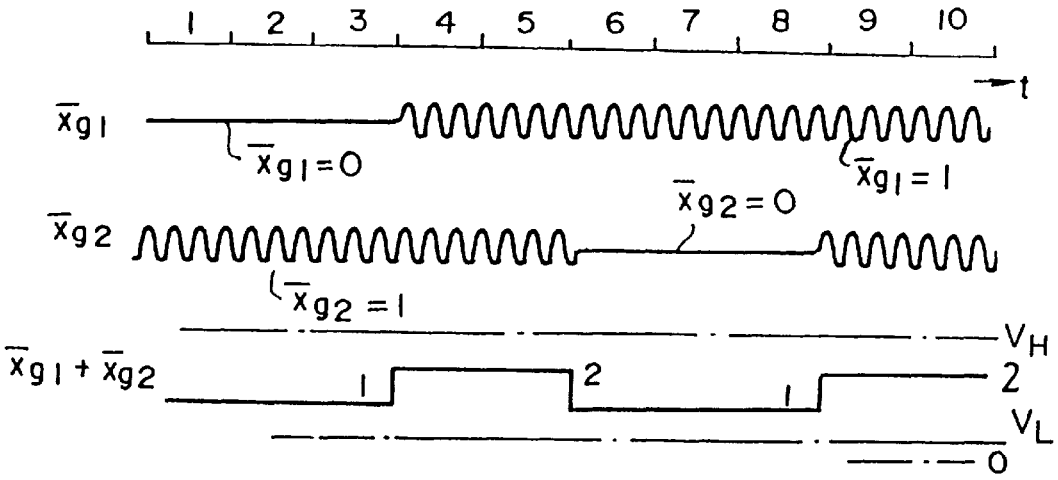
FIG. 24 is a time chart showing a relationship between sensor outputs and addition outputs of the second embodiment of FIG. 23.

FIG. 24 shows the current sensor output signals $\overline{x}_{g1}$ and $\overline{x}_{g2}$ for the green lights 1G and 2G, and the logical values for the rectified output signal addition value $\overline{x}_{g1}+\overline{x}_{g2}$ for these two input signals.

In this case, if the upper limit threshold value $V_H$ of the window comparator WC3 is set to be higher than a logical level of logic value 2, and the lower limit threshold value $V_L$ is set between a logical level of logic value 1 and logic value 0, then provided that the illumination for the green lights 1G and 2G do not overlap, the output signal $Y_4$ is always a logic value 1. In a worst case scenario where the green lights 1G and 2G are simultaneously illuminated, or a fault occurs in the current sensor for producing the input signals $\overline{x}_{g1}$ or $\overline{x}_{g2}$, or in the voltage doubler rectifying circuit REC11 or REC12, or in the window comparator WC3, the output signal $Y_4$ becomes a logic value 0 (the condition where an AC signal is not output). Moreover, even if for example two or more faults occur simultaneously in the constituent components, the output signal still becomes $Y_4=0$.

Consequently, with the circuit constructions of FIG. 22 and FIG. 23, even when a simultaneous illumination fault in the green lights 1G and 2G, and a fault in the detection circuit occur together, such an abnormality can be advised.

Figure 25:
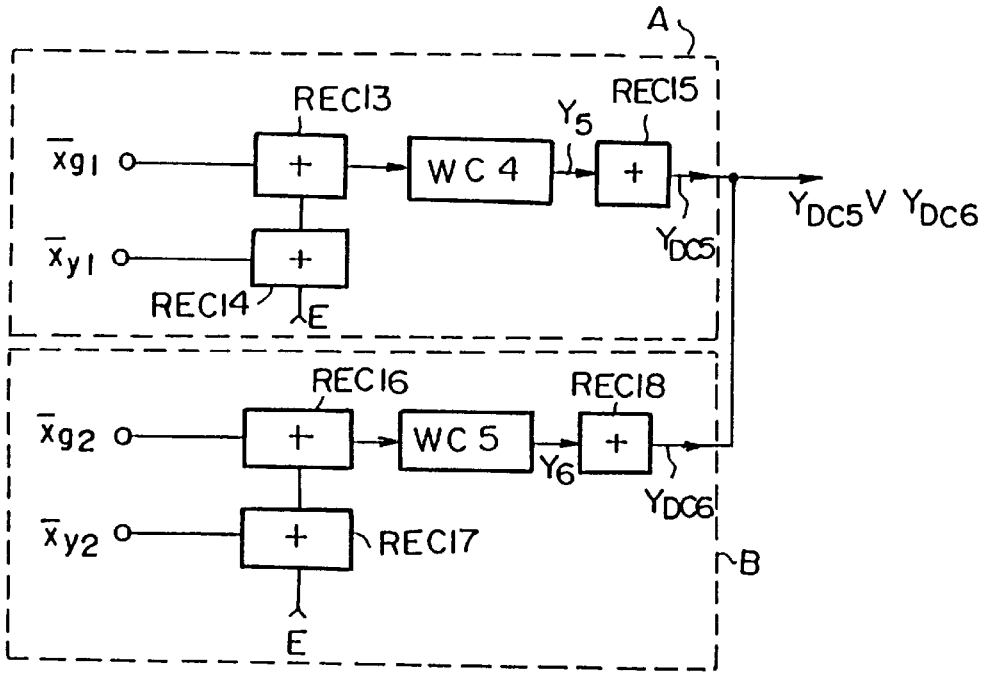
FIG. 25 is a circuit diagram of a third embodiment.
Figure 26:
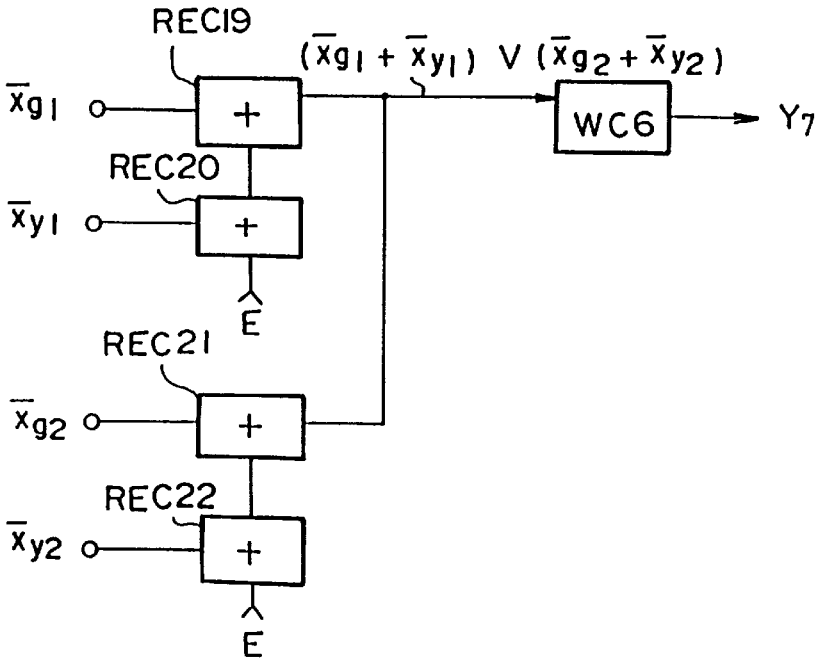
FIG. 26 is a circuit diagram of a fourth embodiment.

FIG. 25 and FIG. 26 show respective embodiments of simultaneous illumination detection circuits of the safety verifying type, which takes into consideration simultaneous illumination between the yellow lights Y, in addition to simultaneous illumination of the green lights G.

In FIG. 25, the section enclosed by dashed line A and the section enclosed by dashed line B have respective input signals $\overline{x}_{g1}$ and $\overline{x}_{y1}$ for section A, and $\overline{x}_{g2}$ and $\overline{x}_{y2}$ for section B, with circuit constructions the same as for FIG. 23. However, with the window comparators WC4 and WC5 serving as fourth and fifth level detection circuits, when the input level is logic value 2, an output signal of logic value 1 is produced, while when the input level is logic value 1 or logic value 0, an output signal of logic value 0 results.

In FIG. 26, the construction is such that after respective addition by voltage doubler rectifying circuits REC19 and REC20 constituting an eighth adding circuit, and voltage doubler rectifying circuits REC21 and REC22 constituting a ninth adding circuit, a logical sum operation is first carried out by a wired OR connection serving as a fifth logical sum operation circuit, after which the level is detected by a window comparator WC6 serving as a sixth level detection circuit.

AC output signals $Y_5$ and $Y_6$ from the window comparators WC4 and WC5 of FIG. 25 are represented by the following equations.

$$Y_5 = \begin{cases} 1, & \bar{x}_{gl} + \bar{x}_{yl} = 2 \\ 0, & \bar{x}_{gl} + \bar{x}_{yl} = 1 \text{ or } \bar{x}_{gl} + \bar{x}_{yl} = 0 \end{cases} \quad (14)$$

$$Y_6 = \begin{cases} 1, & \bar{x}_{g2} + \bar{x}_{y2} = 2 \\ 0, & \bar{x}_{g2} + \bar{x}_{y2} = 1 \text{ or } \bar{x}_{g2} + \bar{x}_{y2} = 0 \end{cases} \quad (15)$$

With FIG. 25, the output signals from the window comparators WC4, WC5 are rectified by the respective voltage doubler rectifying circuits REC15, REC18 and output as a logical sum operation output signal $Y_{DC5}/Y_{DC6}$ by means of a wired OR connection serving as a fourth logical sum operation circuit.

The voltage doubler rectifying circuits REC13, REC14 constitute a sixth adding circuit, while the voltage doubler rectifying circuits REC16, REC17 constitute a seventh adding circuit.

Figure 27:
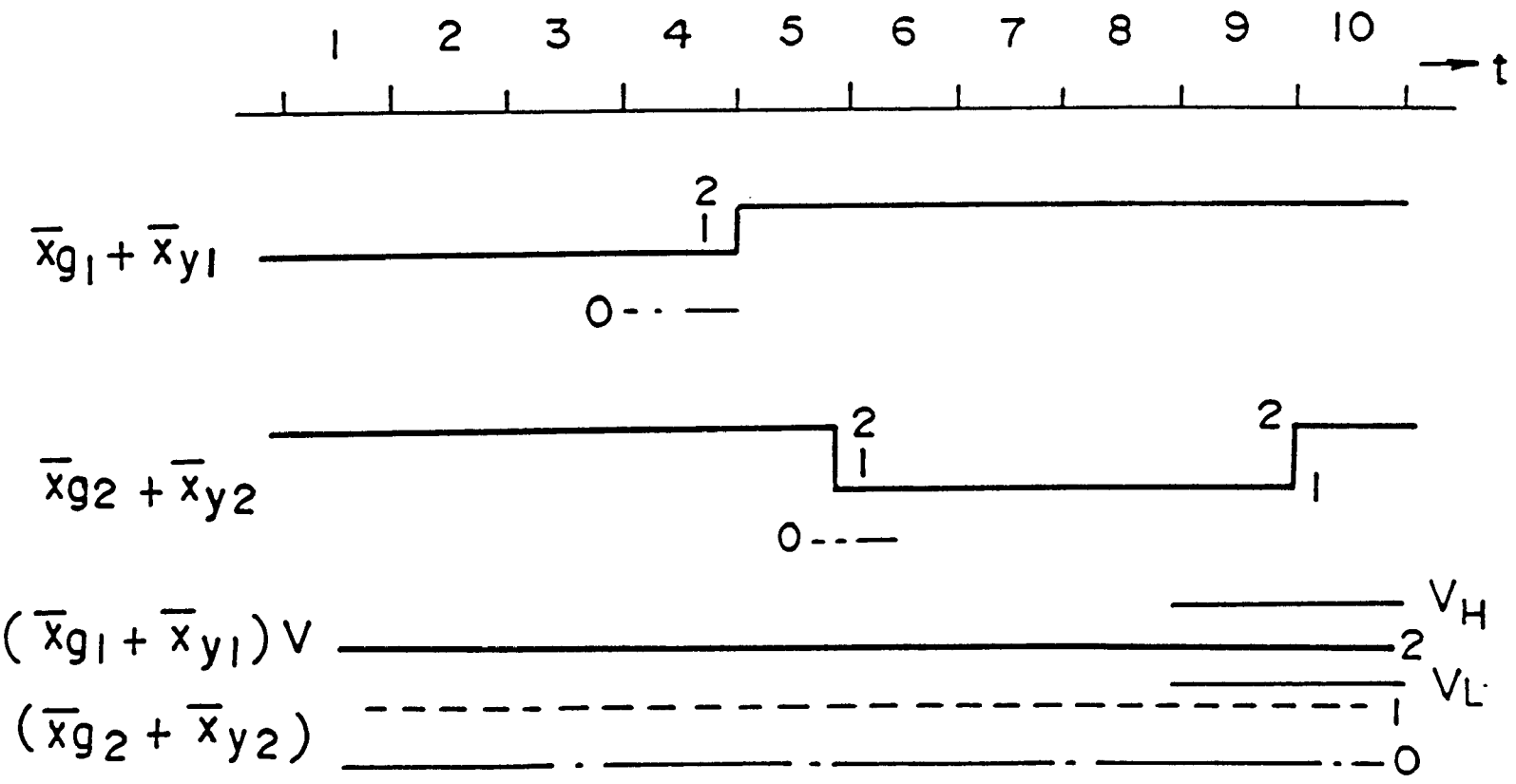
FIG. 27 is a time chart showing a relationship between addition outputs and a logical sum output of the circuit of the fourth embodiment of FIG. 26.

FIG. 27 is an operational time chart for the circuit of FIG. 25, with the illumination relationship of FIG. 18.

When only one of the signals $\bar{x}_{g1}$ and $\bar{x}_{y1}$ representing zero current for the signal lights 1G and 1Y for the first direction is input, then the sum $\bar{x}_{g1}+\bar{x}_{y1}$ of the rectified output signals for both signals is logic value 1. Similarly, when only one of the signals $\bar{x}_{g2}$ and $\bar{x}_{y2}$ representing zero current for the signal lights 2G and 2Y for the second direction is input, then the sum $\bar{x}_{g2}+\bar{x}_{y2}$ of the rectified output signals for both signals is logic value 1. When both of the input signals $\bar{x}_{g1}$and $\bar{x}_{y1}$ are input, and both of the input signals $\bar{x}_{g2}$ and $\bar{x}_{y2}$ are input, the respective logic values are $\bar{x}_{g1}+\bar{x}_{y1}=2$, and $\bar{x}_{g2}+\bar{x}_{y2}=2$. With the threshold values $V_L$ and $V_H$ for the window comparators WC4 and WC5, as shown in FIG. 27, the upper limit threshold value $V_H$ is set to a level higher than the logical level of logic value 2 for the sum of the respective input signals, while the lower limit threshold value $V_L$ is set between the logical levels of logic value $_2$ and logic value 1 for the sum of the respective input signals. Therefore, with the window comparators WC4, WC5, only when the sum of the respective input signals shows a logic value 2, are the respective output signals $Y_{DC5}=1$ and $Y_{DC6}=1$ produced. Furthermore, if simultaneous illumination of the signal lights 1G, 2G, or simultaneous illumination of the signal lights 1G, 2Y, or simultaneous illumination of the signal lights 1Y, 2G occurs, then this will give a time where the output signals $Y_{DC5}$ and $Y_{DC6}$ are simultaneously at logic value 0.

With the construction of FIG. 25, the judgment of section A and section B, that is, whether or not there is signal light illumination for the first and second directions, is carried out by identical circuit constructions, with the upper and lower limit threshold values for the window comparators WC4 and WC5 at the same levels. The construction can therefore be such that the addition of the two input signals, that is, the logical sum operation of $\bar{x}_{g1}+\bar{x}_{y1}$ and $\bar{x}_{g2}+\bar{x}_{y2}$, is carried out first as with the embodiment of FIG. 26, after which level detection is carried out with the window comparator WC6. In FIG. 26, REC19 through REC22 are voltage doubler rectifying circuits.

With the circuit of FIG. 26, if a simultaneous illumination of the signal lights 1G, 1Y, 2G and 2Y occurs in any group, then for both of the addition signals $\bar{x}_{g1}+\bar{x}_{y1}$ and $\bar{x}_{g2}+\bar{x}_{y2}$, a level of logic value 1 or logic value 0 is simultaneously produced. That is, if the signal lights are in a normal illumination condition, then $(\bar{x}_{g1}+\bar{x}_{y1})\vee(\bar{x}_{g2}+\bar{x}_{y2})$ is always at a logic level of logic value 2, while if in the one group of four signal lights a simultaneous illumination occurs, a logic value 1 or a logic value 0 is generated for $(\bar{x}_{g1}+\bar{x}_{y1})\vee(\bar{x}_{g2}+\bar{x}_{y2})$. The window comparator WC6, as shown in FIG. 27, therefore has an upper limit threshold value $V_H$ of a higher level than the logical level of logic value 2 for the $(\bar{x}_{g1}+\bar{x}_{y1})\vee(\bar{x}_{g2}+\bar{x}_{y2})$, and has a lower limit threshold value $V_L$ between a logical level of logic value 2 and a logical level of logic value 1.

Figure 28:
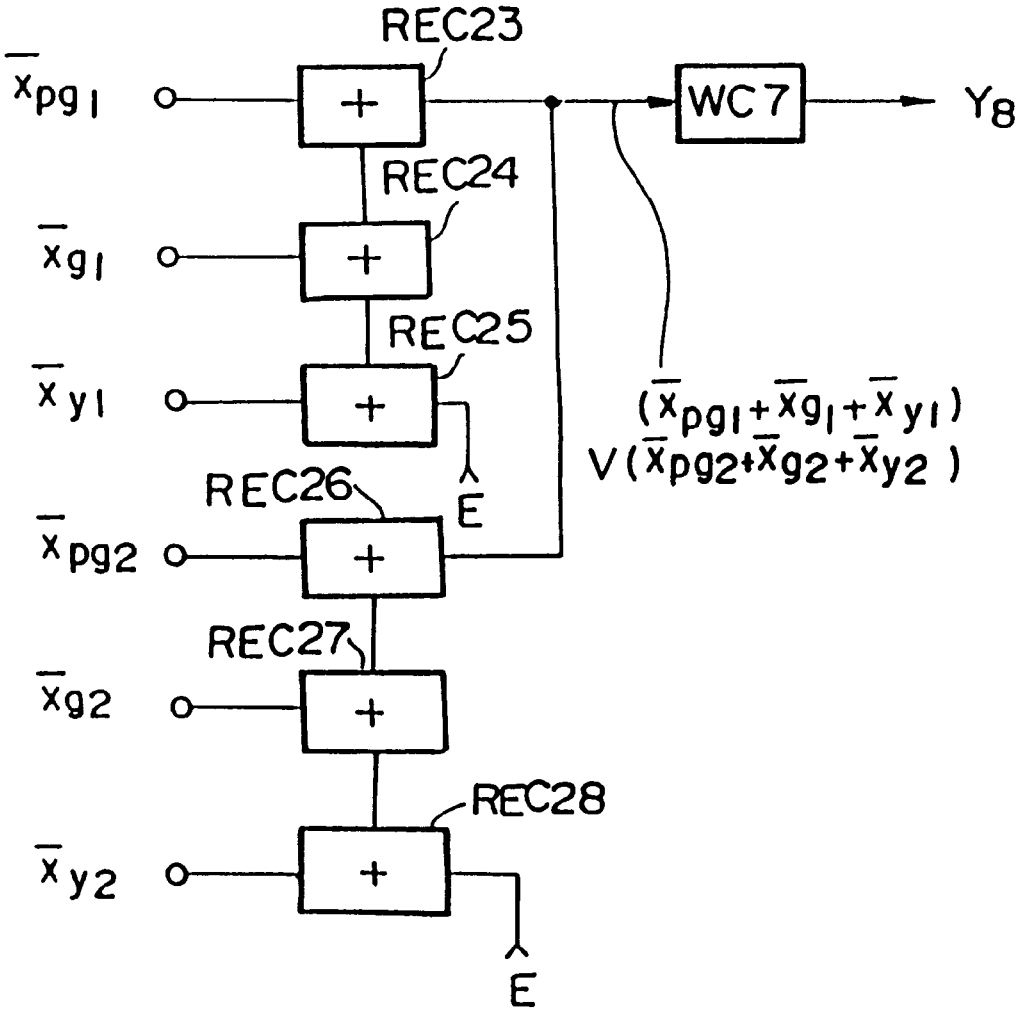
FIG. 28 is a circuit diagram of a fifth embodiment.
Figure 29:
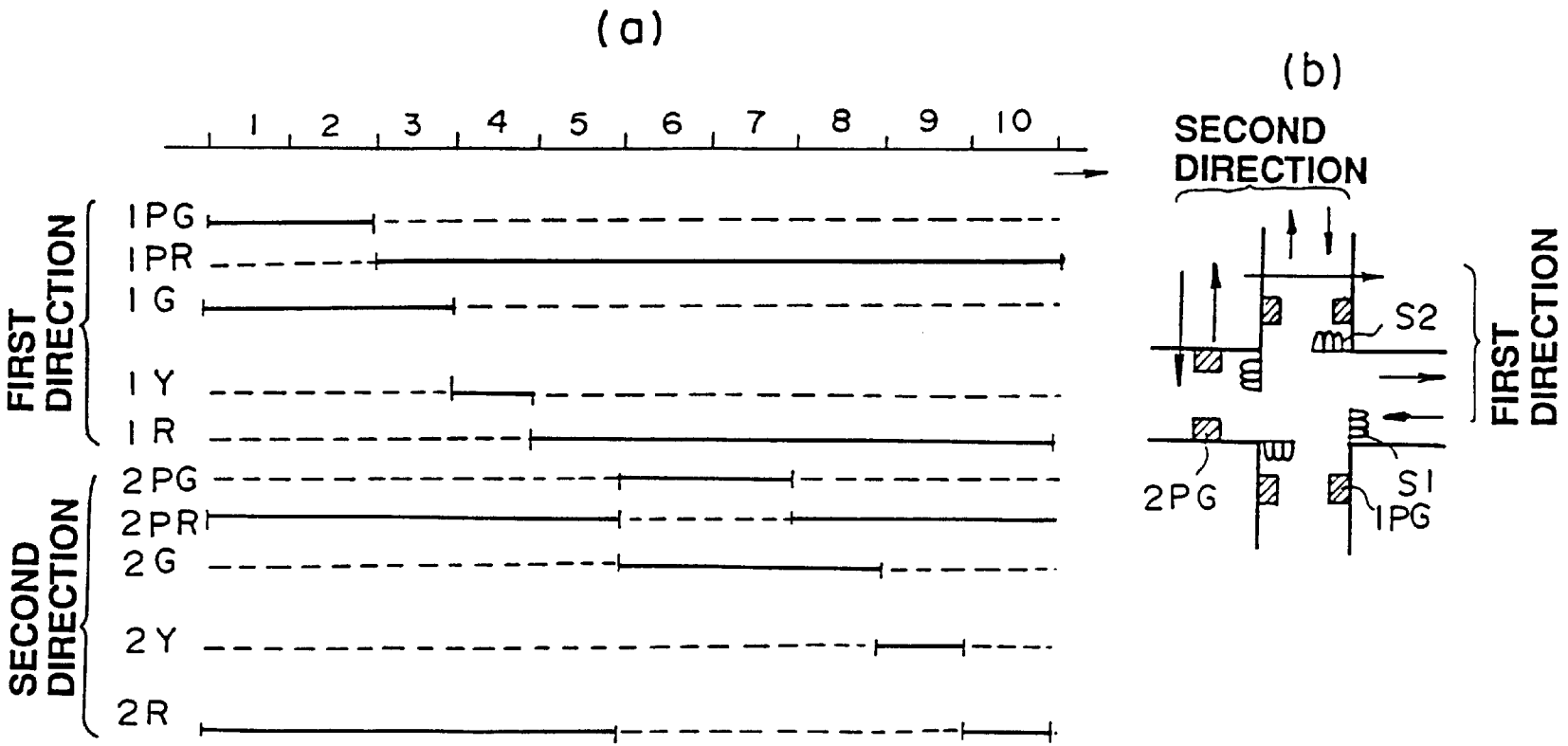
FIG. 29(*a*) is a relational, diagram for the illumination of signal lights of a two way intersection, while FIG. 29(*b*) is a schematic diagram showing a signal unit arrangement at the intersection.
Figure 30:
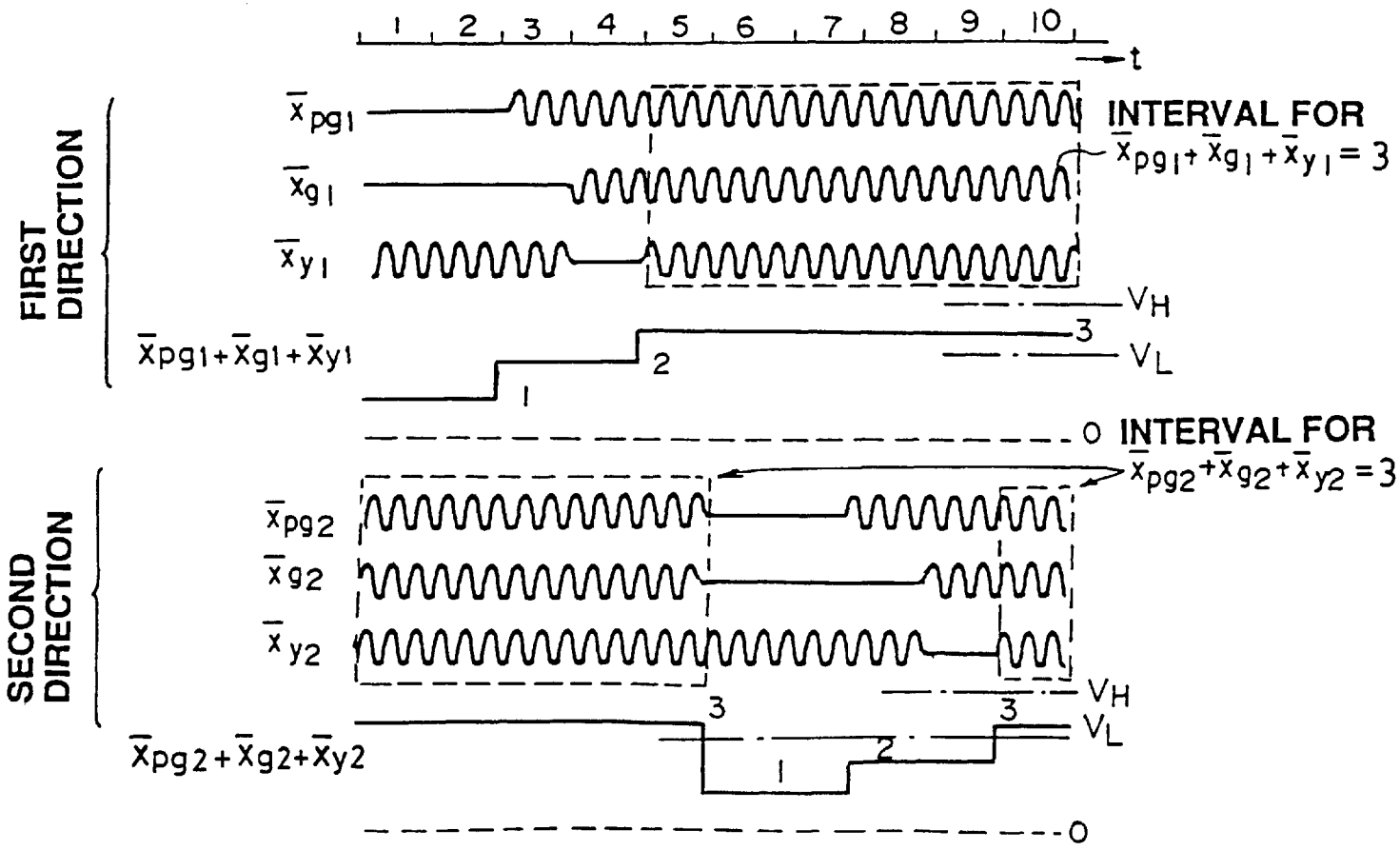
FIG. 30 is a time chart showing a relationship between sensor outputs and addition outputs of the fifth embodiment of FIG. 28.

Next is a description of yet another embodiment of a simultaneous illumination detection circuit with reference to FIG. 28 through FIG. 30.

FIG. 28 is an example of a simultaneous illumination detection circuit for an intersection provided with signals 1PG, 2PG for indicating permission to proceed for pedestrians, as shown in FIG. 29(*b*).

In FIG. 28, $\bar{x}_{pg1}$ indicates a non illumination signal for a pedestrian signal light 1PG. REC23 through REC28 indicate voltage doubler rectifying circuits, while WC7 indicates a window comparator.

With this circuit, the construction is such that six input signals are separated in a similar manner to FIG. 26, into $\bar{x}_{pg1}$, $\bar{x}_{g1}$ and $\bar{x}_{y1}$ (non illumination signals related to first direction signal lights 1PG, 1G, 1Y) and $\bar{x}_{pg2}$, $\bar{x}_{g2}$ and $\bar{x}_{y2}$ (non illumination signals related to second direction signal lights 2PG, 2G, 2Y), which are then respectively added.

FIG. 29(*a*) shows the illumination relationship for the respective signal lights at mri this intersection, with the time axes the same as in FIG. 18(*a*) divided into ten equal increments within one period for the first direction signal lights 1G, 1Y, 1PG, and the second direction signal lights 2G, 2Y, 2PG, the illumination intervals being shown by the full lines. The dashed lines show the non illumination intervals.

The non illumination signals $\bar{x}_{g1}$, $\bar{x}_{y1}$ and $\bar{x}_{pg1}$, and $\bar{x}_{g2}$, $\bar{x}_{y2}$ and $\bar{x}_{pg2}$ for the respective signal lights are respectively generated in the dashed line intervals as logic value 1. The signal lights 1PR, 1R and 2PR, 2R are respectively the red lights for pedestrians and traffic in the first direction, and the red lights for pedestrians and traffic in the second direction.

FIG. 30 shows the logic values for the addition results of the input signals in the respective first direction and second direction. The intervals 5 through 10 for the first direction, enclosed by the dashed line, and the intervals 1 through 5 and 10 for the second direction, enclosed by the dashed line, are the intervals where the addition results show a logic value 3. Since the intervals 1 through 4 are the intervals where permission to proceed in the first direction is given to pedestrians as well as to traffic, then here the addition value $\bar{x}_{pg2}+\bar{x}_{g2}+\bar{x}_{y2}$ for the second direction input signals must be a logic value 3. Moreover, since the intervals 6 through 9 are the intervals where permission to proceed in the second direction is given to pedestrians as well as to traffic, then here the addition value $\bar{x}_{pg1}+\bar{x}_{g1}+\bar{x}_{y1}$ for the first direction input signals must be a logic value 3. The intervals 5 and 10 are intervals wherein none of the above signals are generated for the first direction or the second direction. Consequently, the logical sum of the sum of the input signals for both directions in one period, that is $(\bar{x}_{pg1}+\bar{x}_{g1}+\bar{x}_{y1})\vee(\bar{x}_{pg2}+\bar{x}_{g2}+\bar{x}_{y2})$, is continuously at a logic value 3 provided that the signal lights are operating normally. With the window comparator WC7, then as shown in FIG. 30, the upper limit threshold value $V_H$ is set to a higher logical level than logic value 3 while the lower limit threshold value $V_L$ is set between a logical level of logic value 3 and a logical level of logic value 2. In this way, when the sensors and the circuit are normal, then provided that a simultaneous illumination does not occur with any of the signal lights for the first direction and the second direction, then the output signal $Y_8$ from the window comparator WC7 is a logic value 1, while if a simultaneous illumination fault does occur between the first direction and the second direction, or if a fault occurs in a sensor or in the circuit of FIG. 28, then the output signal $Y_8$ becomes a logic value 0.

In FIG. 28 the number of first direction and second direction input signals is equal, and the addition value for the input signals for non illumination in the first direction and second direction under normal operation is a logic value 3.

Figure 31:
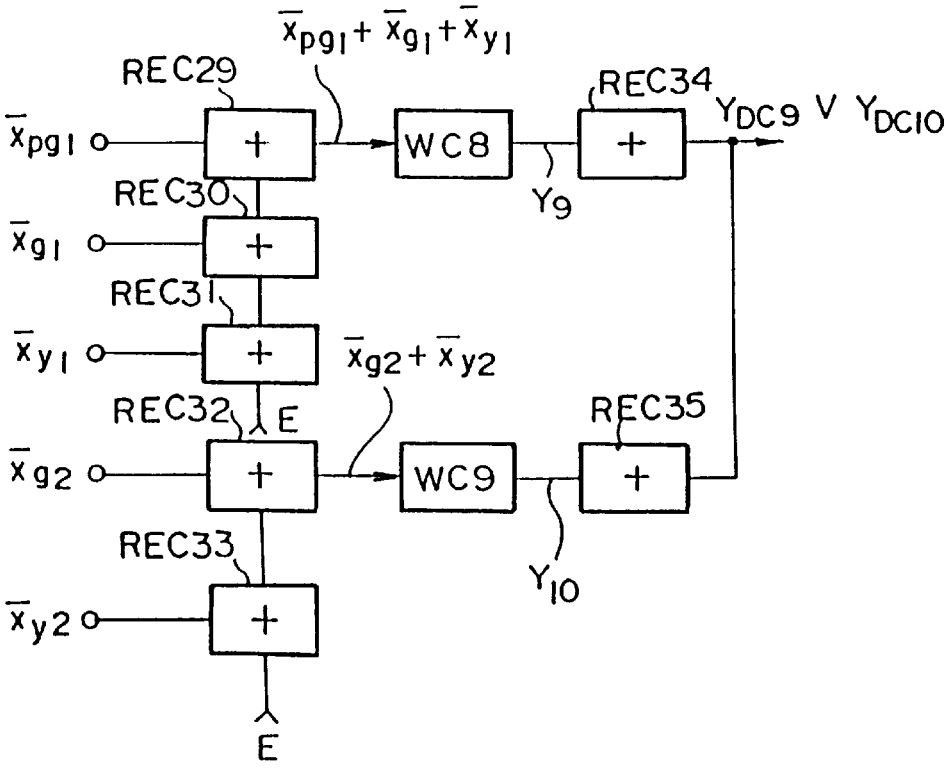
FIG. 31 is a circuit diagram of a sixth embodiment.

FIG. 31 shows an embodiment for the case where the second direction pedestrian signal light 2PG is not provided.

In this case, since the input signal $\overline{x}_{pg2}=1$ does not exist in FIG. 30, then the sum of the input signals for the second direction is $\overline{x}_{g2}+\overline{x}_{y2}$, so that the maximum value for the sum becomes a logic value 2. Consequently, since the maximum value for the sum of the input signals for the first direction and the second direction is three for the first direction and two for the second direction, then it is not possible to take the logical sum of both addition values as in FIG. 28, and carry out a threshold value operation with a common threshold value using a window comparator (a normal condition cannot be detected as a logic value 1). Therefore, with the circuit of FIG. 31, a method with the same construction as for FIG. 25 is used.

That is to say, the level detection for the addition values $\overline{x}_{pg1}+\overline{x}_{g1}+\overline{x}_{y1}$ for the input signals of the first direction is carried out with a window comparator WC8, and the level detection for the addition values $\overline{x}_{g2}+\overline{x}_{y2}$ for the input signals of the second direction is carried out with a window comparator WC9, and the logical sum output signal for the rectified output signals $Y_{DC9}$ and $Y_{DC10}$ for both window comparators WC8 and WC9 is made the detection signal for no simultaneous illumination of the signal lights. Here the window comparator WC8 has the same upper and lower limit threshold values as the window comparator WC7 of FIG. 28, while the window comparator WC9 has the same upper and lower limit threshold values as the window comparator WC5 of FIG. 25.

With the circuit configurations of FIG. 25, FIG. 26, FIG. 28, and FIG. 31, the plurality of travel permit signal lights (1PG, 1G, 1Y, and 2PG, 2G, 2Y) for the first direction and the second direction, are separated into two groups which are never illuminated simultaneously, and the logical sum operation output signal for the signals indicating non illumination for both groups is made a high level, that is to say when a high logical value is indicated, illumination conditions are normal. When at the time of non illumination conditions a signal indicating an illumination condition is erroneously generated, the logical sum operation output signal becomes a low level, that is to say, when a low logical value is indicated conditions are not normal.

Comparing the circuits of FIG. 22, FIG. 23, FIG. 25, FIG. 26, FIG. 28 and FIG. 31, then with regards to the first and second direction signal lights between which a simultaneous illumination must never occur for any of the signal lights, a logical sum operation is carried out on the signals indicating non illumination. When the result of the logical sum operation shows a maximum logical value, this is made a normal condition, while when another logical value lower than the maximum value appears, this is made an abnormal condition. With the circuits of FIG. 22 and FIG. 23, the signal lights being investigated are 1G, 2G and the maximum value of the logical sum is 1, with FIG. 25 and FIG. 26, the signal lights being investigated are 1G, 1Y and 2G, 2Y and the maximum value of the logical sum is 2, with FIG. 28, the signal lights being investigated are 1G, 1Y, 1PG and 2G, 2Y, 2PG and the maximum value is 3, while with FIG. 31, the signal lights being investigated are 1G, 1Y, 1PG and 2G, 2Y and the maximum value in the first direction is 3 and in the second direction is 2. Here the signal lights are illuminated for a direction to give traffic (including pedestrians) permission to proceed, and so that there is no conflict between the first direction and the second direction.

As a method for obtaining the addition results for the input signals in the abovementioned respective circuits, a current sensor may be used as in FIG. 7.

Figure 32:
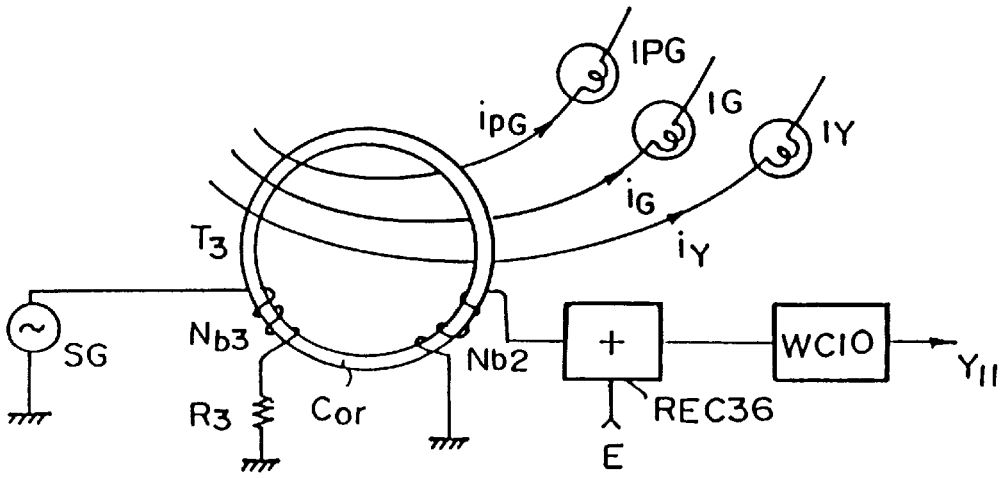
FIG. 32 is a circuit diagram of a current sensor having a logical product operation function for the non illumination of signal lights of the same group.

For example, FIG. 32 gives a sensor construction for obtaining an output signal $Y_9=1$ from the window comparator WC8 for a maximum value of 3 for the addition value $\overline{x}_{pg1}+\overline{x}_{g1}+\overline{x}_{y1}$ for the input signals for the first direction in FIG. 31.

In FIG. 32, a signal generator SG is one based on the construction of FIG. 4. When a current flows in any of the signal lights, the signal from the winding $N_{b3}$ is not transmitted to the winding $N_{b2}$ so that the output level from the voltage doubler rectifying circuit REC36 drops. In FIG. 32, the output signal from the winding $N_{b2}$ for when none of the signal lights 1PG, 1G or 1Y are illuminated (the signal for when $\overline{x}_{pg1}=1$, $\overline{x}_{g1}=1$ and $\overline{x}_{y1}=1$), is generated as a maximum value of the output signals from the winding $N_{b2}$. In the case where a current flows in one or more of the three signal light power supply lines, then the output signal $Y_{11}$ for the winding $N_{b2}$ always drops.

In particular, with a highly sensitive current sensor wherein the saturable magnetic core Cor is saturated even if a slight current flows in one of the three power supply lines, then it is always possible to directly detect the output signal at the time of non illumination without influence from the drop in the current due to age deterioration of the signal lights or due to variations in the signal light power source. In this case, the window comparator WC10 in FIG. 32, serves the role of a fail-safe window comparator for level detecting whether or not an output voltage is generated in the voltage doubler rectifying circuit REC36.

Figure 33:
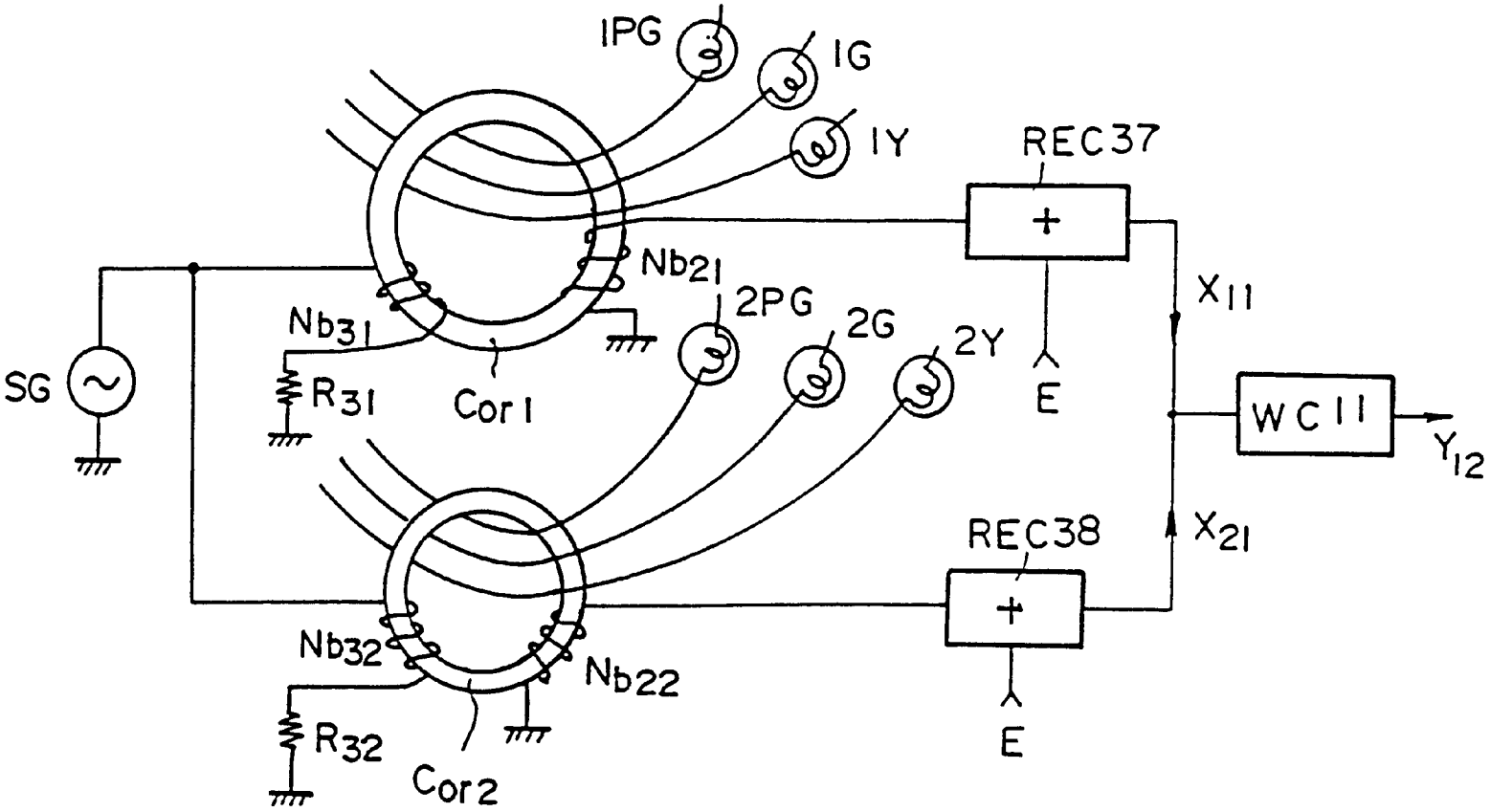
FIG. 33 is a circuit diagram of a seventh embodiment employing the current sensor of FIG. 32.

FIG. 33 shows a structural example of a simultaneous illumination detection 4 circuit for a first direction and second direction corresponding to FIG. 28, for the case with such highly sensitive current sensors.

The case of all non illumination signals for the signal lights 1PG, 1G, 1Y in FIG. 28 is generated as an output signal $X_{11}$ (voltage signal) from the voltage doubler rectifying circuit REC37, while the case of all non illumination signals for the signal lights 2PG, 2G, 2Y is generated as an output signal $X_{21}$ (voltage signal) from the voltage doubler rectifying circuit REC38. The window comparator WC11 generates $Y_{12}=1$ when an output signal is generated in at least one of the voltage doubler rectifying circuits REC37 and REC38, and generates $Y_{12}=0$ when an output signal is not generated in either.

Figure 34:
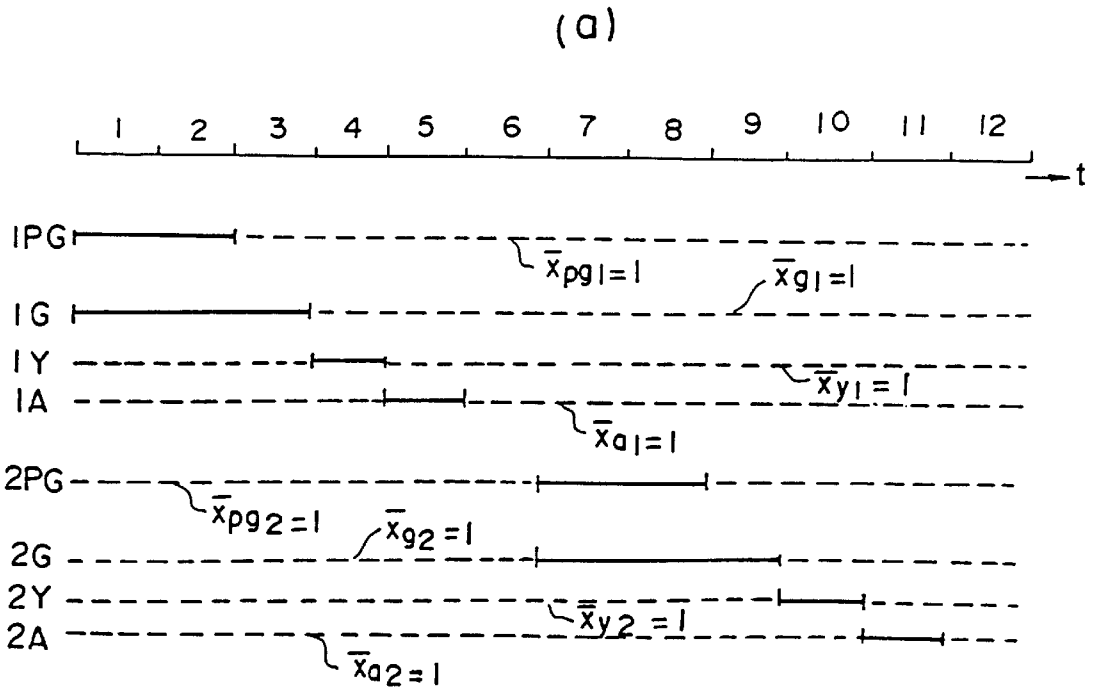
FIG. 34(*a*) is a relational diagram for the illumination of signal lights of a two way intersection, for the case where arrow lights are added, while FIG. 34(*b*) is a schematic diagram showing a signal unit arrangement at the intersection.
Figure 34:
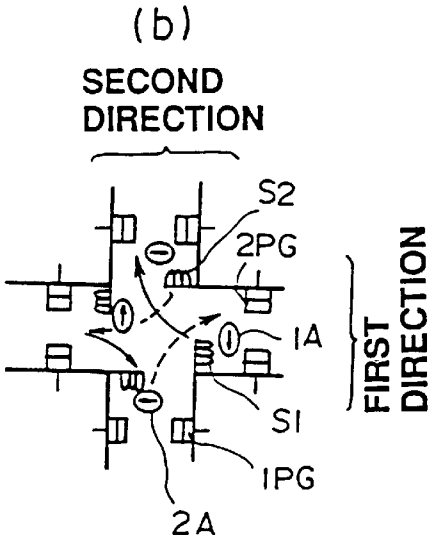

In the case where, as shown in FIG. 34(*b*), respective arrow lights 1A, 2A, are added to the first direction and second direction of FIG. 29(*b*), then for example with the circuit of FIG. 28, the construction may be such that the rectified outputs for a non illumination signal $\overline{x}_{a1}$ for the arrow light 1A, and a non illumination signal $\overline{x}_{a2}$ for the arrow light 2A respectively obtained from current sensors via voltage doubler rectifying circuits, are appended to the respective groups and added.

In this case, the logical sum of the rectified output signals for the first direction and the second direction becomes $(\overline{x}_{pg1}+\overline{x}_{g1}+\overline{x}_{y1}+\overline{x}_{a1})\vee(\overline{x}_{pg2}+\overline{x}_{g2}+\overline{x}_{y2}+\overline{x}_{a2})$. The setting of the threshold values for the window comparator WC7 may be such that an output signal of logic value 1 is generated when the logical sum output signal is an addition value of 4, and a logical value of 0 results when the addition value is 3 or less. FIG. 34(*a*) shows the illumination relationship for the signal lights in the case where the arrow lights 1A, 2A are added.

Figure 35:
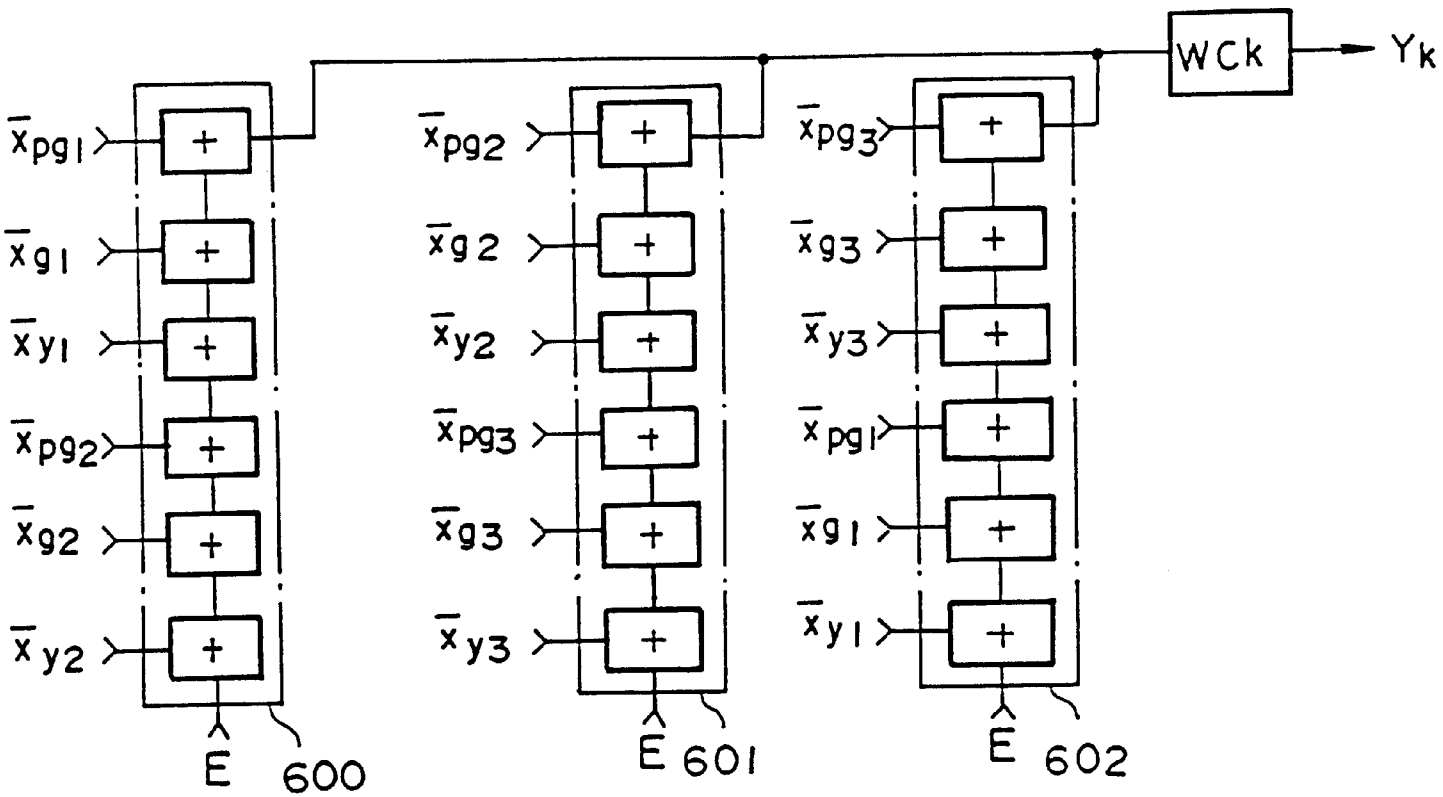
FIG. 35 is a circuit diagram of an embodiment of the invention according to claim 37.
Figure 36:
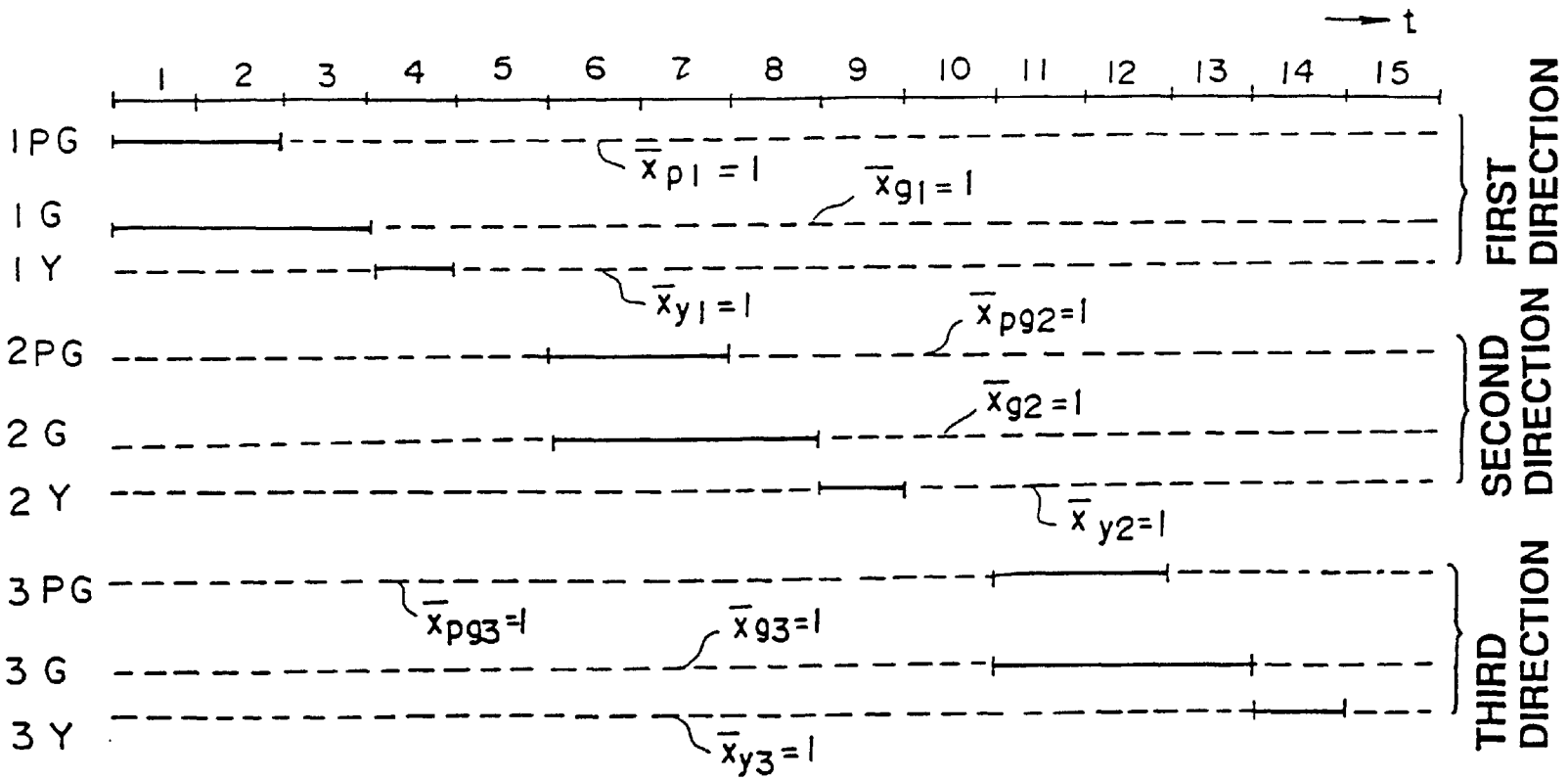
FIG. 36 is a relational diagram for the illumination of signal lights of a three way intersection applicable to the embodiment of FIG. 35.

FIG. 35 shows an embodiment of a simultaneous illumination detection circuit applicable to the case of a three way intersection (three roads intersecting with each other) with an illumination relationship as shown in FIG. 36.

In this case, the construction is such that a logical sum output for: an addition value for non illumination signals for a first direction and a second direction; an addition value for non illumination signals for the second direction and a third direction; and an addition value for non illumination signals for the third direction and the first direction, is level detected by a window comparator $WC_k$.

The settings for the threshold value of the window comparator $WC_k$ are such that the window comparator $WC_k$ oscillates and an output signal $Y_k=1$ is produced when the logical sum of the addition values for the respective non illumination signals, that is $(\overline{x}_{pg1}+\overline{x}_{g1}+\overline{x}_{y1}+\overline{x}_{pg2}+\overline{x}_{g2}+\overline{x}_{y2})\vee(\overline{x}_{pg2}+\overline{x}_{g2}+\overline{x}_{y2}+\overline{x}_{pg3}+\overline{x}_{g3}+\overline{x}_{y3})\vee(x_{pg3}+x_{g3}+x_{y3}+x_{pg1}+x_{g1}+x_{y1})$, is six, and does not oscillate so that the output signal becomes $Y_k=0$ when this is five or less.

In FIG. 35, numerals 600, 601 and 602 indicate respective fourteenth, fifteenth and sixteenth adding circuits.

Next is a description of an embodiment of a safety verifying type simultaneous illumination detection circuit which samples a non illumination condition of a signal light as being safe, using a current sensor.

Methods of monitoring the illumination condition of a signal light using a current sensor involve; the method as shown in FIGS. 1(*a*) and (*c*) where a voltage sensor is connected acros's the terminals of a light switch SW for a signal light L, and the method as shown in FIGS. 1(*b*) and (*d*) wherein a voltage sensor is connected across the terminals of a signal light L.

Figure 37:
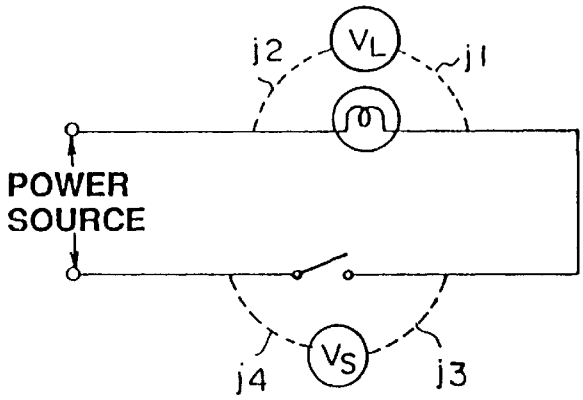
FIG. 37 is a diagram for explaining a method of fail-safe monitoring an illumination condition for the case where a voltage sensor is used.

With the method of FIGS. 1(*b*) and (*d*) for monitoring the voltage ($V_L$) across the terminals of the signal light, then in a worst case scenario as shown in FIG. 37 where a disconnection fault occurs in the lead $j_1$ or $j_2$, this gives a condition the same as for signal light non illumination (no terminal voltage), even if the signal light is in an illuminated condition (voltage produced across the signal light terminals).

On the other hand, with the method of FIGS. 1(*a*) and (*c*) for monitoring the voltage ($V_S$) across the terminals of the light switch SW, then in a worst case scenario as shown in FIG. 37 where a disconnection fault occurs in the lead $j_3$ or $j_4$, this gives a condition the same as for signal light illumination (the switch on condition) irrespective of whether or not the signal light is illuminated. Consequently, when the non illumination condition of the signal light is made the safe condition, and this condition is monitored using the voltage, then the method of FIGS. 1(*a*) and (*c*) is preferable.

Figure 38:
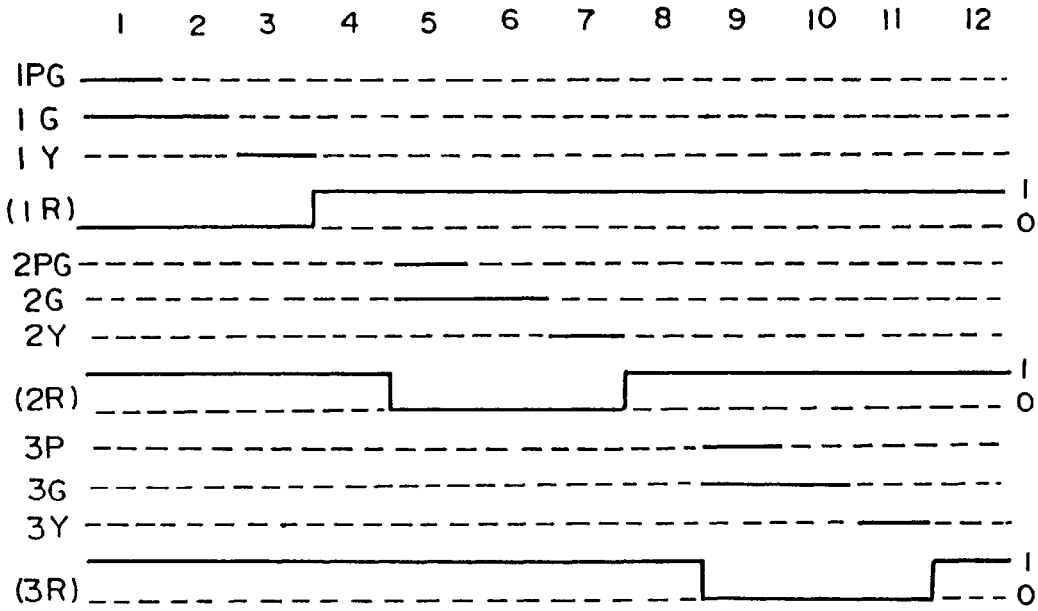
FIG. 38 is a relational diagram for the illumination of signal lights of a three way intersection applicable to an embodiment, for the case where a voltage sensor is used.
Figure 39:
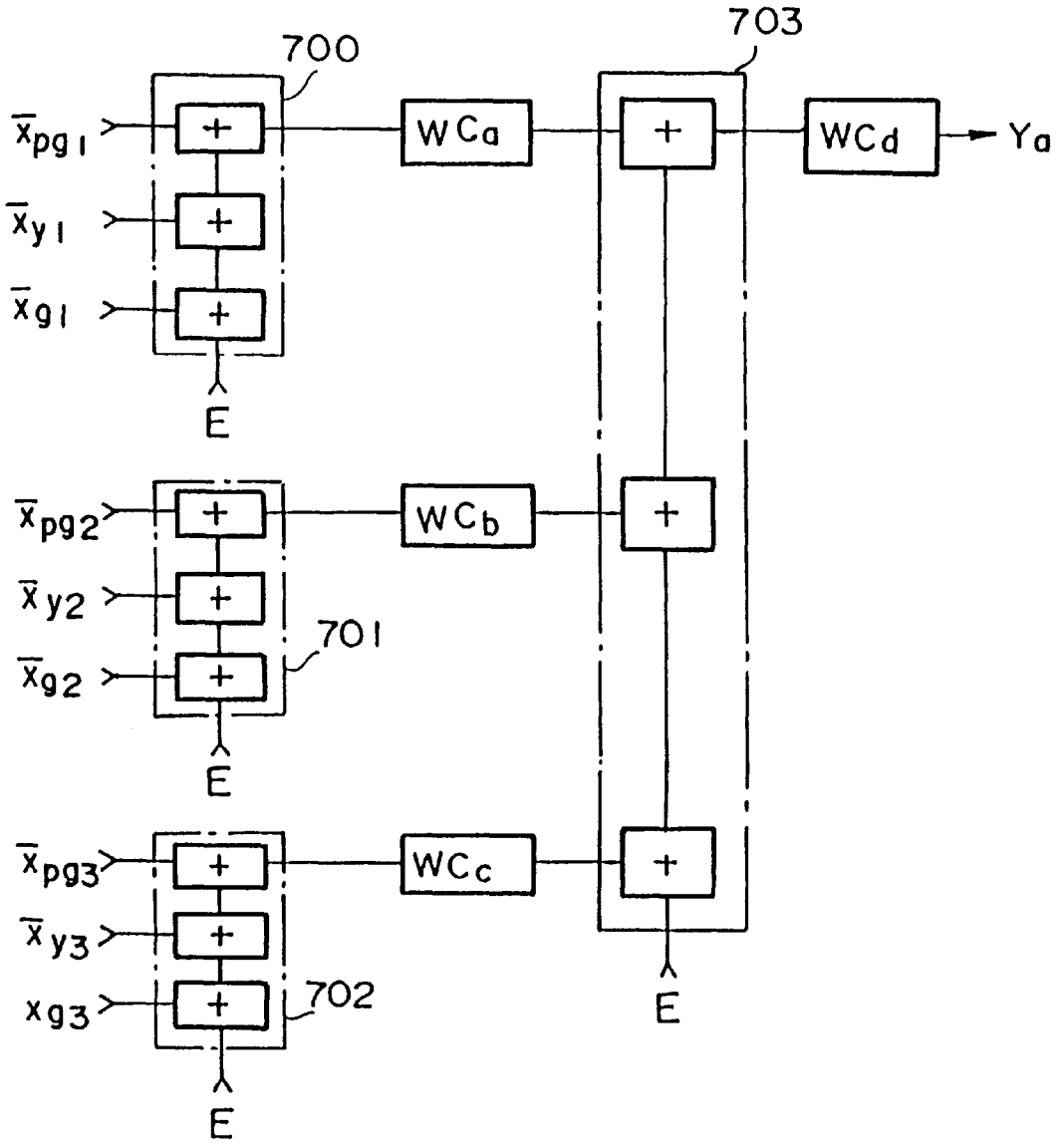
FIG. 39 is a circuit diagram of an embodiment employing a voltage sensor.

FIG. 39 shows an embodiment of a simultaneous illumination detection circuit according to the safety verification type, for signal lights at a three way intersection having an illumination relationship as shown in FIG. 38.

In FIG. 39 the non illumination signals $\overline{x}_{pg1}$, $\overline{x}_{g1}$, $\overline{x}_{y1}$, and $\overline{x}_{pg2}$, $\overline{x}_{g2}$, $\overline{x}_{y2}$, and $\overline{x}_{pg3}$, $\overline{x}_{g3}$, $\overline{x}_{y3}$ for the signal lights of the respective signal units are added by respective tenth, eleventh and twelfth adding circuits 700, 701 and 702 which use voltage doubler rectifying circuits respectively, and the addition values are then level detected with window comparators $WC_a$, $WC_b$ and $WC_c$ serving as respective seventh, eighth and ninth level detection circuits. The respective level detection results are then again added with a thirteenth adding circuit 703 constituted by voltage doubler rectifying circuits, and the resultant addition value then level detected with a window comparator $WC_d$ serving as a tenth level detection circuit, the construction being such that when the signal lights are illuminated and operating normally, the window comparator $WC_d$ gives a logical output of $Y_a=1$.

Next is a description of the principle of simultaneous illumination detection according to the present embodiment.

In order to effect fail-safe monitoring across the terminals of the switch SW, the conditions-must be sampled as an AC voltage signal. Here the presence of a voltage is sampled as an AC signal.

In FIG. 38 showing a step diagram for signal light illumination for three aspects of signal light illumination at a three way intersection, none of the signal lights 1PG, 1G, or 1Y illuminated is represented by 1R, none of the signal lights 2PG, 2G, or 2Y illuminated is represented by 2R, and none of the signal lights 3PG, 3G, or 3Y illuminated is represented by 3R. Since logically, 1R represents when none of the signal lights 1PG, 1G and 1Y is illuminated, then if non illumination of the respective signal lights 1PG, 1G, 1Y is represented by 1, and illumination is represented by 0, and the negation symbol is represented by "",then a binary logical output 1R, being 1 at the time of illumination and 0 at the time of non illumination, is represented by the following equation:

$$1R = \overline{1PG \vee 1G \vee 1Y} \tag{16}$$

where symbol $\vee$ represents a logical sum.

Similarly, double value logical outputs 2R and 3R are represented by the following equations:

$$2R = \overline{2PG \vee 2G \vee 2Y} \tag{17}$$

$$3R = \overline{3PG \vee 3G \vee 3Y} \tag{18}$$

For non occurrence of a simultaneous illumination in the signal lights for the three directions, then the following equation must be satisfied:

$$1R+2R+3R \geqq 2 \tag{19}$$

In sampling 1R, 2R and 3R using addition, then for example in sampling 1R, the voltage signals (AC) for the signal lights 1PG, 1G and 1Y may be added, making 1R=1 for when the sum is three or more and 1R=0 for when 2 or less. The same applies for 2R and 3R. Moreover, if the logical outputs of 1R, 2R and 3R (AC output signals) are added, and 2 or more is taken as no simultaneous illumination and 1 or less is taken as simultaneous illumination, then simultaneous illumination of the lights can be monitored in exactly the same way as for the case with current detection.

Figure 40:
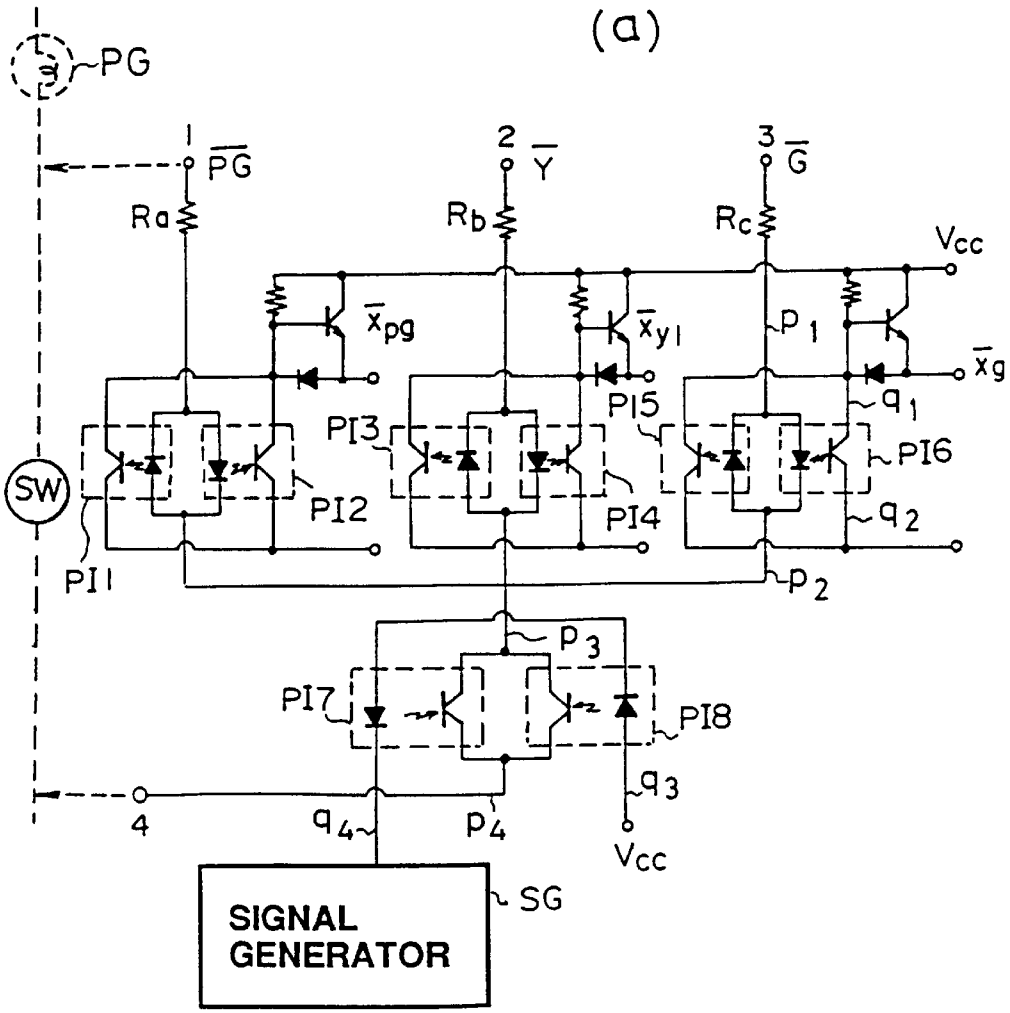
FIG. 40(*a*) is a circuit diagram showing a structure of a voltage sensor which uses photocouplers, while FIGS. 40(*b*) and (*c*) are circuit diagrams showing modified forms for FIG. 40(*a*)
Figure 40:
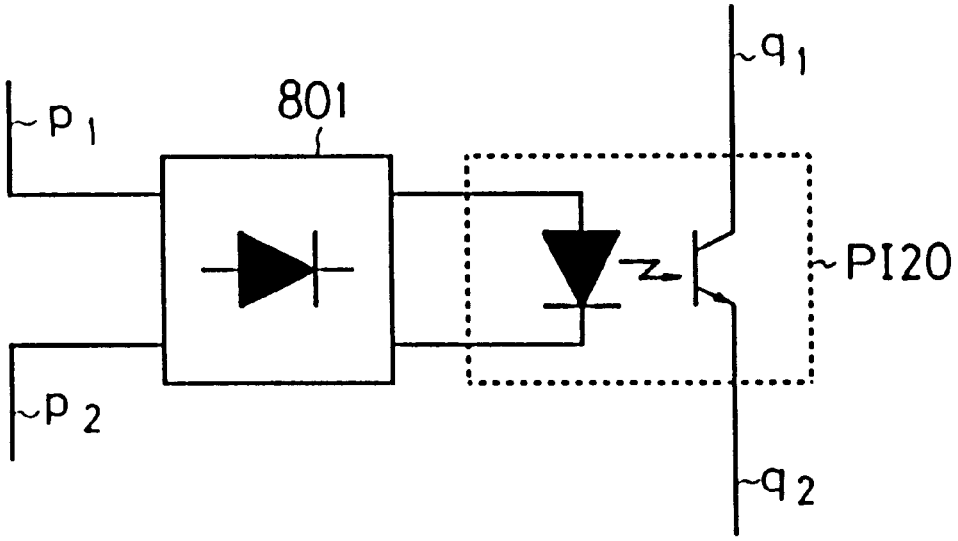
Figure 40:
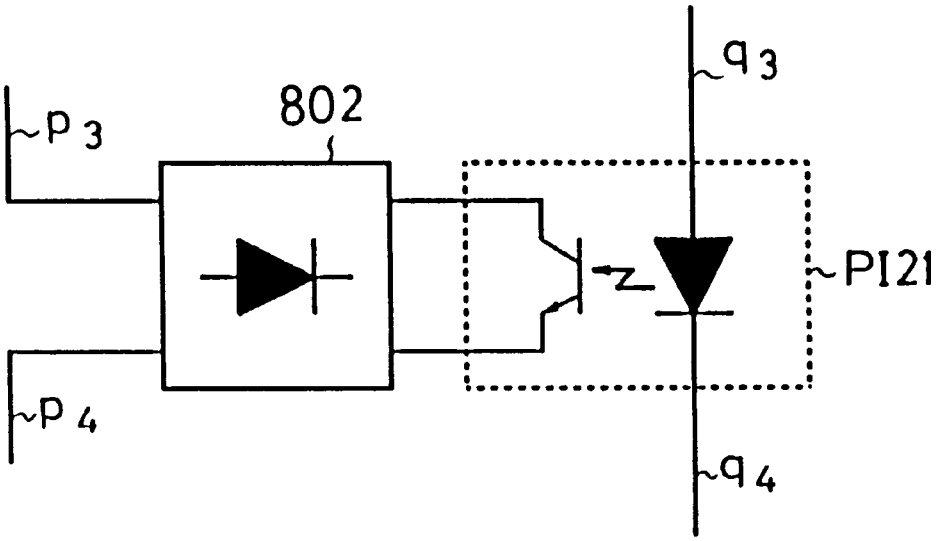

FIG. 40 shows a structural example for the case where the voltage signal $V_S$ across the terminals of the switch SW is sampled as an AC signal, using the voltage sensor of FIG. 1(*c*) which utilizes a photocoupler.

With FIG. 40, photocouplers Pl1, Pl2, and Pl7, Pl8 are connected across the terminals of a switch circuit SW (for example a bi-directional thryistor) for respective signal lights (represented in FIG. 40 by PG, the pedestrian proceed permit light) via terminals 1, 4 and a resistor Ra. Also in a similar manner with signal lights Y, photocouplers Pl3, Pl4 and Pl7, Pl8 are connected via terminals 2, 4, and a resistor Rb. Similarly with signal lights G, photocouplers Pl5, Pl6 and Pl7, Pl8 are connected via terminals 3, 4, and a resistor Rc. The terminal 4 is connected as a common line for the signal lights PG, Y and G, to the side of the switch circuit opposite the signal light side. The photocouplers Pl1 and Pl2, Pl3 and Pl4, Pl5 and Pl6 sample from photodiodes a current flowing in both directions, and correspond to second photocouplers. The photocouplers Pl7, Pl8 have supplied to their respective light emitting elements from a signal generator SG, a high frequency switch current higher than the frequency of the AC power source for the signal lights, and correspond to first photocouplers for switching an AC current from the AC power source for the signal lights, according to the high frequency signal. In this way, when there is a voltage at the terminals 1, 2 and 3, the current flowing in the resistors Ra, Rb and Rc is switched by the respective light receiving elements of the photocouplers Pl7, Pl8, and the respective light emitting elements of the photocouplers Pl1, Pl2, Pl3, Pl4, Pl5 and Pl6 pass this switch current. The current switched by the photocoupler Pl7 is passed by the respective light emitting elements of the photocouplers Pl2, Pl4 and Pl6, so that an AC output signal is generated in the respective light receiving elements corresponding to these. The current switched by the photocoupler Pl8 is passed through the respective light emitting elements of the photocouplers Pl1, Pl3 and Pl5, so that an AC output signal is produced in the respective light receiving elements corresponding to these. When there is no voltage at the terminals 1, 2 and 3 (when the switch is on) this current is not passed.

Consequently, when all the signal lights PG, Y and G are in a non illuminated condition, then an output of $\overline{x}_{pg}=\overline{x}_y=\overline{x}_g=1$ is generated from the respective voltage sensors. The lower limit threshold values of the window comparators WCa, WCb and WCc are set to a logical level between 2 and 3, so that when none of the signal lights PG, Y and G are illuminated and hence the addition value for the respective adding circuits which use voltage doubler rectifying circuits becomes 3, then the logical outputs from the window comparators WCa, WCb and WCc become 1. Moreover, the lower limit threshold value of the window comparator WCd is set to a logical level between 1 and 2, so that when the addition value of the logical outputs from the window comparators WCa, WCb and WCc is 2 or more, the logical output from the window comparator WCd becomes 1, and an output indicating normal (no simultaneous illumination) is generated.

Now instead of the construction for the second photocouplers as shown in FIG. 40(*a*) with two photocouplers connected in parallel in opposite directions to each other so as to match the direction of the AC current flowing via the resistors Ra, Rb and Rc, the construction may be as shown in FIG. 40(*b*) where the current flowing in the resistors Ra, Rb and Rc is rectified by a full wave rectifying circuit 801, and the light emitting element side of a photocoupler Pl20 is connected to the rectified output side. Similarly with the first photocoupler section also, instead of the construction for the first photocoupler with two photocouplers connected in parallel in opposite directions to each other, the construction may be as shown in FIG. 40(*c*) with rectification by a full wave rectifying circuit 802, and the light receiving element side of a photocoupler Pl21 connected to the rectified output side. The symbols $q_1$~$q_4$ and $p_1$~$p_4$ in FIGS. 40(*b*) and (*c*) correspond to the symbols $q_1$~$q_4$ and $p_1$~$p_4$ in FIG. 40(*a*). FIG. 40(*b*) shows only a voltage sensor portion for detecting the voltage across the terminals of the signal light G. However the construction can also be the same for the other signal lights PG and Y.

Figure 41:
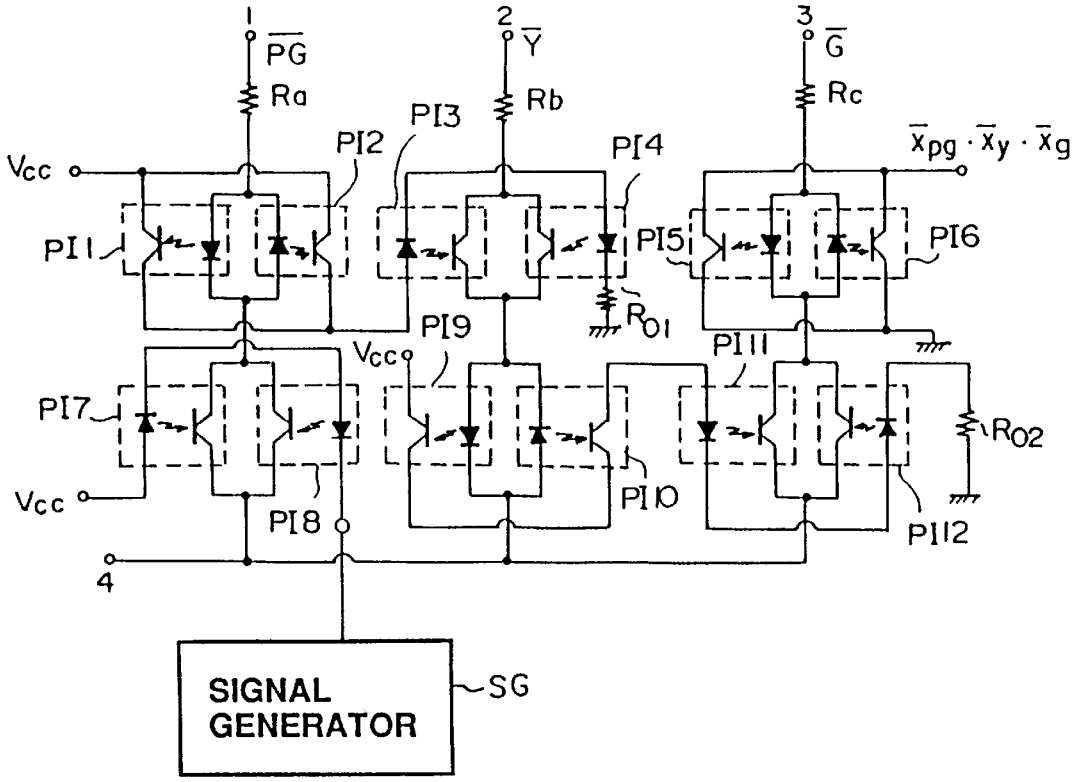
FIG. 41 is a circuit diagram showing a structural example of another voltage sensor which uses photocouplers.

FIG. 41 shows a circuit example for sampling without addition, the AC voltage signals for the signal lights G, PG and Y, as logical product signals of the voltage sensor outputs.

Photocouplers Pl7,;Pl8 corresponding to a first photocoupler, are switched by a switch output signal from a signal generator SG in the same way as in FIG. 40, switching the current flowing in a resistor Ra when there is a voltage at terminal 1. This switch current is detected by photocouplers Pl1, Pl2, corresponding to a second photocoupler. This switch current is then supplied to photocouplers Pl3, Pl4 which are cascade connected to the photocouplers Pl1, Pl2. Thus if a voltage is applied to terminal 2 (signal light Y switch off), then the switch signal is transmitted to photocouplers Pl9, Pl10 which are cascade connected to photocouplers Pl3 and Pl4. Moreover, if there is a voltage at terminal 3 (signal light G off), then due to the switch signal from the photocouplers Pl9 and Pl10, the photocouplers Pl11, Pl12 cascade connected to these are switched, after which a logical product output $\overline{x}_{pg}\bullet\overline{x}_y\bullet\overline{x}_g=1$ indicating no simultaneous illumination, is obtained from the cascade connected final stage photocouplers Pl5, Pl6. That is to say, when a voltage is generated at all the terminals 1, 2, 3, in other words, when all of the switch circuits for the signal lights PG, Y and G are off, then the logical product output becomes a high level AC signal. R01, R02 are current reducing resistors for the light emitting elements.

Consequently, in the case of this sensor construction, the prior stage voltage doubler rectifying circuits and the window comparators WCa~WCc in the circuit of FIG. 39 are not necessary, and the sensor output can be input directly to the respective voltage doubler rectifying circuits in the succeeding stage. Setting of the threshold values for the window comparator WCd is the same.

Here the method of monitoring the voltage $V_L$ across the terminals of the signal lights has an advantage over the method of monitoring the voltage $V_S$ across the terminals of the switch circuit, from the point that a current does not flow in the signal light when the switch circuit is off. However, in the case where the non illumination condition is made the safe condition in order to ensure an even greater level of fail-safety, then it is preferable to monitor the voltage Vs across the terminals of the switch circuit. Therefore, a resistor is inserted in series in the lead of the voltage sensor connected across the terminals of the switch circuit SW, and while this causes some inconvenience in that the illumination current when the switch circuit is off must be reduced, from the point of maintaining safety, this cannot be avoided. The resistors Ra, Rb and Rc in FIG. 40 and FIG. 41 are for this reduction.

Next is a discussion concerning difference between detecting voltage and detecting current across the switch circuit terminals.

Figure 42:
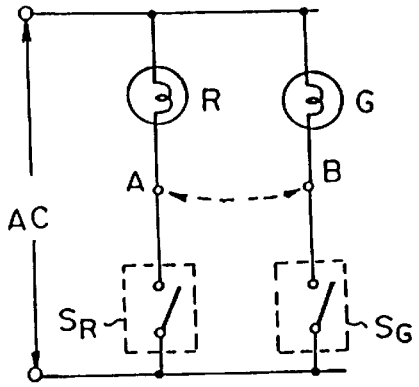
FIG. 42 is a diagram for explaining differences between a voltage sensor and a current sensor.

The method for current detection involves detecting whether or not a transducer is passing a current, and when not (non illumination of the signal light), a high level AC signal results. Therefore, in the case as shown by the dashed line in FIG. 42, where a short circuit fault occurs between the two signal light terminals due for example to a construction works error, then at the time of illumination, a signal indicating non illumination is produced. For example, in FIG. 42, in the case where a short circuit occurs between the signal light terminals A, B while the switch circuit $S_G$ is off, then with switching on the switch circuit $S_R$, the signal light G also comes on. With the method where the current across the terminals of the switch circuit is detected, if a current does not flow in the switch circuit $S_G$, this will be detected as a non illumination condition, irrespective of whether or not the signal light G is A illuminated.

On the other hand, with the method where the voltage across the terminals of the switch circuit is detected, then even with the abovementioned short circuit fault, illumination of the signal light G can still be indicated by the voltage becoming zero.

Next is a description of a control apparatus for traffic signal lights utilizing the simultaneous illumination detection circuits illustrated by the abovementioned respective embodiments.

Figure 43:
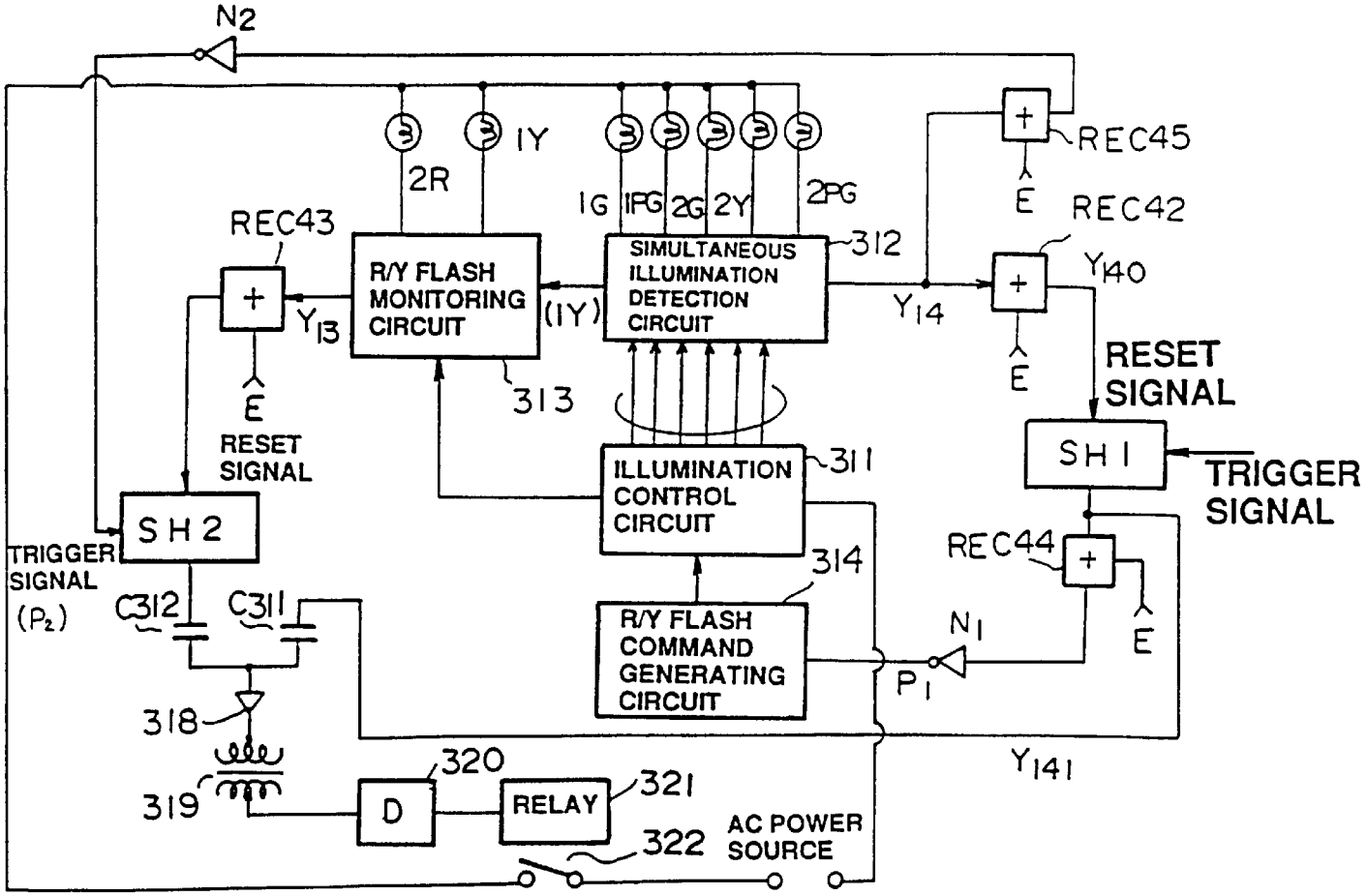
FIG. 43 is a circuit diagram showing an embodiment of a control apparatus for traffic signal lights, related to the invention according to claim 38.

FIG. 43 shows a structural diagram of an embodiment of a control apparatus for traffic signal lights, based on simultaneous illumination detection of proceed permit signal lights. This embodiment illustrates a control apparatus example for a case with pedestrian proceed permit signal lights 1PG, 2PG, for the respective directions at a two way intersection.

In FIG. 43, an illumination control circuit 311 is for illumination control of the intersection signal lights in a predetermined sequence. As well as controlling the signal lights 1G, 2G, 1Y, 2Y, 1PG, 2PG, and 2R in FIG. 43, it also controls the illumination of a signal light 1R (not shown in the figure). Here G indicates a green light, Y indicates a yellow light, and R indicates a red light.

A simultaneous illumination detection circuit 312 serving as a signal light monitoring circuit, is constructed for example as shown in FIG. 33, with the power supply lines for the first direction signal lights 1G, 1Y, 1PG and the second direction signal lights 2G, 2Y, 2PG, wound around respective saturable magnetic ring cores, or simply passed through the ring cores (passed through corresponds to one turn). An R/Y flash monitoring circuit 313 serving as a flash monitoring circuit, also, as shown in subsequent FIG. 44(*a*) or FIG. 45(*a*), incorporates a similar saturable magnetic ring core or cores, with the power supply lines for the signal lights 2R and 1Y wound around a single or separate saturable magnetic ring cores. The power supply line for the signal light 1Y is wound around the saturable magnetic ring core of the simultaneous illumination detection circuit 312, and at the same time is wound around the saturable magnetic ring core for the R/Y flash monitoring circuit 313.

Figure 44:
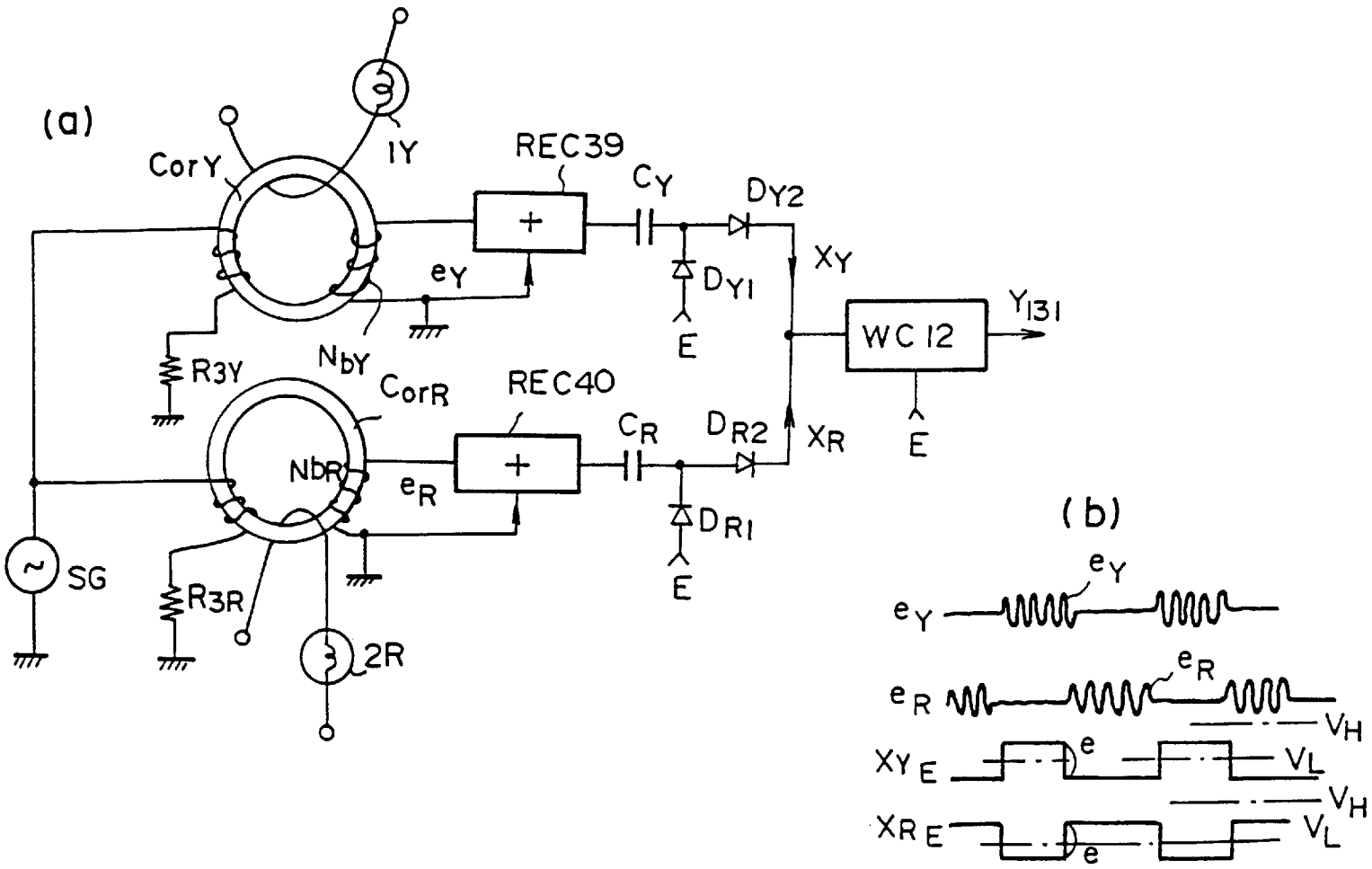
FIG. 44(*a*) is a circuit diagram of an embodiment of a R/Y flash monitoring circuit, while FIG. 44(*b*) is a time chart showing the appearance of output signals therefrom.

FIG. 44(*a*) shows an embodiment of an R/Y flash monitoring circuit constructed with the power supply lines for the signal lights 2R and 1Y wound around separate saturable magnetic ring cores.

In FIG. 44, $C_{orY}$ and $C_{orR}$ indicate the saturable magnetic ring cores. A power supply line for the signal light 1Y is wound around the saturable magnetic core $C_{or1}$ of the simultaneous illumination detection circuit 312 (FIG. 33), and then the portion between this and the signal light 1Y is wound around the core $C_{orY}$. A power supply line for the signal light 2R is wound around the core $C_{orR}$. Output signals $e_Y$ and $e_R$ as shown in FIG. 44(*b*), are respectively output from the output windings $N_{bY}$ and $N_{bR}$ of the saturable magnetic ring cores $C_{orY}$ and $C_{orR}$ when the alternately flashing signal lights 1Y and 2R are respectively not illuminated. These high frequency output signals are then rectified by respective voltage doubler rectifying circuits REC39, REC40, the rectified output signals then supplied via respective coupling capacitors $C_Y$, $C_R$ to clamp diodes $D_{Y1}$, $D_{R1}$ and thereby clamped at a power source potential E, and then input from diodes $D_{Y2}$, $D_{R2}$ via a wired OR connection to a window comparator WC12. The upper limited threshold value $V_H$ of the window comparator WC12 is set to a sufficiently high level. The lower limit threshold value $V_L$ is set so that when at least one of the signals $e_Y$ or $e_R$ is received as a high level, an output signal $Y_{131}$=1 is produced, while when both signals are received as low levels, an output signal $Y_{131}$=0 results. If the signal lights 1Y and 2R flash normally (flash alternately), then there is a continuous output signal of $Y_{131}$=1. In the case where one or other of the signal lights 1Y or 1R does not illuminate when it should illuminate or neither illuminate, then at least one of the rectified output signals of the output signals $e_Y$, $e_R$ become a DC output signal or zero. Hence the input signal to the window comparator WC12 becomes the potential E so that $Y_{131}$=0 is produced.

Figure 45:
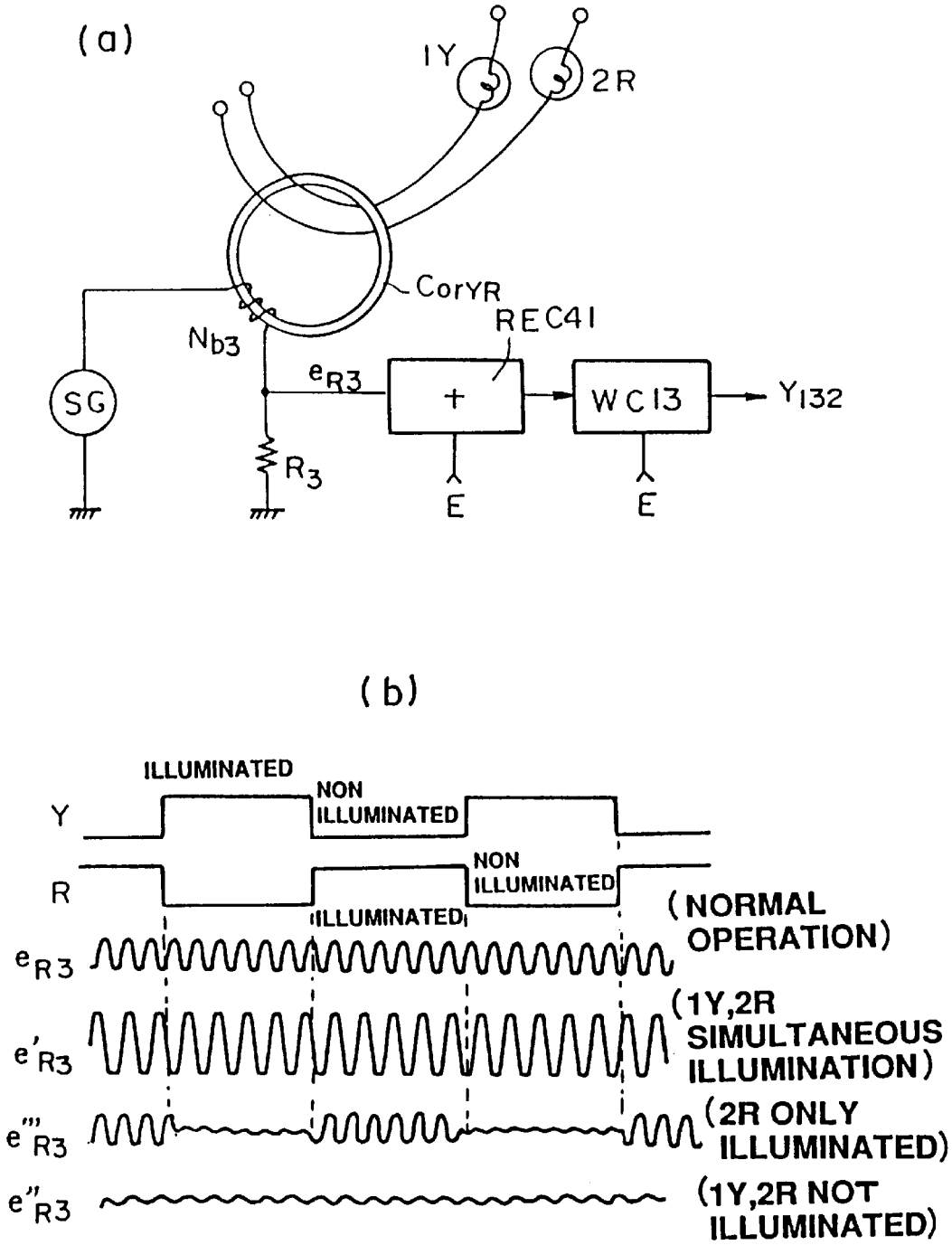
FIG. 45 is a circuit diagram of another embodiment of a R/Y flash monitoring circuit, while FIG. 45(*b*) is a time chart showing the appearance of output signals therefrom.

FIG. 45(*a*) shows an embodiment of an R/Y flash monitoring circuit constructed with the power supply lines for the signal lights 2R and 1Y wound around a single saturable magnetic ring core.

With the circuit of the embodiment in FIG. 45(*a*), when a current flows in the power supply lines for the signal lights 1Y and 2R wound around the saturable magnetic ring core $C_{orYR}$, a high level output signal $e_{R3}$ is produced. Consequently, as shown in FIG. 45(*b*), when the signal lights 1Y and 2R are illuminated alternately under normal operation, then a high level output signal $e_{R3}$ is continuously produced. However, in a worst case scenario where the signal lights 1Y and 2R are simultaneously illuminated, then as shown by $e'_{R3}$ in FIG. 45(*b*), a high level output signal higher than the output signal $e_{R3}$ for normal operation is produced, while in the case where neither of the two lights are illuminated, then as shown by $e''_{R3}$ in FIG. 45(*b*), this results in a lower level than the output signal $e_{R3}$. Moreover, if only one of the signal lights 1Y and 2R flashes, then as shown by $e'''_{R3}$, a low level condition is periodically produced. Consequently, if the upper limit threshold value $V_H$ for the 44. window comparator WC13 is set lower than the output level of the voltage doubler rectifying circuit REC41 for when the signal lights 1Y and 2R are simultaneously illuminated, and the lower limit threshold value $V_L$ is set between the output level of the voltage doubler rectifying circuit REC41 for normal operating conditions and the output level of the voltage doubler rectifying circuit REC41 for when neither of the signal lights 1Y and 2R are illuminated, then only when the signal lights 1Y and 2R are operating normally will the output signal $Y_{132}$ from the window comparator WC13 become a logic value 1.

In FIG. 43, $SH_1$ and $SH_2$ indicate the beforementioned window comparator type fail-safe first and second self-hold circuits (refer to FIG. 10). With the self-hold circuit $SH_1$, the power source switch on signal for the illumination control circuit 311 is made a trigger input signal.

$N_1$ and $N_2$ indicate NOT circuits. A structural example of these circuits is given in FIG. 46.

Figure 46:
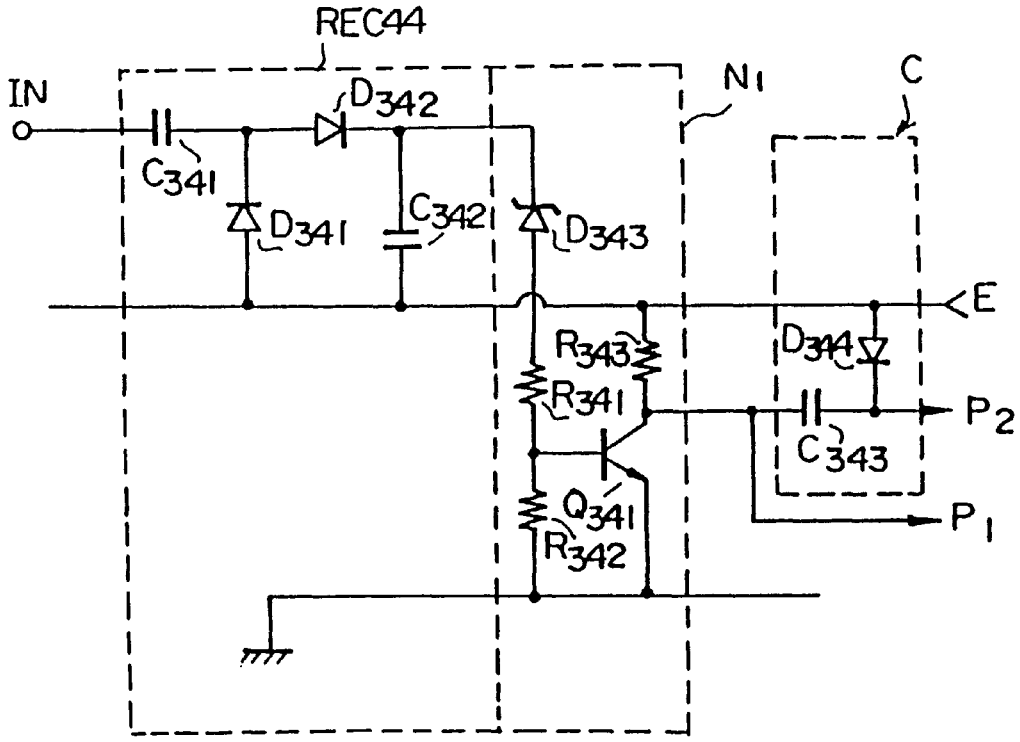
FIG. 46 is a circuit diagram of a NOT circuit.

In FIG. 46, in the case of the NOT circuit $N_1$, an input signal IN corresponds to an AC output signal $Y_{141}$ from the self-hold circuit $SH_1$, while in the case of the NOT circuit $N_2$, this corresponds to an AC output signal $Y_{14}$ from the simultaneous illumination detection circuit 312. A voltage doubler rectifying circuit comprising capacitors $C_{341}$, $C_{342}$ and diodes $D_{341}$, $D_{342}$, corresponds to voltage doubler rectifying circuits $REC_{44}$ and $REC_{45}$ in FIG. 43. $D_{343}$ indicates a level conversion zener diode having a zener potential slightly greater than the power source potential E, for driving a transistor $Q_{341}$ which goes off at a potential lower than the power source potential E. $R_{341}$, $R_{342}$ and $R_{343}$ indicate resistors.

With the operation of the NOT circuit, when the AC input signal IN is input, a rectified output signal is input to the base of the transistor $Q_{341}$ via the zener diode $D_{343}$ and the resistor $R_{341}$ so that the transistor $Q_{341}$ comes on. When the input signal IN is not applied, the transistor $Q_{341}$ goes off so that the collector output voltage $P_1$ of the transistor $Q_{341}$ becomes a high level. This signal $P_1$ is input to an R/Y flash command generating circuit 314 of FIG. 43, being a standard circuit comprising for example a CMOS.

In FIG. 43, the output signal from the NOT circuit N2 becomes the input signal to the window comparator type self-hold circuit SH2. Consequently, this input signal must be of a higher potential than the power source potential E. Therefore, the NOT circuit $N_2$ is constructed with a capacitor $C_{343}$ and a clamp diode $D_{344}$ outlined by the dashed line C in FIG. 46 added to the constituent components of the NOT circuit $N_1$. Hence, with the transmission of a rising signal for the signal P1, the output signal from the transistor $Q_{341}$ is generated as an output signal P2 of a higher level than the power source potential E.

Next is a description of the operation of the control apparatus of FIG. 43.

The signal lights 1G, 2G, 1Y, 2Y, 1PG, and 2PG which are switched by the illumination control circuit 311, have their illumination condition monitored by the simultaneous illumination detection circuit 312. If these signal lights are operating normally, then the output signal $Y_{14}$ is always a logic value 1. When the power source is switched on, since the respective signal lights are not illuminated and there is thus no simultaneous illumination, then the output signal $Y_{14}=1$ is input to the reset input terminal of the self-hold circuit SH1, and due to the input of the trigger signal with the power source being switched on, the self-hold circuit SH1 generates an output signal $Y_{141}$ of logic value 1. This AC output signal $Y_{141}$ is transmitted to an amplifier 318 via a capacitor $C_{311}$ so that a relay 321 is excited via a transformer 319 and a rectifying circuit 320, and contact points 322 thereof close, thus connecting the AC power source to the respective signal lights.

Figure 47:
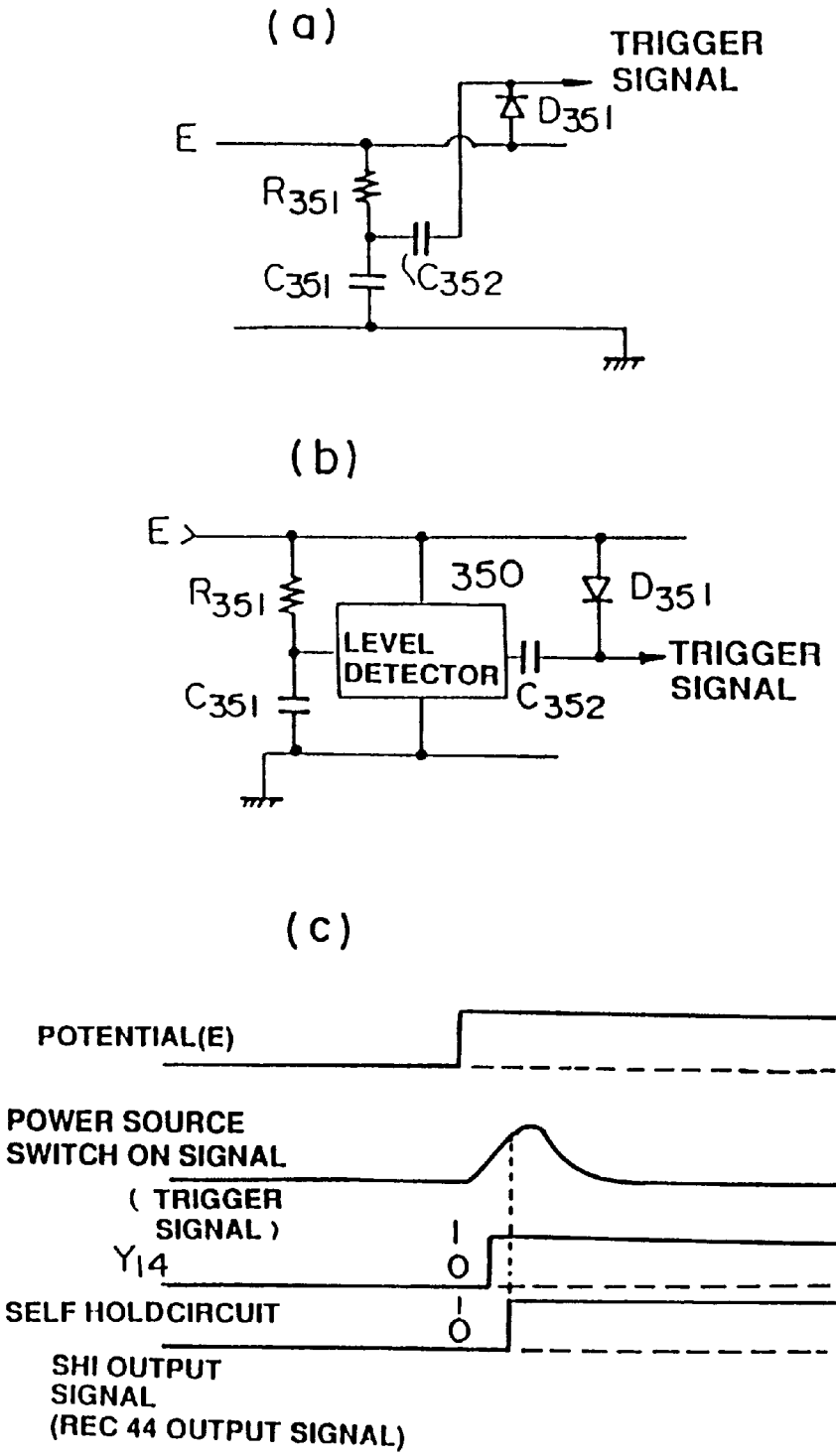
FIG. 47(*a*) is a circuit diagram of an embodiment of a trigger input signal generating circuit, FIG. 47(*b*) is a circuit diagram of another embodiment of a trigger input signal generating circuit, while FIG. 47(*c*) is a time chart showing output timing from a self-hold circuit.

FIG. 47(*a*) shows an example of a trigger input signal generating circuit for inputting a trigger signal to the self-hold circuit SH1 when the power source is switched on. When the power source is switched on, the potential is stored in a capacitor $C_{351}$ via a resistor $R_{351}$ and rises. This rising signal is clamped at the potential E with the capacitor $C_{352}$ as a coupling capacitor and the diode $D_{351}$ as a clamp diode, and then output. This trigger input signal generating circuit may also be constructed as shown in FIG. 47(*b*) with a level detection circuit 350 provided between an integrating circuit of the resistor $R_{351}$ and the capacitor $C_{351}$, and the coupling capacitor $C_{352}$.

FIG. 47(*c*) shows the operation of the self-hold circuit SH1 after switching on the power source potential E. After the power source potential E rises, an output signal $Y_{14}=1$ is generated from the simultaneous illumination detection circuit 312 indicating a normal condition. Moreover, when a trigger input signal is generated, the self-hold circuit SH1 generates an AC output signal $Y_{141}=1$ and self holds. Furthermore, at this time, an output signal P1=0 is input to the R/Y flash command generating circuit 314 via the negation circuit N1 so that a flash command is not generated from the R/Y flash command generating circuit 314. In FIG. 47(*c*), the output signal from the self-hold circuit SH1 is shown as the output signal from the voltage doubler rectifying circuit REC44.

If in a worst case scenario, a simultaneous illumination occurs between the signal lights 1G, 1Y, 1PG and the signal lights 2G, 2Y, 2PG, then since this gives $Y_{14}=0$, the self-hold circuit SH1 is reset and an AC signal is not input to the capacitor $C_{311}$. At the same time an output signal $P_1=1$ is input to the R/Y flash command generating circuit 314 via the NOT circuit N1, and a flash command for the signal lights 1Y and 2R is output from the R/Y flash command generating circuit 314 to the illumination control circuit 311. Also at the same time, the falling signal $Y_{14}=0$ from the simultaneous illumination detection circuit 312 is input to the NOT circuit N2 via the voltage doubler rectifying circuit REC45, and a trigger signal $P_2=1$ is input to the self-hold circuit $SH_2$. If the signal lights 1Y and 2R are operating normally so as to illuminate alternately, then an AC signal of $Y_{13}=1$ is generated from the R/Y flash monitoring circuit 313 and input to the self-hold circuit SH2 via the voltage doubler rectifying circuit REC43 as a reset signal. Therefore, an AC output signal is supplied from the self-hold circuit $SH_2$ to the amplifier 318 via the capacitor C312, and the excitation of the relay 321 is thus maintained. That is to say, even if for example a simultaneous illumination occurs between the signal lights 1G, 1Y, 1PG and 2G, 2Y, 2PG, if there is a switching of the flash signal for the signal lights 1Y–2R produced by the illumination control circuit 311, then the excitation condition for the relay 321 is maintained. However, if in a worst case scenario the flashing of the signal lights 1Y–2R does not operate normally, then a signal of $Y_{13}=0$ is input from the R/Y flash monitoring circuit 313 to the reset input terminal of the self-hold circuit $SH_2$, then the relay 321 becomes non excited so that the contact points 322 open and the supply from the AC power source is interrupted.

In FIG. 43, if the R/Y flash command generating circuit 314 has a latching function (storage function) so that the falling component of the output signal $Y_{14}$ from the simultaneous illumination detection circuit 312 can be stored, then the output signal $Y_{14}$ from the simultaneous illumination detection circuit 312 can be input directly to the voltage doubler rectifying circuit REC44, and the voltage doubler rectifying circuit REC42 and the self-hold circuit SH1 omitted. In this case, the circuits of FIGS. 47(*a*) and (*b*) for generating a trigger input signal at the time of switching on the power also become unnecessary. Moreover, if when a simultaneous illumination occurs, the power source is directly cut off, then the R/Y flash command generating circuit 314, the self-hold circuit $SH_2$, the NOT circuits $N_1$, $N_2$, the voltage doubler rectifying circuits REC44, REC45, REC43, and the capacitor $C_{312}$ become unnecessary.

Next is a discussion concerning a signal light burn-out detection apparatus. With the signal lights, one of each light is provided for each signal light power supply line.

With an intersection having the illumination relationship of FIG. 18(*a*), then under normal operation the number of illuminated signal lights is always 2, and the number not illuminated is always 4. Consequently, if the illumination condition of the signal lights 1G, 1Y, 1R, 2G, 2Y, 2R is detected as $x_{g1}$, $x_{y1}$, $x_{r1}$, $x_{g2}$, $x_{y2}$, $x_{r2}$, in a similar manner to the output signal $x_{g1}$ from the current sensor of FIG. 16, and the non illumination condition is detected as $\bar{x}_{g1}$, $\bar{x}_{y1}$, $\bar{x}_{r1}$, $\bar{x}_{g2}$, $\bar{x}_{y2}$, $\bar{x}_{r2}$, in a similar manner to the output signal $\bar{x}_{g1}$ from the current sensor of FIG. 16, then for a normal illumination number m and non illumination number $\bar{m}$, these can be added as follows using the adding circuit of FIG. 6.

$$m=x_{g1}+x_{y1+xr1}+x_{g2}+x_{y2}+x_{r2}=2 \tag{20}$$

$$\bar{m}=\bar{x}_{g1}+\bar{x}_{y1}+\bar{x}_{r1}+\bar{x}_{g2}+\bar{x}_{y2}+\bar{x}_{r2}=4 \tag{21}$$

If as shown in FIG. 11, a fail-safe window comparator is used and the normal condition, that is to say when m=2 and $\bar{m}=4$, is made a logic value 1, and the abnormal condition, that is to say when $m \neq 2$ and $\overline{m} \neq 4$, is made a logic value 0, then the illumination condition of the signal lights can be continuously monitored. More specifically, if the voltages (logic value levels) indicating the logic values of the signals $x_{g1}$, $\overline{x}_{g1}$, $x_{y1}$, $\overline{x}_{y1}$, $x_{g2}$, $\overline{x}_{g2}$, $x_{y2}$, $\overline{x}_{y2}$, $x_{r1}$, $\overline{x}_{r1}$, $x_{r2}$, $\overline{x}_{r2}$ have the same size e, then with a circuit for judging the normal condition from the number of illuminations, the window comparator after the adding circuit can have an upper limit threshold value $V_H$ set between addition output signals 2*e* and 3*e*, and a lower limit threshold value $V_L$ set between addition output signals 2*e* and e. Moreover, with a circuit for judging the normal condition from the number of non illuminations, an upper limit threshold value $V_H$ can be set between addition output signals 4*e* and 5*e*, and a lower limit threshold value $V_L$ can be set between addition output signals 4*e* and 3*e*. If the output signal from the window comparator for the former case is $Y_{15}$ and the output signal from the window comparator for the latter case is $Y_{16}$, and the levels of the addition output signals are respectively me and $\overline{me}$, then the logic values of the respective output signals are given by the following equations.

$$Y_{15} = 1, \quad V_L \leq me \leq V_H \qquad (22)$$
$$0, \quad V_L > me \text{ or } V_H < me$$

$$Y_{16} = 1, \quad V_L \leq \overline{me} \leq V_H \qquad (23)$$
$$0 \quad V_L > \overline{me} \text{ or } V_H < \overline{me}$$

Figure 48:
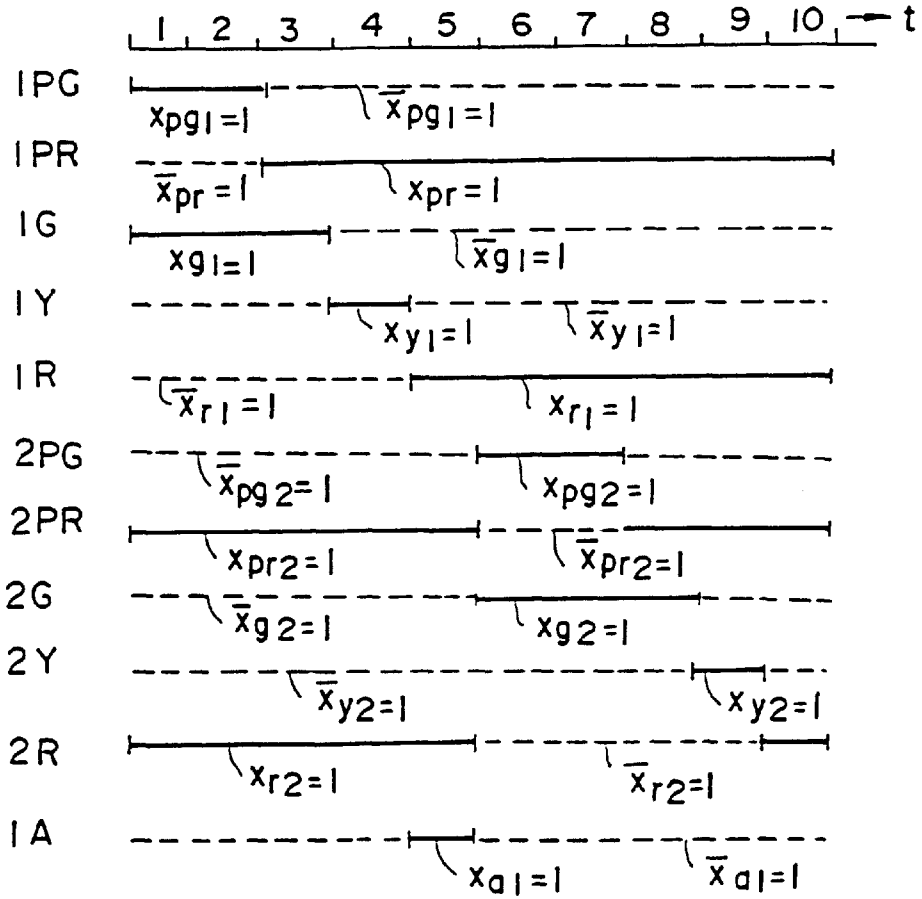
FIG. 48 is a relational diagram for illumination at an intersection provided with arrow lights 2.

FIG. 48 illustrates a case where pedestrian signal lights 1PG, 1PR, 2PG and 2PR are added to the case illustrated in FIG. 18(*a*). 1A is for an arrow light, which will be discussed later.

In this case, when operating normally, there are always 4 illuminated signal lights (that is, m=4), and 6 non illuminated signal lights (that is, $\overline{m}$=6). Consequently, if the number of illuminated and non illuminated signal lights is calculated, then it is possible to continuously monitor the illumination condition, and generate an output of logic value 1 if the value for m or $\overline{m}$ is a normal value, and generate an output of logic value 0 if the value of m or $\overline{m}$ differs from the normal value, for example in the case where a signal light is not illuminated during an illumination time, or an erroneous simultaneous illumination occurs.

Next is a discussion of the characteristics of signal light monitoring based on equations 22 and 23.

With the method where the number of illuminations are added to thereby monitor the illumination condition of the signal lights, if a simultaneous illumination occurs in the signal lights, the addition level me increases, while if a burn-out fault occurs in the signal lights, the addition level me decreases. Consequently, in either case the output signal from the window comparators becomes a zero voltage signal (logic value 0). However, in a case where 2 lights are simultaneously illuminated so that me=3*e* results and at the same time a fault occurs in the sensor which is producing the addition signal of 3*e*, then me=2*e* results, and an output signal Y15=1 showing normal is produced in the window comparator.

On the other hand, in the case where a burn-out fault occurs in the signal light, the addition level me decreases, and this also decreases in the case where a fault occurs in the sensor or the adding circuit. Consequently, with the method wherein the number of illuminations is added, when a double fault occurs such as a simultaneous illumination error occurring in the signal lights and a fault occurring in the sensor or the adding circuit, this error cannot always be notified. However, a burn-out fault can always be notified.

With the method where the number of non illuminations are added, if a simultaneous illumination occurs in the signal lights, the addition level me decreases, while if a burn-out fault-occurs in the signal lights, the addition level me increases. Therefore, for the same reason as for the above method where the number of illuminations are added, with the method where the number of non illuminations are added, when a double fault occurs such as a burn-out fault occurring in the signal light and a fault occurring, in the sensor or the adding circuit, then the burn-out fault cannot always be notified. However if a simultaneous illumination occurs, this can always be notified.

In FIG. 28 and FIG. 31, the reason for using the non illumination signal in the simultaneous illumination detection is based on the above general way of thinking.

Next is a description for the case with an arrow light 1A.

The arrow light 1A in FIG. 48 is for giving permission to travel in a specific travel direction. In FIG. 48 this signal light is shown as being illuminated at interval 5 (shown by the full line). In this case, if the illumination detection signal $x_{a1}$=1 and the non illumination detection signal $x_{a1}$=1 are added by the same method as for the R/Y flash monitoring circuit shown in FIG. 44, and a threshold value operation is carried out with the addition result added to equation 22 or equation 23, then detection of an abnormality in the signal light for the case where the arrow light 1A is provided can be carried out.

Figure 49:
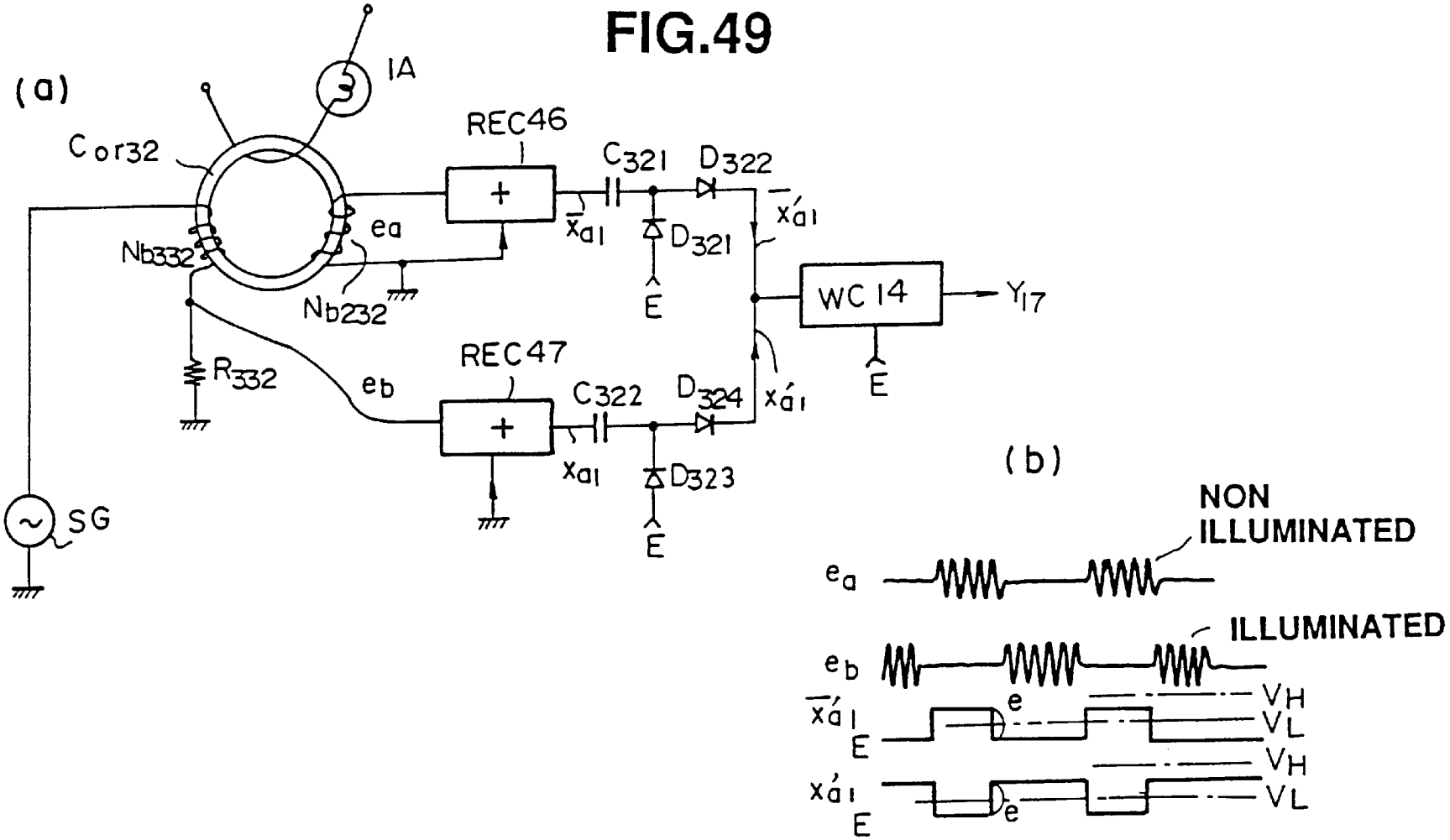
FIG. 49(*a*) is a diagram of a circuit for detecting an illumination condition of arrow lights using a current sensor; while FIG. 49(*b*) is a time chart showing the appearance of output signals therefrom.

In FIG. 49, signals for illumination and non illumination of the arrow light 1A are output as respective output signals $x_{a1}$ and $\overline{x}_{a1}$ from the voltage doubler rectifying circuits REC46 and REC47 which are respectively clamped at zero potential, and changes in these rectified output signals are respectively clamped at the power source potential E and made the input signals $x_{a1}'$ and $\overline{x}_{a1}'$ for a window comparator WC14. An output signal $Y_{17}$ from the window comparator $WC_{14}$ is always $Y_{17}$=1 while the arrow light 1A is switching between illumination and non illumination. However, in, the case wherein the arrow light 1A remains illuminated, the output signal from the voltage doubler rectifying circuit REC47 continues to be generated giving a DC output signal, while the output signal from the voltage doubler rectifying circuit REC46 becomes zero. Moreover, in the case where a burn-out fault occurs in the arrow light 1A, the output signal from the voltage doubler rectifying circuit REC46 becomes a DC output signal, while the output signal from the voltage doubler rectifying circuit REC47 becomes zero. Consequently, in either case, the output signal $Y_{17}$ from the window comparator $WC_{14}$, becomes $Y_{17}$=0 (the condition for no AC output signal).

If in FIG. 48, the output signal $Y_{17}$ is added to the addition value m or $\overline{m}$, so that the normal illumination condition becomes m=4+1=5 and the non illumination condition becomes $\overline{m}$=6+1=7, and a threshold value operation (a window operation) is carried out with the circuit of FIG. 11, then signal light monitoring including the illumination condition for the arrow light 1A can be carried out.

If the number of illuminations and non illuminations of the plurality of signal lights is respectively detected and added in this manner, then it is possible to continuously advise if the illumination condition is normal. However, with this method, in a worst case scenario where a simultaneous illumination or a burn-out fault occurs in the signal lights, then a signal indicating this abnormality only appears for a certain period within one cycle for the signal lights, and this cycle is repeated.

Next is a description of an embodiment of a circuit made so as to be able to continuously generate this periodically generated abnormal detection signal.

Figure 50:
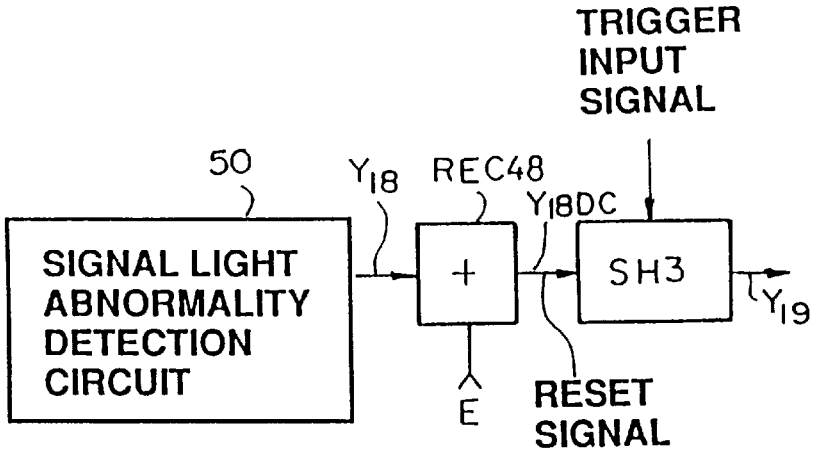
FIG. 50 is a diagram of a circuit for continuously outputting an output from a signal light abnormality detection circuit, using a self-hold circuit.

FIG. 50 shows an embodiment for a case where the beforementioned fail-safe self-hold circuit is used.

In FIG. 50, numeral 50 indicates a signal light abnormality detection circuit based on the abovementioned addition, with an output signal Y18 being the output signal from a window comparator which carries out the threshold value operation.

When the illumination condition of the signal lights is normal, an AC output signal Y18=1 is produced while when not normal, this AC output signal is not generated, and Y18=0. A voltage doubler rectifying circuit REC48 rectifies this output signal which then becomes the reset signal for a window comparator type self-hold circuit $SH_3$.

The trigger signal for the self-hold circuit $SH_3$ is produced by the circuit of FIG. 47(*a*) or (*b*).

Next is a description of the operation.

When the power is switched on, if the illumination of the signal lights is normal, then $Y_{18}$=1 is generated from the signal light abnormality detection circuit 50 as a reset signal, so that the self-hold circuit $SH_3$ generates a self-hold output signal $Y_{19}$=1 due to the trigger signal accompanying switching on of the power. Then after this, if in a worst case scenario an abnormality occurs in the illumination of the signal lights, then $Y_{18}$=0 is produced so that the self-hold circuit $SH_3$ is reset giving $Y_{19}$=0, after which the self-hold circuit $SH_3$ will not generate $Y_{19}$=1 unless the illumination conditions return to normal and the power source is again switched on.

Figure 51:
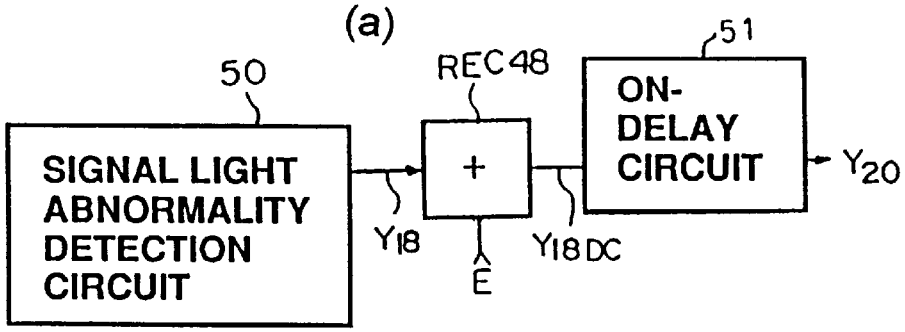
FIG. 51(*a*) is a diagram of a circuit for continuously outputting an output from a signal light abnormality detection circuit, using an on-delay circuit; while FIG. 51(*b*) is a time chart for the output therefrom.
Figure 51:
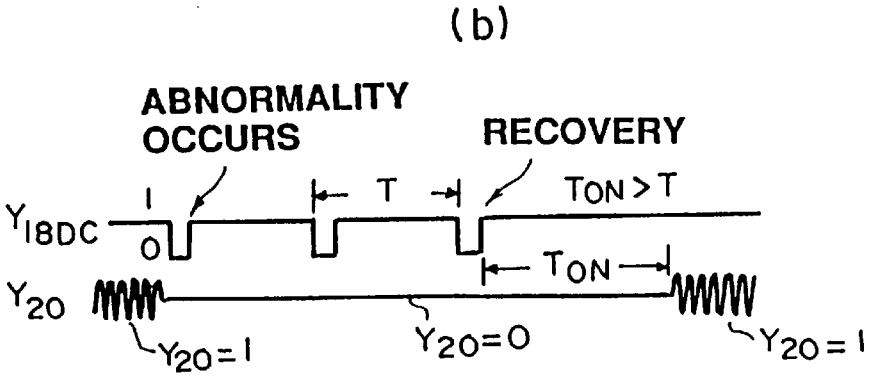

FIG. 51 illustrates a different embodiment.

With this embodiment, a fail-safe on-delay circuit 51 (having the characteristic that at the time of a fault the delay time is not lengthened) is used.

As follows is a description of this fail-safe on-delay circuit.

Figure 52:
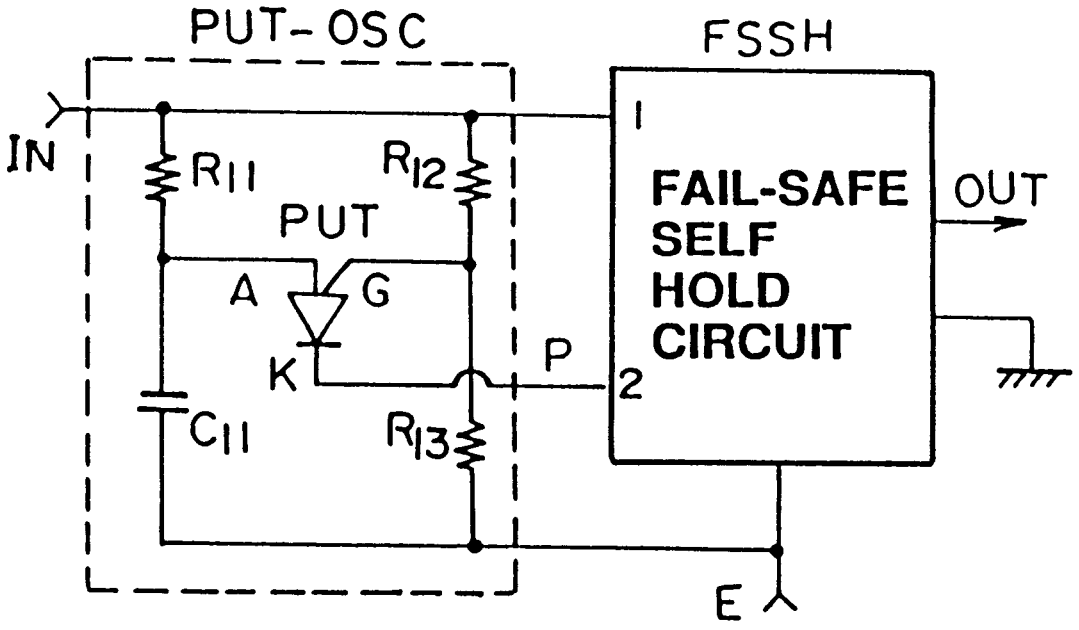
FIG. 52(*a*) is a diagram showing a structural example of a fail-safe on-delay circuit, while FIG. 52(*b*) is an output time chart.
Figure 52:
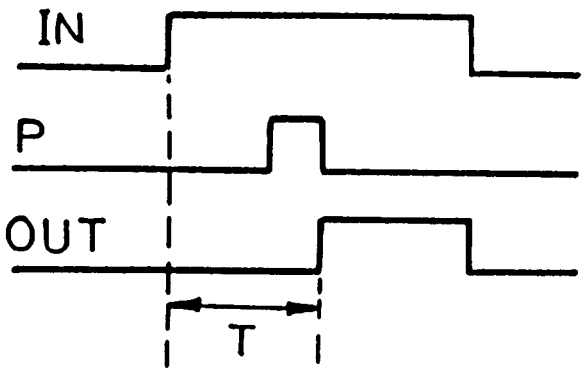

FIG. 52 shows an example of a fail-safe on-delay circuit.

In FIG. 52(*a*), FSSH denotes the self-hold circuit shown in FIG. 10, constructed such that an output signal from the fail-safe AND gate is fed back to the input terminal 2. PUT-OSC denotes a PUT oscillator which produces an oscillation pulse at a threshold value (a voltage division ratio for resistors R12 and R13) held by a PUT (programmable unijunction transistor), relative to a charging input determined by a time constant $R_{11}$•$C_{11}$, when an input signal IN is applied. That is to say, as shown by the time chart of FIG. 52(*b*), when the input signal IN rises, this is input to the input terminal 1 of the FSSH, and at the same time the capacitor $C_{11}$ is charged according to the time constant $R_{11}$•$C_{11}$, and after a time T seconds an output pulse P from the PUT is input to the input terminal 2 of the FSSH and is self held. Then, when the input signal IN drops, the output signal OUT is reset. The circuit of FIG. 52 has the following characteristics:

(1) the construction involves an AND gate having the characteristic that an erroneous output signal is not produced with a fault while there is no input signal to the self-hold circuit;

(2) with the PUT oscillator, if a fault occurs in any of the constituent elements of the circuit, there will be no trigger signal. For example, if a short circuit fault occurs between the gate and the cathode of the PUT, an input level which exceeds the threshold value of the terminal 2 of the FSSH will not result. This is provided that the materials used for the resistors R12, R13 will not result in a short circuit fault.

Such a fail-safe on-delay circuit is known for example from prior International Patent Publication No. WO94/23496.

In FIG. 51(*a*), a signal light abnormality detection circuit 50 and a voltage doubler rectifying circuit REC48 are the same as in FIG. 50. With the output signal $Y_{18DC}$ from the voltage doubler rectifying circuit REC48, if an abnormality occurs in the signal light illumination, then it is possible for $Y_{18DC}$=0 to be intermittently produced. $Y_{18DC}$=0 in FIG. 51(*b*) shows this. With the on-delay circuit 51, if $Y_{18DC}$=0 is produced, then the AC output signal disappears giving a logical output $Y_{20}$=0. Moreover, even if $Y_{18DC}$=1 occurs after this, if the delay time TON set in the on-delay circuit 51 is set to be greater than a control period T for the signal lights, then the AC output signal $Y_{20}$=1 will not occur. After the illumination of the signal lights has returned to normal, a signal $Y_{20}$=1 indicating normal will not be produced until delay time TON is exceeded.

Figure 53:
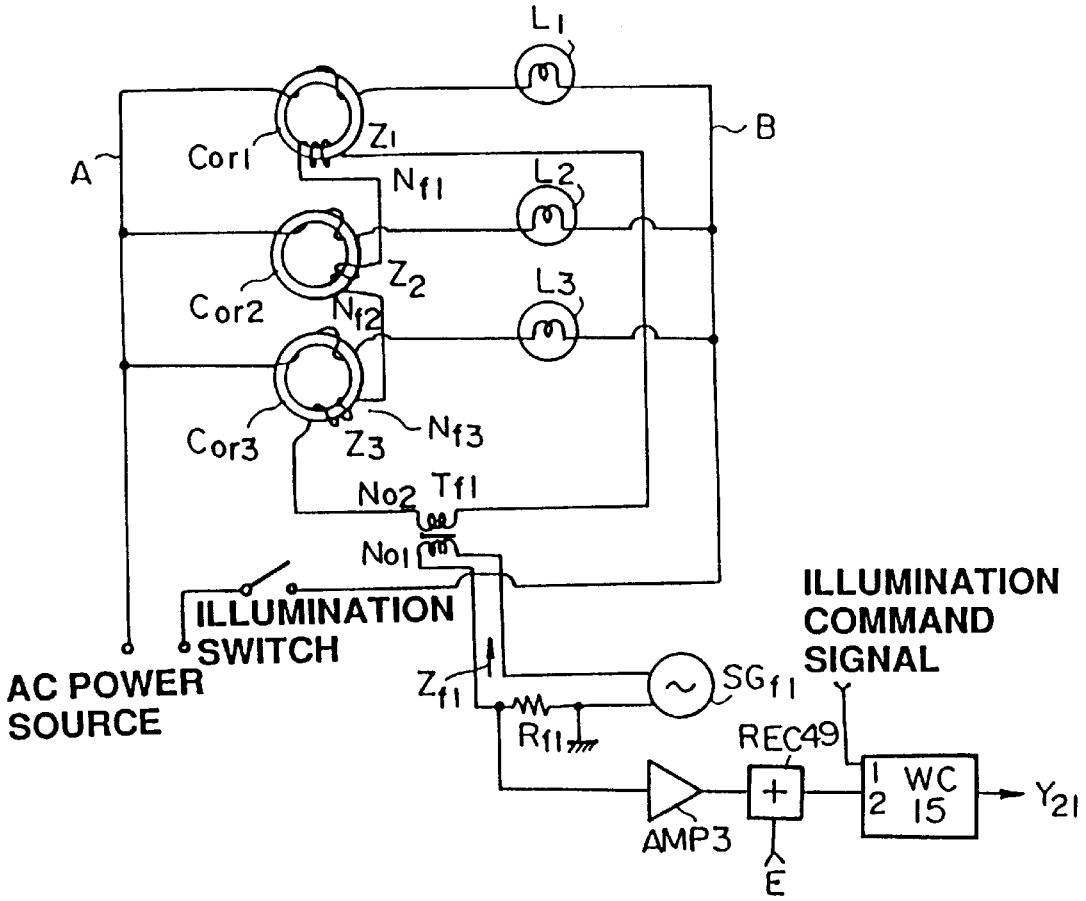
FIG. 53 is a circuit diagram showing an embodiment of a burn-out monitoring apparatus for the case where a plurality of signal lights are connected in parallel to a common power supply line.

Next is a description of an embodiment of a burn-out detection apparatus for detecting signal light burn-out, for the case of FIG. 53 where a plurality of signal lights are connected to one signal light power supply line.

FIG. 53 shows the case where three signal lights L1, L2 and L3 are connected to a signal light power supply line AB.

In FIG. 53, respective signal light leads are wound on saturable magnetic ring cores $C_{or1}$, $C_{or2}$, and $C_{or3}$. Moreover, respective second windings $N_{f1}$, $N_{f2}$ and $N_{f3}$ are wound on the saturable magnetic cores $C_{or1}$, $C_{or2}$ and $C_{or3}$. These are connected in series and connected to a secondary winding $N_{O2}$ of a transformer $T_{f1}$. A high frequency signal is supplied to a primary winding $N_{O1}$ of the transformer $T_{f1}$ from a high frequency signal generator $SG_{f1}$ via a resistor $R_{f1}$. The high frequency signal generator $SG_{f1}$ is constructed as in FIG. 4. A terminal voltage $e_f$ of the resistor $R_{f1}$ is amplified by an amplifier AMP3, rectified by a voltage doubler rectifying circuit REC49, and input to one input terminal 2 of a two input window comparator WC15. An illumination command signal is input to the other input terminal 1 of the window comparator WC15. Instead of the illumination command signal, an illumination signal for the signal lights L1, L2, L3 may be input.

Figure 54:
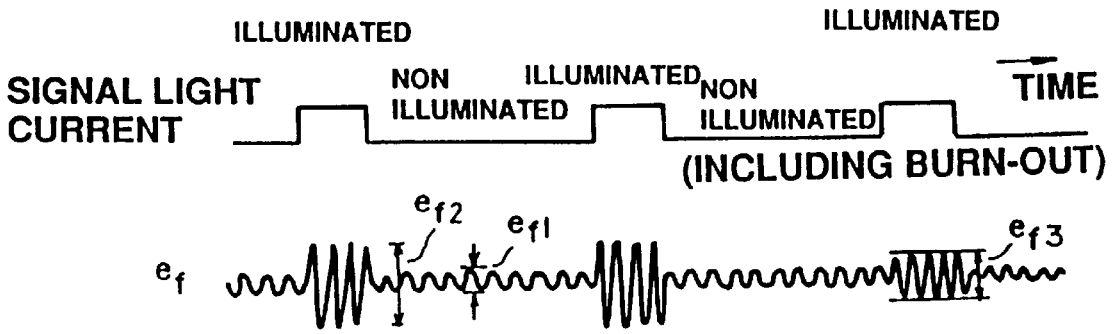
FIG. 54 is a time chart for the output from the circuit of FIG. 53.

Next is a description of the operation with reference to the time chart of FIG. 54.

As shown in FIG. 54, at the time of illumination, a current flows in the signal lights L1, L2 and L3 while at the time of non illumination no current flows. At the time of non illumination, since the saturable magnetic ring cores $C_{or1}$, $C_{or2}$ and $C_{or3}$ are not saturated, then the impedances $Z_1$, $Z_2$ and $Z_3$ of the respective windings $N_{f1}$, $N_{f2}$ and $N_{f3}$ show a high value. That is to say, the impedance $Z_{f1}$ seen from the primary side of the transformer $T_{f1}$ is low at the time of illumination and high at the time of non illumination, and hence the terminal voltage $e_f$ of the resistor $R_{f1}$, as shown in FIG. 54 becomes a high level (shown by $e_{f2}$) at the time of illumination and becomes a low level (shown by $e_{f1}$) at the time of non illumination. If in a worst case scenario, a burn-out condition occurs in one or more of the signal lights L1, L2 and L3 at the time of illumination, then the terminal voltage $e_f$ drops (shown by $e_{f3}$). When the signal $e_{f2}$ at the time of illumination of the signal lights L1, L2 and L3 drops (becomes $e_{f3}$) due to a burn-out, then this drop is detected by the lower limit threshold value of the input terminal of the window comparator WC15, so that the output signal $Y_{21}$ becomes a logic value 0. On the other hand, when the illumination command signal is input as a logic value 1 when the terminal voltage $e_f$ is at a normal level $e_{f2}$, an AC output signal with the output signal $Y_{21}$ as a logic value 1 is produced, thus showing that all of the signal lights L1, L2 and L3 are normally illuminated.

Figure 55:
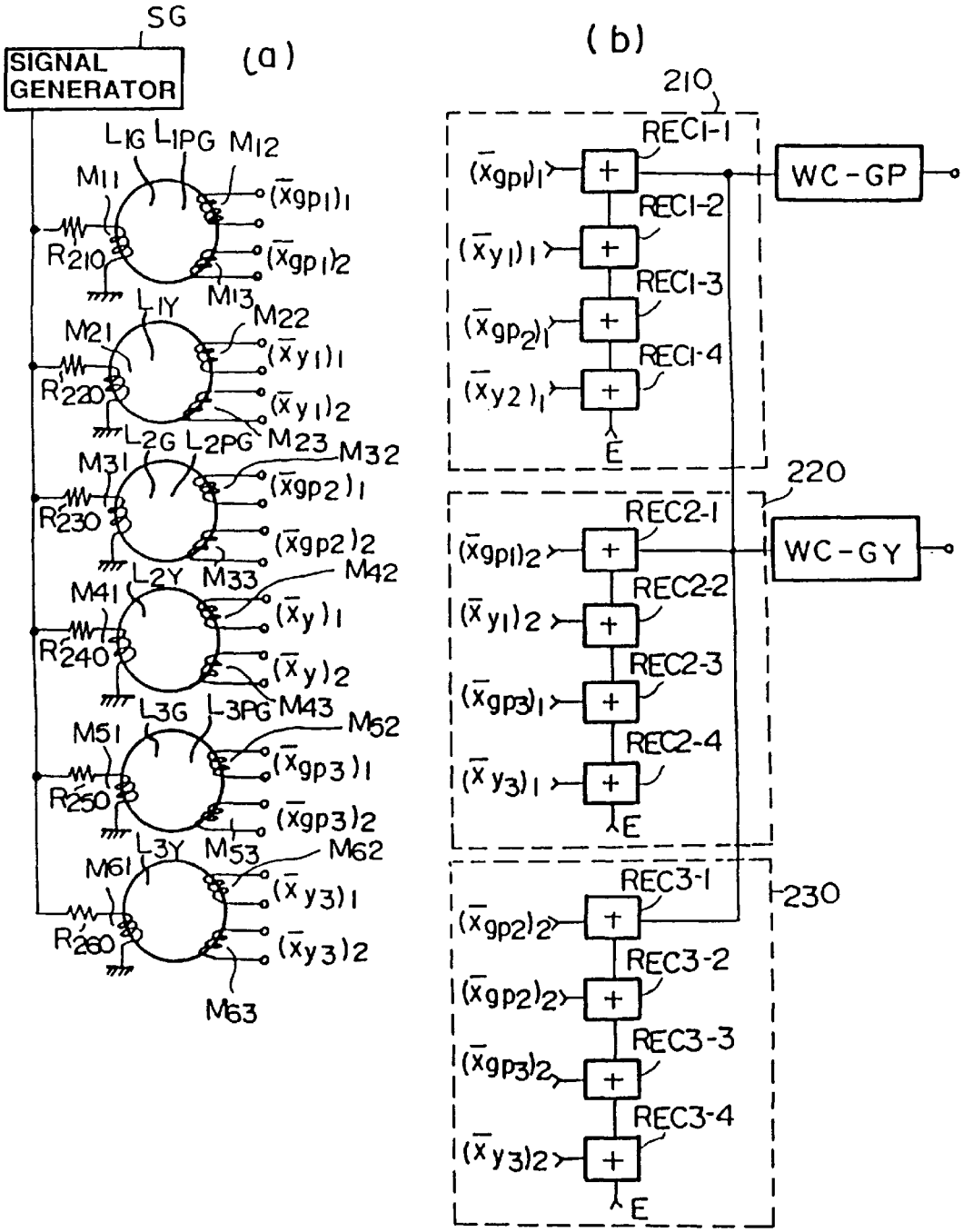
FIG. 55 is a circuit diagram of an embodiment of a monitoring apparatus for differentiating between respective simultaneous illumination faults of a green light pair, or a green light and a yellow light, FIG. 55(*a*) being a structural diagram of a current sensor section, and FIG. 55(*b*) being a structural diagram of a judgment circuit section.

FIG. 55 shows an embodiment of a different simultaneous illumination detection circuit.

Figure 56:
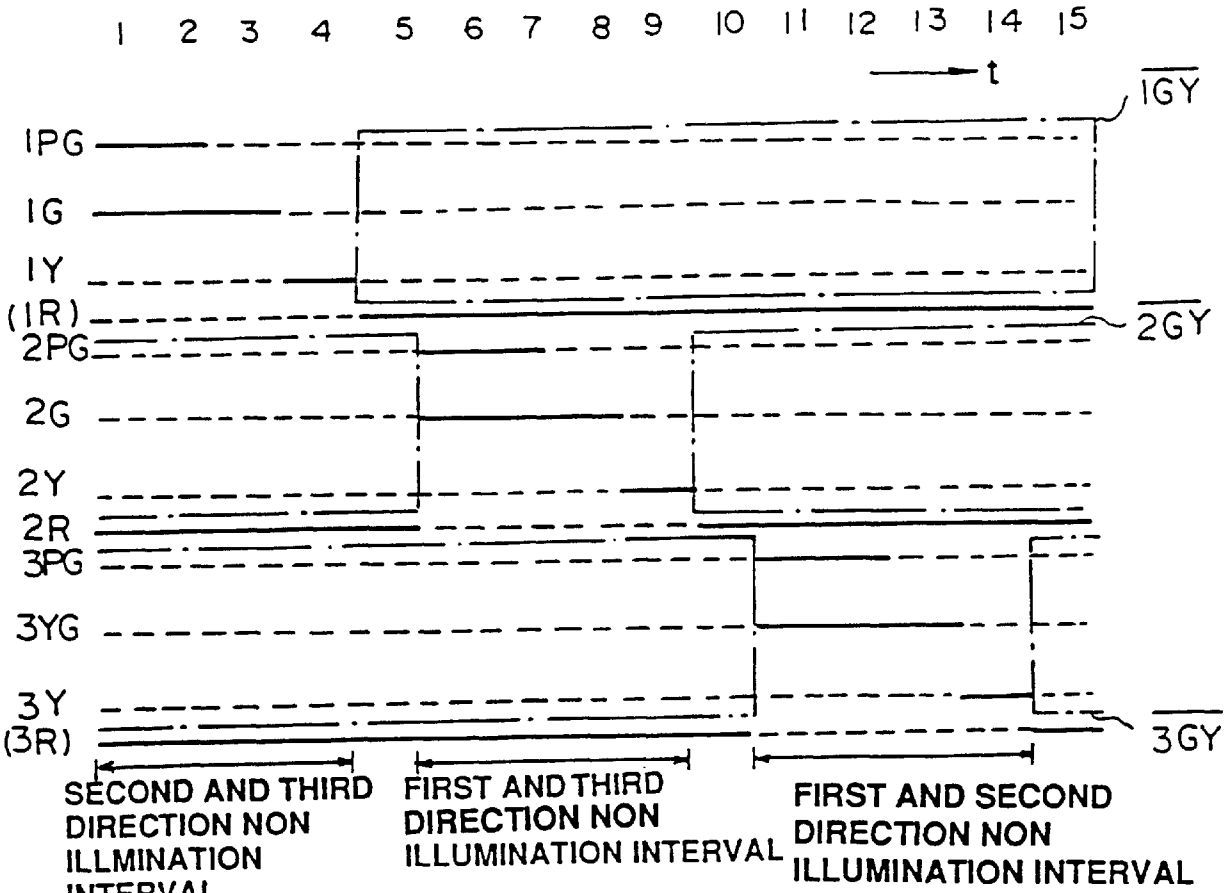
FIG. 56 is a relational diagram for the illumination of signal lights of a three way intersection, applicable to the apparatus of FIG. 55.

This embodiment is a circuit example for a case with a three way intersection with three roads intersecting with each other as illustrated in FIG. 56 (which is similar to FIG. 36), where danger information is separated into: danger information for when a simultaneous illumination occurs with pedestrian proceed permit lights PG (between 1PG and 2PG, 1PG and 3PG, or 2PG and 3PG), or a simultaneous illumination occurs with vehicle proceed permit lights G (between 1G and 2G, 1G and 3G, or 2G and 3G), or a simultaneous illumination occurs with a pedestrian proceed permit light PG and a vehicle proceed permit light G (excluding simultaneous illumination of the same direction pedestrian and vehicle proceed permit lights); and danger information for when a simultaneous illumination occurs with a green light G and a yellow light Y for different directions. In FIG. 56, the red light R is omitted.

FIG. 55 is a structural example of a signal light simultaneous illumination detection circuit with current sensors using saturable magnetic ring cores. In FIG. 55 (a), $M_{11}$, $M_{21}$, $M_{31}$, $M_{41}$, $M_{51}$ and $M_{61}$ indicate excitation windings wound onto respective saturable magnetic ring cores of respective first through sixth current sensors. The excitation current is supplied from a signal generator SG via respective resistors $R_{210}$, $R_{220}$, $R_{230}$, $R_{240}$, $R_{250}$ and $R_{260}$. $L_{1PG}$, $L_{1G}$, $L_{1Y}$ and $L_{2PG}$, $L_{2G}$, $L_{2Y}$, and $L_{3PG}$, $L_{3G}$, $L_{3Y}$ indicate power supply lines for respective signal lights for first, second and third directions, which are passed through the saturable magnetic ring cores. The directions of the current passing through the power supply lines $L_{1PG}$, $L_{1G}$, and $L_{2PG}$, $L_{2G}$ and $L_{3PG}$, $L_{3G}$ are respectively in the same direction. Windings $M_{12}$, $M_{13}$, and $M_{22}$, $M_{23}$, and $M_{32}$, $M_{33}$, and $M_{42}$, $M_{43}$ and $M_{52}$, $M_{53}$, and $M_{62}$, $M_{63}$ are windings for sampling the respective non saturated outputs at the time of non illumination. When a current flows in the power supply lines which pass through the saturable magnetic ring cores, the output signal from these windings becomes a low level. ($\overline{x}_{gp1})_1$, $(\overline{x}_{gp1})_2$, and $(\overline{x}_{y1})_1$, $(\overline{x}_{y1})_2$, and $(\overline{x}_{gp2})_1$, $(\overline{x}_{gp2})_2$, and ($\overline{x}_{y2})_1$, $(\overline{x}_{y2})_2$, and $(\overline{x}_{gp3})_1$, $(\overline{x}_{gp3})_2$, and $(\overline{x}_{y3})_1$, $(\overline{x}_{y3})_2$, indicate output signals from the respective windings $M_{12}$, $M_{13}$, and $M_{22}$, $M_{23}$, and $M_{32}$, $M_{33}$, and $M_{42}$, $M_{43}$ and $M_{52}$, $M_{53}$, and $M_{62}$, $M_{63}$. In FIG. 55(*b*), 210 through 230 indicate fifteenth, sixteenth and seventeenth adding circuits which are respectively constituted by voltage doubler rectifying circuits REC1-1 through REC1-4, REC2-1 through REC2-4, and REC3-1 through REC3-4. The adding circuit 210 adds the respective winding output signals $(\overline{x}_{gp1})_1$, $(\overline{x}_{y1})_1$, $(\overline{x}_{gp2})_1$ and $(\overline{x}_{y2})_1$ for when the first direction signal lights 1PG, 1G. 1Y and the second direction signal lights 2PG, 2G, 2Y shown in FIG. 56 are not illuminated (the interval shown by $\overline{1GY}$ and $\overline{2GY}$). The adding circuit 220 adds the respective winding output signals $(\overline{x}_{gp1})_2$, $(\overline{x}_{y1})_2$, $(\overline{x}_{gp3})_1$ and $(\overline{x}_{y3})_1$ for when the first direction signal lights 1PG, 1G, 1Y and the third direction signal lights 3PG, 3G, 3Y are not illuminated (the interval shown by $\overline{1GY}$ and $\overline{3GY}$). The adding circuit 230 adds the respective winding output signals $(\overline{x}_{gp2})_2$, $(\overline{x}_{y2})_2$, ($\overline{x}_{gp3})_2$ and $(\overline{x}_{y3})_2$ for when the second direction signal lights 2PG, 2G, 2Y and the third direction signal lights 3PG, 3G, 3Y are not illuminated (the interval shown by $\overline{2GY}$ and $\overline{3GY}$).

In FIG. 55, it for example the number of turns for the windings $M_{12}$, $M_{13}$ for monitoring the non illumination of the signal light 1G, 1PG and producing an output voltage, and the number of turns for the windings M22, M23 for monitoring the non illumination of the signal light 1Y and producing an output voltage, are made different, then in the case where saturable magnetic ring cores having the same properties are used, with the windings $M_{11}$, $M_{21}$ having the same number of turns, then the magnitude of the output signals $(\overline{x}_{gp1})_1$, $(\overline{x}_{gp1})_2$, and the output signals $(\overline{x}_{y1)1}$, $(\overline{x}_{y1})_2$ can be made different. For example, if the non illumination output levels (rectified output levels) for $(\overline{x}_{gp1)1}$, $(\overline{x}_{gp1})_2$, ($\overline{x}_{gp2})_1$, $(\overline{x}_{gp2})_2$ and $(\overline{x}_{gp3})_1$, $(\overline{x}_{gp3})_2$ are 6V. and the non illumination output levels (rectified output levels) for $(\overline{x}_{y1})_1$, $(\overline{x}_{y1})_2$, $(\overline{x}_{y2})_1$, $(\overline{x}_{y2})_2$ and $(\overline{x}_{y3})_1$, $(\overline{x}_{y3})_2$ are 3V, then the addition output signals from the adding circuits 210, 220 and 230 are respectively 18V. Therefore, when for example the output level from the adding circuit 210 is 18V, then if an illumination condition occurs in the signal lights 1G or 1PG, or the signal lights 2G or 2PG, then the output level from the adding circuit 210 becomes 12V, dropping by 6V. On the other hand, if at this time (at the time with 18V) the signal light 1Y or 2Y is illuminated, then the output level from the adding circuit 210 becomes 15V (drops 3V). With the fail-safe window comparators WC-GP and WC-GY, when the input level is 18V, a high level output signal of logic value 1 is output. Moreover, with the window comparator WC-GP, if the input level drops 6V, a low level or a zero level output signal of logic value 0 is output. Therefore, the lower limit threshold value $T_L$ of the window comparator WC-GP is set between 15V and 12V (for example 13.5V) (the upper limit threshold value $T_H$ is set sufficiently higher than 18V). Moreover, with the window comparator WC-GY, if the input level drops 3V, a low level or a zero level output signal of logic value 0 is output. Therefore, the lower limit threshold value $T_L$ of the window comparator WC-GY is set between 18V and 15V (for example 16.5V) (the upper limit threshold value $T_H$ is set sufficiently higher than 18V)

If the threshold values for the window comparators WC-GP and WC-GY are set in this way, then the window comparator WC-GP outputs a logic value 1 even if a simultaneous illumination occurs between a yellow light Y and a green light GP or G, and intermittently produces a logic value 0 only if a simultaneous illumination occurs between green lights GP or G.

On the other hand, the window comparator WC-GY intermittently produces a logic value 0 if a simultaneous illumination occurs between green lights GP or G, and also if a simultaneous illumination occurs between a yellow light Y and a green light GP or G.

Figure 57:
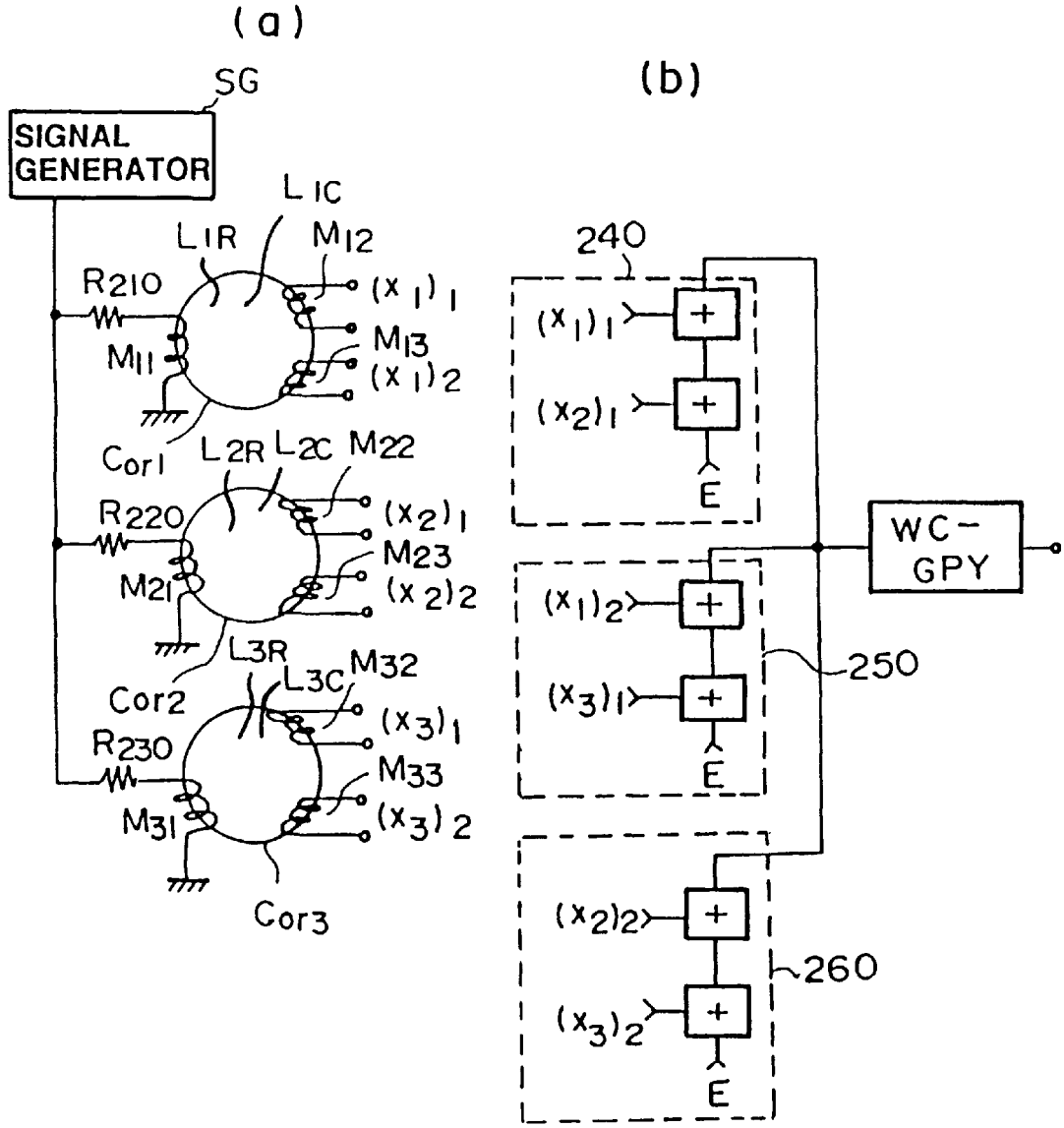
FIGS. 57*a, b* are a circuit diagram of an embodiment for the case where a red light power supply line is used for a common power supply line in monitoring for simultaneous illumination faults, FIG. 57(*a*) being a structural diagram of a current sensor section, and FIG. 57(*b*) being a structural diagram of a judgment circuit section.

FIG. 57 shows an embodiment for the case where signal light non illumination signals are sampled from a common signal light power supply line.

The power supply line for normal traffic signal lights is made up of illumination wires for the green light G, the yellow light Y, and the red light R, and one common lead. Consequently, since an illumination current for any one of the signal lights G, Y or R always flows in the common lead, then the non illumination signals for the green light G and the yellow light Y can not be sampled by a sensor coil for detecting zero current.

Therefore, in FIG. 57 as shown in (a), common leads $L_C$ for the respective signal lights pass through the saturable magnetic ring cores $C_{or1}$, $C_{or2}$ and $C_{or3}$, and at the same time power supply lines $L_{1R}$, $L_{2R}$ and $L_{3R}$ for the red lights 1R, 2R and 3R are passed through in the opposite winding direction to the common leads $L_C$.

With this arrangement, since when the red light R is illuminated, the current flowing through the common lead, and the illumination current for the red light R are equal, then the resultant magnetic field inside the saturable magnetic ring core is balanced out, so that the saturable magnetic ring core is not saturated. That is to say, the output signals from the respective saturable magnetic cores $C_{or1}$, $C_{or2}$ and $C_{or3}$ of FIG. 57 become high level output signals when, for the saturable magnetic core $C_{or1}$, a current does not flow in the signal lights 1G, 1Y, and when, for the saturable magnetic core $C_{or2}$, a current does not flow in the signal lights 2G, 2Y[and when, for the saturable magnetic core $C_{or3}$, a current does not flow in the signal lights 3G, 3Y. As shown in FIG. 57(*b*), the adding circuits 240, 250 and 260 carry out respective logical sum operations on the sum of the output signals $(x_1)_1$ and $(x_2)_1$, the sum of the output signals $(x_1)_2$ and $(x_3)_1$, and the sum of the output signals $(x_2)_2$ and $(x_3)_2$ for when the respective signal lights 1R, 2R and 3R are illuminated. With the window comparator WC-GPY, if the respective current output signals are 3V, then an output level due to addition of 6V is made normal, while less than 6V is not normal.

Figure 58:
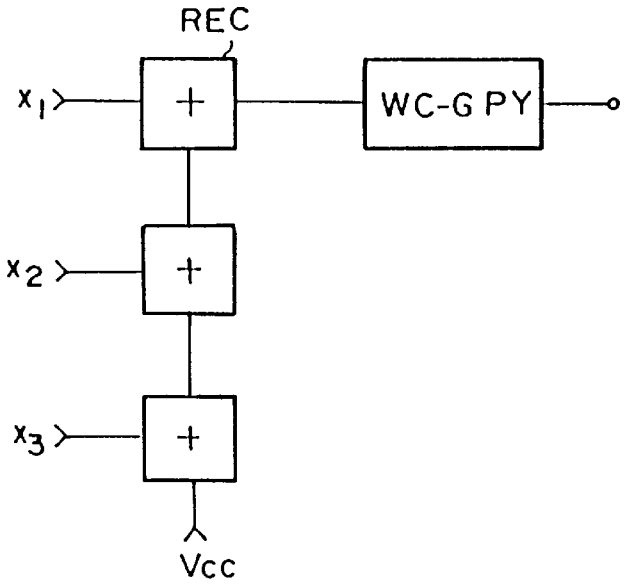
FIG. 58 is a circuit diagram of another embodiment for the case where a red light power supply line is used for a common power supply line in monitoring for simultaneous illumination faults.

FIG. 58 shows a circuit example for where the number of output windings for the saturable magnetic ring cores $C_{or1}$, $C_{or2}$ and $C_{or3}$ is not two windings, but is only the respective output windings $M_{12}$, $M_{22}$ and $M_{32}$. Here the respective output signals $(x_1)_1$, $(x_2)_1$ and $(x_3)_1$ therefrom are added by adding circuits comprising voltage doubler rectifying circuits, and when the addition value is 6V or above, an output signal of logic value 1 indicating normal is generated from a window comparator WC-GPY, while if less than 6V, an output signal of logic value 0 is generated indicating an abnormal illumination condition. (The respective rectified output signal levels are 3V).

Figure 59:
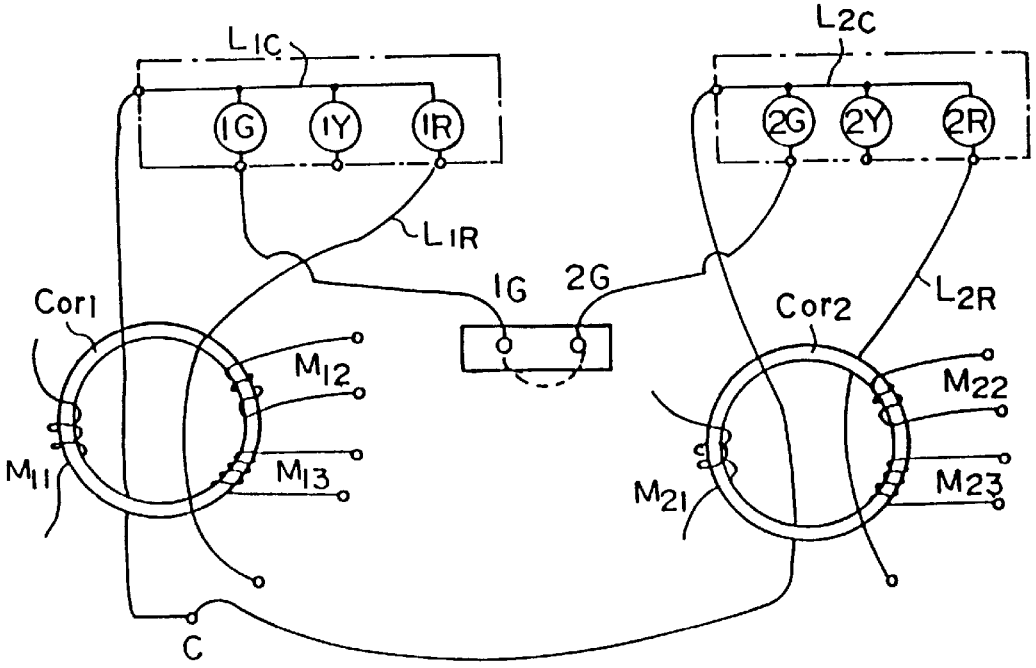
FIG. 59 is a diagram for explaining advantages in the case where a red light power supply line is used for a common power supply line in monitoring for simultaneous illumination faults.

With the circuit configuration of FIG. 57 or FIG. 58, simultaneous illumination detection is possible even in a worst case situation as shown in FIG. 59, where for some reason a short circuit as shown by the dashed line in FIG. 59 occurs between junction connection terminals for the power supply lines of for example the first direction signal light 1G and the second direction signal light 2G. Erroneous illumination due to this often occurs due to lack of care with the connections during construction work, or due to rain permeating into the junction box. In FIG. 59, C indicates a common wiring terminal.

Next is a description of an embodiment of a signal light illumination control apparatus configured such that, with a signal unit S1 and a signal unit S2 for intersecting roads, one of the proceed permit lights G is illuminated, on the proviso that the other proceed permit light is not illuminated.

At a two way intersection for example, there is a time when neither the signal light 1G nor the signal 2G is illuminated.

Therefore, if, using electrical contact points, a non illumination signal $\overline{x}_{g1}=1$ for the signal light 1G is input as an illumination condition for the signal light 2G, and a non illumination signal $\overline{x}_{g2}=1$ for the signal light 2G is input as an illumination condition for the signal light 1G, then at the time of switching the illumination conditions on and off, the current is never cut off.

Figure 60:
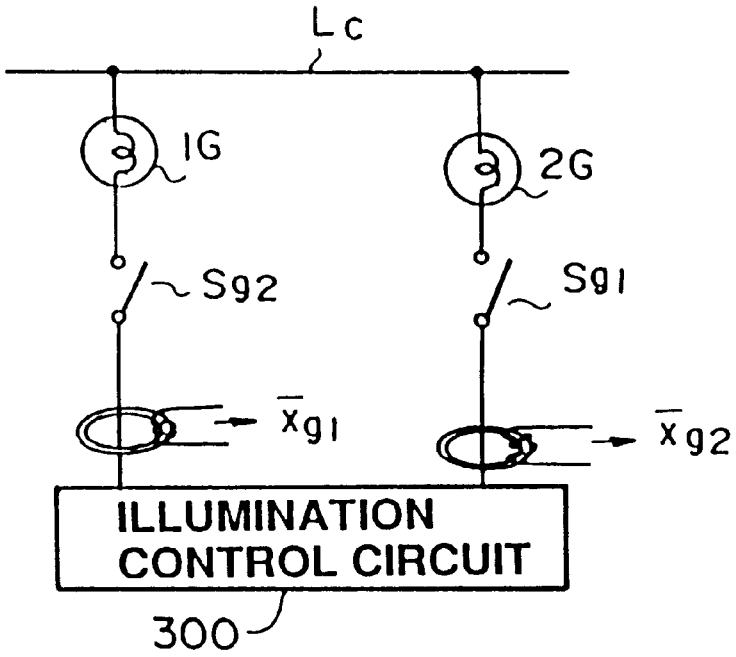
FIG. 60(*a*) is a circuit diagram of an embodiment of a signal light control apparatus where a non illumination condition for the green lights for the respective directions of intersecting roads, is introduced as an illumination proviso for the corresponding green lights for the respective other directions, and FIG. 60(*b*) being an excitation circuit diagram of an electromagnetic relay.
Figure 60:
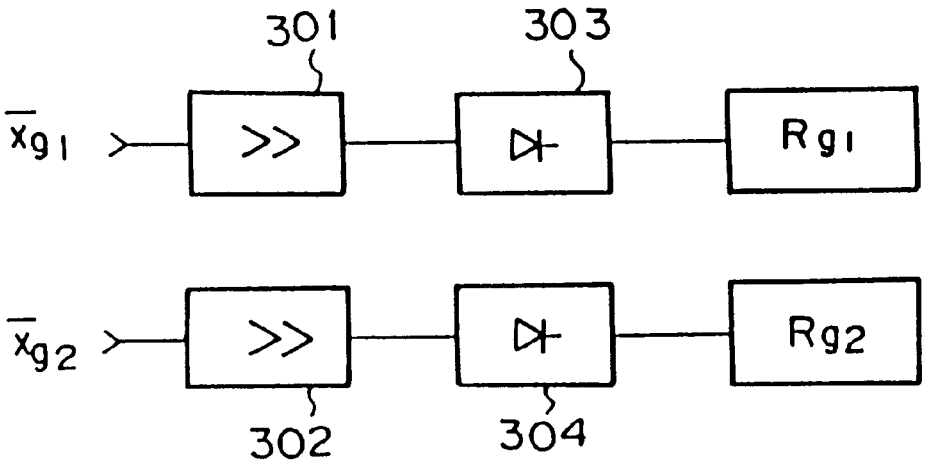

Basically, a s shown in FIG. 60, make contact points $S_{g2}$ of a second electromagnetic relay $R_{g2}$ excited by a non illumination signal $\overline{x}_{g2}=1$ for a signal light 2G, and make contact points $S_{g1}$ of a first relay $R_{g1}$ excited by a non illumination signal $\overline{x}_{g1}=1$ for a signal light 1G, are respectively disposed in the illumination leads for the signal lights 1G and 2G, between a power supply line $L_C$ and an illumination control circuit 300.

The non illumination signals $\overline{x}_{g1}$, $\overline{x}_{g2}$ correspond to the output signal $\overline{x}_{g1}$ from the current sensor shown in FIG. 16. As shown in FIG. 60(*b*) these are respectively amplified by amplifiers 301, 302, rectified by rectifying circuits 303, 304, and then supplied to electromagnetic relays $R_{g1}$, $R_{g2}$.

Consequently, the signal light 1G is illuminated when, with non illumination of the signal light 2G, the electromagnetic relay $R_{g2}$ is excited so that the contact points $S_{g2}$ come on, while the signal light 2G is illuminated when, with non illumination of the signal light 1G, the electromagnetic relay $R_{g1}$ is excited so that the contact points $S_{g1}$ come on. If with one of the signal lights 1G (or 2G) in the illuminated condition, there is an attempt to illuminate the other signal light 2G (or 1G), this other signal light 2G (or 1G) will not illuminate.

Industrial Applicability

The present invention has a fail-safe construction which can monitor the illumination condition of traffic signal lights provided at an intersection or the like and reliably advise when an abnormal illumination condition arises, and which can also warn of an abnormality at the time of a fault in the monitoring apparatus. Safety of a traffic signal light control system can thus be improved, and hence industrial applicability is considerable.

What is claimed is:

1. A monitoring apparatus for traffic signal lights comprising:

sensor means for detecting an illumination condition of traffic signal lights of a plurality of traffic signal light devices which are provided at an intersection and are subjected to an illumination/non illumination control in connection with each other; and judgement means for generating an output of logic value 1 corresponding to a high energy condition indicating a normal condition of the signal lights when, based on an output from said sensor means, the number of illuminated or non illuminated signals lights of said plurality of traffic signal light devices is a predetermined number, and generating an output of logic value 0 corresponding to a low energy condition indicating an abnormal condition of the signal lights when the number of illuminated or non illuminated signals lights of said plurality of traffic signal light devices is not the predetermined number.

2. A monitoring apparatus for traffic signal lights according to claim 1, wherein said sensor means is provided for each signal light, and is constructed so as to generate an AC signal at the time of illumination of the signal light, and not to generate an AC signal at the time of non illumination, and said judgment means is constructed so as to generate an output of logic value 1 when an addition signal level of the AC signals from the respective sensor means is a predetermined level, and to generate an output of logic value 0 when not the predetermined level.

3. A monitoring apparatus for traffic signal lights according to claim 2, wherein said sensor means is a current sensor with a power supply line for the signal light wound around a saturable magnetic core such that an excitation signal for the saturable magnetic core input from a high frequency signal generator is received on an output side at a high level at the time of power to said power supply line, and is received on the output side at a low level at the time of no power supply.

4. A monitoring apparatus for traffic signal lights according to claim 1, wherein a self-hold circuit is provided with the output from said judgment means as a reset input signal, and a signal light power source switch on signal as a trigger input signal, which self-holds said trigger input signal, and an output from said self hold circuit is made a judgment output for a signal light burn-out fault.

5. A monitoring apparatus for traffic signal lights according to claim 1, wherein said judgement means generates an output of logic value 1 when the number of non illuminated signal lights is a predetermined number, and generates an output of logic value 0 indicating a signal light simultaneous illumination fault where simultaneous illumination is not permitted, when the number of non illuminated signed lights is not the predetermined number.

6. A monitoring apparatus for traffic signal lights according to claim 5, wherein said sensor means is provided for each signal light, and is constructed so as to generate an AC signal at the time of non illumination of the signal light, and not to generate an AC signal at the time of illumination, and said judgment means is constructed so as to generate and output of logic value 1 when an addition signal level of the AC signals from the respective sensor means is a predetermined level, and to generate an output of logic value 0 when the addition signal level of the AC signals from the respective sensor means is not the predetermined level.

7. A monitoring apparatus for traffic signal lights according to claim 6, wherein said sensor means is a current sensor with a power supply line for the signal light wound around a saturable magnetic core such that an excitation signal for the saturable magnetic core input from a high frequency signal generator is received on an output side at a high level at the time of no power to said power supply line, and is received on the output side at a low level at the time of power supply.

8. A monitoring apparatus for traffic signal lights according to claim 5, wherein a self-hold circuit is provided with the output from the judgment means as a reset input signal, and a signal light power source switch on signal as a trigger input signal, which self-holds said trigger input signal, and an output from said self hold circuit is made a judgment output for a simultaneous illumination fault.

9. A monitoring apparatus for traffic signal lights wherein the signal lights for the same road side of a two way intersection where two roads intersect are made one group, and wherein for each group the illumination condition of a permit signal light indicating permission to proceed is detected using sensor means which outputs a binary logic signal, generating an AC signal and outputting a logic value 1 when a signal light is not illuminated, and not generating an AC signal and outputting a logic value 0 when the signal light is illuminated, and wherein there is provided judgment means which, based on the output conditions from the sensor means for each group, generates an output of logic value 1 corresponding to a high energy condition indicating the signal lights are normal, when at least one group shows a non illuminated condition, and generates an output of logic value 0 corresponding to a low energy condition indicating a simultaneous illumination fault when neither group shows a non illuminated condition.

10. A monitoring apparatus for traffic signal lights according to claim 9, wherein in the case of only one permit signal light for the respective groups, said judgment means comprises a third logical sum operation circuit for carrying out a logical sum operation on the logical output from the respective sensor means for each respective group, and the logical sum operation output is made a judgment output.

11. A control apparatus for traffic signal lights incorporating an illumination control circuit for controlling the illumination of signal lights of respective signal light units installed at an intersection where several roads intersect, said control apparatus comprising: a signal light monitoring circuit provided with, sensor means for detecting an illumination condition of respective signal lights, and judgment means for generating an output of logic value 1 corresponding to a high energy condition indicating a normal condition of the signal lights when, based on an output from said sensor means, the number of illuminated or non-illuminated signal lights is a predetermined number, and generating an output of logic value 0 corresponding to a low energy condition indicating an abnormal condition of the signal lights when the number is not the predetermined number; and a signal light power supply control circuit which supplies power to the signal lights when an output of logic value 1 is generated from said signal light monitoring circuit, and which stops power supply to the signal lights when an output of logic value 0 is generated;

wherein said signal light monitoring circuit comprises:

sensor means constructed so as to generate an AC signal at the time of non-illumination of a signal light, and not to generate an AC signal at the time of illumination; and judgment means which generates an output of logic value 1 when the number of non-illumination outputs from said sensor means is a predetermined number, and generates an output of logic value 0 indicating a signal light simultaneous illumination fault where simultaneous illumination is not permitted, when not the predetermined number;

wherein said signal light power supply control circuit has an electromagnetic relay having relay contact points disposed in series in the power supply lines for the respective signal lights, the construction being such that said electromagnetic relay is placed in a non-excited condition with said contact points open, based on an output of logic value 0 indicating simultaneous illumination from said signal light monitoring circuit; and wherein said signal light power supply control circuit incorporates:

a first self-hold circuit with a signal light power source switch on signal as a trigger input signal, and an output from said signal light monitoring circuit as a reset input signal, which self-hold said trigger input signal, the construction being such that said electromagnetic relay is excited and the contact points thus closed with an output of logic value 1 from said first self-hold circuit when a reset input signal of logic value 1 indicating normal signal lighting from said monitoring circuit, and a trigger input signal of logic value 1 due to said power source switch on signal are input together.

* * * * *